US006115020A

United States Patent [19]

Taguchi et al.

[11] Patent Number: 6,115,020

[45] Date of Patent: Sep. 5, 2000

[54] LIQUID CRYSTAL DISPLAY DEVICE AND DISPLAY METHOD OF THE SAME

[75] Inventors: Yoshihisa Taguchi; Katsunori Tanaka; Toshiya Onodera; Katsuhiko Kishida; Hirofumi Miyamoto; Hiroyuki Isogai; Tsutomu Kai; Masanori Nakamura, all of Kawasaki, Japan

[73] Assignee: Fujitsu Limited, Kawasaki, Japan

[21] Appl. No.: 08/726,021

[22] Filed: Oct. 4, 1996

[30] Foreign Application Priority Data

Mar. 29, 1996 [JP] Japan ..... 8-077937
Aug. 19, 1996 [JP] Japan ..... 8-217492

[51] Int. Cl.[7] ..... G09G 5/26

[52] U.S. Cl. ..... 345/99; 345/98; 345/130; 348/793

[58] Field of Search ..... 345/130, 131, 345/132, 87, 98, 99, 100; 348/793

[56] References Cited

U.S. PATENT DOCUMENTS

| | | | |
|---|---|---|---|
| 4,775,891 | 10/1988 | Aoki et al. | 345/87 |
| 4,907,284 | 3/1990 | Ohuchi | 345/127 |
| 5,097,518 | 3/1992 | Scott et al. | 382/47 |
| 5,122,789 | 6/1992 | Ito | 345/130 |
| 5,351,064 | 9/1994 | Zenda | 345/3 |
| 5,364,284 | 11/1994 | Matsumoto et al. | 348/793 |
| 5,448,259 | 9/1995 | Hidaka | 345/98 |
| 5,461,424 | 10/1995 | Shimizu | 345/100 |
| 5,475,437 | 12/1995 | Song | 345/130 |
| 5,521,614 | 5/1996 | Kotha et al. | 345/128 |
| 5,600,347 | 2/1997 | Thompson et al. | 345/132 |
| 5,721,565 | 2/1998 | Nguyen | 345/127 |

FOREIGN PATENT DOCUMENTS

| | | |
|---|---|---|
| 4-147212 | 5/1992 | Japan . |
| 5-48992 | 2/1993 | Japan . |
| 5-232899 | 9/1993 | Japan . |
| 667647 | 3/1994 | Japan . |
| 75844 | 1/1995 | Japan . |
| 7181943 | 7/1995 | Japan . |
| 7219485 | 8/1995 | Japan . |

*Primary Examiner*—Steven J. Saras
*Assistant Examiner*—Amr Awad
*Attorney, Agent, or Firm*—Greer, Burns & Crain Ltd.

[57] ABSTRACT

A display device includes a display panel having display pixels arranged in matrix formation. A first driver circuit sequentially supplies image data to vertical lines of the display panel in synchronism with a first clock signal. A second driver circuit sequentially drives horizontal lines in synchronism with a second clock signal. A control circuit controls a drive timing at which the second driver circuit sequentially drives the horizontal lines so that identical image data equal to one horizontal line is supplied, from the first driver circuit in synchronism with the first clock signal, to two consecutive horizontal lines every N horizontal lines (N is an integer) in accordance with an enlargement ratio at which an image is enlarged in a vertical direction and is displayed on the display panel.

29 Claims, 53 Drawing Sheets

(1) ~(6):SCAN BUS LINES #1~#6

(1) ~(14):SCAN BUS LINES #1~#14

FIG. 46

| DISPLAY MODE | SYNC SIGNALS | |
|---|---|---|
| | /HS | /VS |
| 640×480 | 25.42μs | 16.68ms |
| 800×600 | 20.80μs | 13.85ms |
| 1024×768 | 17.17μs | 14.27ms |

LIQUID CRYSTAL DISPLAY DEVICE AND DISPLAY METHOD OF THE SAME

BACKGROUND OF THE INVENTION

1. Field of the Invention

The present invention generally relates to liquid crystal display devices, and more particularly to a liquid crystal display device capable of extending an arbitrary portion of a display at an arbitrary magnification. More particularly, the present invention is concerned with a liquid crystal display device equipped with an active-matrix type liquid crystal display panel having switching elements, such as TFTs (Thin Film Transistors), provided for respective pixels and arranged in a matrix formation, or a matrix type liquid crystal display panel having a matrix electrode structure called CS-ON-GATE. Further, the present invention relates to a display method of such liquid crystal display devices.

Recently, image signals output by a computer, a workstation or the like have been required to realize highly precise, high-quality display. Hence, there has been considerable activity in the development of a highly precise, high-quality display device. A display device of a matrix-formation structure is required to have a larger number of pixels (display elements). Further, it is required that a display device can operate in a plurality of display modes because a personal computer, a workstation or the like can output image signals in conformity with a plurality of display modes such as VGA, SVGA and XGA.

Generally, the image signals output by the computers have a predetermined number of pixels. For example, the VGA consists of 640×480 pixels, the SVGA consists of 800×600 pixels, and the XGA consists of 1024×768 pixels.

When an image formed in the VGA or SVGA mode is displayed on a display device capable of operating in the XGA mode, such an image is partially displayed on the whole display screen. In this case, the operator will feel that the display is not bright. Such feeling is particularly conspicuous in the display device of a projection type. In order to avoid the above problem, the original image is enlarged and displayed so that an extended image is displayed on the substantially whole display screen.

Normally, a display is enlarged in both the horizontal and vertical directions. In the following, an enlargement in the horizontal direction will be described first with reference to FIGS. 1 through 4, and an enlargement in the vertical direction will be described second.

2. Description of the Related Art

FIG. 1 is a block diagram of a liquid crystal display device related to the present invention. A liquid crystal display device 9 shown in FIG. 1 includes a liquid crystal display panel 1A, a horizontal driver circuit 3, a vertical driver circuit 2, and a timing control circuit 4. The liquid crystal display panel 1A has switching elements provided for respective pixels and arranged in a matrix formation. Such switching elements are formed of, for example, thin film transistors. The horizontal driver circuit 3 performs a horizontal scan control in which image data amounting to one horizontal line (which is also called scan bus line) is serially written into the switching elements equal to one horizontal line in synchronism with a shift clock signal for the horizontal direction. The above horizontal scan control is initiated in a start signal for the horizontal scan. The vertical driver circuit 2 performs a write timing control in which the switching elements forming one vertical line (which is also called data bus line) are serially selected in synchronism with a shift clock signal for the vertical direction. The above write timing control is initiated in response to a start signal for the vertical scan. The timing control circuit 4 generates timing control signals 4*a* for controlling a displaying operation. The timing control signals 4*a* include the above-mentioned start signal for the horizontal scan, the timing signal for the horizontal direction, the start signal for the vertical scan, and the timing signal for the vertical direction.

An image memory 4A is provided in the timing control circuit 4 in order to display an image extended in the vertical direction. The same image data as that forming an image of one horizontal line is written, every predetermined number of horizontal lines dependent on an enlargement ratio, into the next line so that the identical image data is written into the two consecutive horizontal lines consisting of the last line of the predetermined number of horizontal lines and the above next line. Since the image data is serially applied to the horizontal driver circuit 3, there is not enough time to write identical image data into two consecutive horizontal lines. The image memory 4A is used to realize the above write operation. The image memory 4A may be formed of an FIFO (First-In First-Out) memory and adjusts the timing at which image data is received and the timing at which image data is written every line.

FIG. 2 is a timing chart of the timing control circuit 4 equipped with the FIFO memory 4A. As shown in FIG. 2, the same image data as that forming the last line of three horizontal lines is written, every three horizontal lines, into the next horizontal line following the above last horizontal line. Image data is serially written into the FIFO memory 4A every horizontal line. The read timing of the FIFO memory 4A is controlled so that image data forming the last line of the three horizontal lines is read again to form the image of the next horizontal line. For example, image data (3) equal to one line is consecutively read from the FIFO memory 4A twice and is applied to the horizontal driver circuit 3 shown in FIG. 1.

The liquid crystal display panel 1A shown in FIG. 1 can be replaced by a matrix-type liquid crystal panel 1B having a matrix electrode structure called CS-ON-GATE directed to a high aperture ratio.

FIG. 3 is an enlarged plan view of a pixel and its peripheral circuit of the matrix type liquid crystal panel 1B of the CS-ON-GATE matrix electrode structure. FIG. 4 is a circuit diagram of the structure shown in FIG. 3. As is known, the CS-ON-GATE matrix electrode structure has a TFT substrate on which data bus lines (signal electrodes) including a data bus line 5A and scan bus lines including scan bus lines 5B-1 and 5B-2 are formed in a matrix formation. At the crosspoints of the lines are provided switching elements 6 formed of TFT. A common electrode is provided on a common substrate. The data bus lines including the line 5A are connected to the horizontal scan driver 3 shown in FIG. 1, and the scan bus lines including the lines 5B-1 and 5B-2 are connected to the vertical driver circuit 2. A liquid crystal display capacitor CLC is connected between the TFT 6 and a common substrate reference voltage VC.

A compensation capacitor CS, provided for each pixel, is provided to minimize a drop of the pixel potential caused by a floating capacitance of the TFT 6. The compensation capacitor CS is connected to the TFT 6 and the scan bus line next to the scan bus line to which the above TFT 6 is connected. In the case of FIG. 4, the compensation capacitor CS is connected to the TFT 6 and the adjacent scan bus line 5B-2.

The voltage corresponding to the image data (one-pixel image data) is applied to the data bus line 5A by the horizontal driver circuit 3. When the scan bus line 5B-1 is selected by the vertical driver circuit 2, the above voltage of the data bus line 5A is applied to the display capacitor CLC via the TFT 6 and is held until the scan bus line 5B-1 is selected the next time. The applied voltage determines the orientation of the liquid crystal (pixel) and thus controls the optical transparency ratio. Hence, a gradation display can be realized.

The inventors consider that the related art which has been described with reference to FIGS. 1 and 2 has the following disadvantage. As has been described, it is necessary to provide the image memory 4A formed of an FIFO memory or the like in order to realize an enlarged display enlarged in the vertical direction. The use of the image memory 4A requires a complex read timing control in order to realize the above-mentioned enlarged display.

The inventors consider that the related art which has been described with reference to FIGS. 3 and 4 has the following disadvantage. The adjacent scan bus lines 5B-1 and 5B-2 are AC-coupled together via the compensation capacitor CS. Hence, it is very difficult to drive the AC-coupled adjacent scan bus lines and apply identical pixel data to the data bus line 5A. Hence, the enlargement control as shown in FIG. 2 cannot be applied to the CS-ON-GATE type liquid crystal display panel 1B. That is, identical image data cannot be applied to the two consecutive horizontal lines.

A general procedure for enlarging an image in the horizontal direction is as follows. Generally, the frequency of a sampling clock is made higher in order to obtain a larger number of samples. The sampling clock is extracted from the image signal by a PLL (Phase-Locked Loop) circuit. originally, the frequency of the sampling clock is selected so that the peaks of the image signal in analog formation are sampled. When the frequency of the sampling clock is increased, the image signals are sampled at portions other than the peaks. In this way, an increased number of samples necessary to enlarge the image in the horizontal direction can be obtained.

However, the samples obtained by sampling the image signal at portions other than the peaks will cause problems. For example, an interference fringe or flicker noise may appear on the displayed image.

SUMMARY OF THE INVENTION

It is a general object of the present invention to provide a liquid crystal display device and display method in which the above disadvantages of the related art are eliminated.

A more specific object of the present invention is to provide a liquid crystal display device and display method capable of enlarging an image in the vertical direction at an arbitrary enlargement ratio without any image memory specifically used for enlargement.

The above objects of the present invention are achieved by a display device comprising: a display panel having display pixels arranged in matrix formation; a first driver circuit which sequentially supplies image data to vertical lines of the display panel in synchronism with a first clock signal; a second driver circuit which sequentially drives horizontal lines in synchronism with a second clock signal; and a control circuit which controls a drive timing at which the second driver circuit sequentially drives the horizontal lines so that identical image data equal to one horizontal line is supplied, from the first driver circuit in synchronism with the first clock signal, to two consecutive horizontal lines every N horizontal lines (N is an integer) in accordance with an enlargement ratio at which an image is enlarged in a vertical direction and is displayed on the display panel.

The display device may be configured so that: the control circuit controls the second driver circuit so that a predetermined amount of image data equal to two consecutive horizontal lines is supplied to each of the horizontal lines so that a first half of the image data is supplied to a given horizontal line and then the second half of the image data is supplied to the horizontal line; and the control circuit further controls the second driver circuit so that the second driver circuit drives two consecutive horizontal lines at each cycle of the second clock signal, and the second half of the predetermined amount of image data is prevented from being supplied to the one horizontal line when the identical image data is supplied to one of the two consecutive horizontal lines.

The display device may be configured so that the control circuit controls the second driver circuit so that each of the horizontal lines is supplied from the first driver circuit with the predetermined amount of image data, equal to two consecutive horizontal lines, within a period equal to twice the cycle of the second clock signal.

The display device may be configured so that the control circuit generates an enable signal including a pulse which prevents the first driver circuit from supplying the identical image data to one of the two consecutive horizontal lines.

The display device may be configured so that the control circuit controls the second driver circuit so that the image data is sequentially supplied to the horizontal lines during a constant period less than the cycle of the second clock signal.

The display device may be configured so that the number N can be externally selected based on the enlargement ratio so that the enlargement ratio can be changed.

The display device may be configured so that the control circuit controls, on the basis of the enlargement ratio, a start horizontal line from which the image data is sequentially supplied to the horizontal lines.

The display device may be configured so as to further include another control circuit which controls a drive timing at which the first driver circuit sequentially supplies the image data to the horizontal lines so that identical pixel data contained in the image data is successively supplied to one horizontal line being driven every M pixels (M is an integer) in accordance with a second enlargement ratio at which an image is enlarged in the horizontal direction and is displayed on the display panel.

The display device may be configured so that the number N is equal to the number M and the enlargement ratio relating to the vertical direction is equal to the second enlargement ratio relating to the horizontal direction.

The display device may be configured so that the second control circuit controls the first driver circuit so that the image data is sequentially supplied to the horizontal lines in synchronism with a timing based on a number of pixels of the display panel and the second enlargement ratio relating to the horizontal direction.

The display device may be configured so that the display panel is a liquid crystal display panel.

The above-mentioned objects of the present invention are also achieved by a method of controlling a display device comprising a display panel having display pixels arranged in matrix formation, the method comprising the steps of: (a) sequentially supplying image data to vertical lines of the display panel in synchronism with a first clock signal; (b) sequentially driving horizontal lines in synchronism with a second clock signal; and (c) controlling a drive timing at which the horizontal lines are sequentially driven by the step (b) so that identical image data equal to one horizontal line is supplied, in synchronism with the first clock signal, to two consecutive horizontal lines every N horizontal lines (N is an integer) in accordance with an enlargement ratio at which an image is enlarged in a vertical direction and is displayed on the display panel.

The method may further comprise the steps of: (d) controlling the step (b) so that a predetermined amount of image data equal to two consecutive horizontal lines is supplied to each of the horizontal lines so that a first half of the predetermined amount of image data is supplied to one horizontal line and then a second half thereof is supplied to the one horizontal line; and (e) controlling the step (b) so that two consecutive horizontal lines are driven at each cycle of the second clock signal, and prevents the second half of the predetermined amount of image data from being supplied to the one horizontal line when the identical image data is supplied to one of the two consecutive horizontal lines.

The method may further comprise the step of controlling the step (b) so that each of the horizontal lines is supplied with the predetermined amount of image data equal to two consecutive horizontal lines within a period equal to twice the cycle of the second clock signal.

The method may further comprise the step of controlling the step (b) so that the image data is sequentially supplied to the horizontal lines during a constant period less than the cycle of the second clock signal.

The method may further comprise the step of controlling the step (a) so that identical pixel data contained in the image data is successively supplied to one horizontal line being driven every M pixels (M is an integer) in accordance with a second enlargement ratio at which an image is enlarged in the horizontal direction and is displayed on the display panel.

The above-mentioned objects of the present invention are achieved by a display device comprising: a display panel having display pixels arranged in matrix formation; a first driver circuit which sequentially supplies image data to vertical lines of the display panel in synchronism with a first clock signal; a second driver circuit which sequentially drives horizontal lines in synchronism with a second clock signal; and a control circuit which controls a drive timing at which the second driver circuit sequentially drives the horizontal lines so that identical image data equal to one horizontal line supplied from the first driver circuit in synchronism with the first clock signal is supplied, within one cycle of the second clock signal, to two consecutive horizontal lines every N horizontal lines (N is an integer) in accordance with an enlargement ratio at which an image is enlarged in a vertical direction and is displayed on the display panel.

The display device may be configured so that the control circuit serially drives the two consecutive horizontal lines so that each of the two consecutive horizontal lines is driven for a period shorter than one cycle of the second clock signal.

The display device may be configured so that: the second driver circuit comprises a first circuit part and a second circuit part; the first circuit part sequentially drives odd-numbered horizontal lines, and the second circuit part sequentially drives even-numbered horizontal lines; the first and second circuit parts alternately drive the horizontal lines one by one; and the control circuit controls the first and second circuit parts in one cycle of the second clock signal so that one of the two consecutive lines is driven by the first circuit part and the other one of the two consecutive lines is driven by the second circuit part.

The display device may further comprise another control circuit which controls a drive timing at which the first driver circuit sequentially supplies the image data to the horizontal lines so that identical pixel data contained in the image data is successively supplied to one horizontal line being driven every M pixels (M is an integer) in accordance with a second enlargement ratio at which an image is enlarged in the horizontal direction and is displayed on the display panel.

The display device may be configured so that the number N is equal to the number M and the enlargement ratio relating to the vertical direction is equal to the second enlargement ratio relating to the horizontal direction.

The display device may be configured so that the display panel is a liquid crystal display panel.

The above-mentioned objects of the present invention are also achieved by a method of controlling a display device comprising a display panel having display pixels arranged in matrix formation, the method comprising the steps of: (a) sequentially supplying image data to vertical lines of the display panel in synchronism with a first clock signal; (b) sequentially driving horizontal lines in synchronism with a second clock signal; and (c) controlling the step (b) so that identical image data equal to one horizontal line supplied by the step (a) in synchronism with the first clock signal is supplied, within one cycle of the second clock signal, to two consecutive horizontal lines every N horizontal lines (N is an integer) in accordance with an enlargement ratio at which an image is enlarged in vertical direction and is displayed on the display panel.

The method may be configured so that the step (c) serially drives the two consecutive horizontal lines so that each of the two consecutive horizontal lines is driven for a period shorter than one cycle of the second clock signal.

The method may be configured so that: the step (b) comprises the step (b-1) of alternately driving the horizontal lines one by one via a first circuit part and a second circuit part; and the step (c) comprises the step of controlling the step (b-1) in one cycle of the second clock signal so that one of the two consecutive lines is driven by the first circuit part and the other one of the two consecutive lines is driven by the second circuit part.

The method may be configured so as to further comprise the step of controlling the step (a) so that identical pixel data contained in the image data is successively supplied to one horizontal line being driven every M pixels (M is an integer) in accordance with a second enlargement ratio at which an image is enlarged in the horizontal direction and is displayed on the display panel.

Another object of the present invention is to provide a liquid crystal display device and display method capable of enlarging an image in the horizontal direction without degradation of the quality of displayed images.

The above objects of the present invention are achieved by a display device comprising: a display panel having display pixels arranged in matrix formation; a first circuit which samples an image signal by a first clock signal synchronized with the image signal, and performs a predetermined process for sampled image data, the predetermined process being carried out by a second clock signal depending on a number of the display pixels of the display panel; and a second circuit which produces the first clock signal and the second clock signal.

The display device may be configured so that: the first circuit comprises an A/D converter which converts the image signal in analog formation into serial digital data, a serial-to-parallel converter which converts the serial digital data into parallel data, a latch circuit which latches the parallel data, and a multiplexer which sequentially selects data contained in the parallel data; and the A/D converter and the serial-to-parallel converter operate in synchronism with the first clock signal, and the multiplexer operates in synchronism with the second clock signal.

The display device may be configured so that the second circuit comprises a first generator circuit which produces the first clock signal synchronized with the image signal, a second generator circuit which produces the second clock signal based on the number of the display pixels of the display panel, a counter which counts the second clock signal to thereby produce a select signal by which the multiplexer sequentially selects the data contained in the parallel data, and a control circuit which controls the counter on the basis of an enlargement ratio.

The display device may be configured so that the control circuit stops the counter counting the second clock signal on the basis of the enlargement ratio.

The display device may be configured so that the second circuit further comprises a circuit which discriminates the enlargement ratio from horizontal and vertical synchronizing signals contained in the image signal, so that the second circuit controls the counter based on the enlargement ratio thus discriminated.

The display device may be configured so that: the first circuit comprises an A/D converter which converts the image signal in analog formation into digital data, and a frame memory which stores the digital data every predetermined number of bits; the A/D converter operates in synchronism with the first clock signal; a write operation of the frame memory is carried out in synchronism with the first clock signal; and a read operation of the frame memory is carried out in synchronism with the second clock signal.

The display device may be configured so that the second circuit comprises a first generator circuit which generates the first clock signal synchronized with the image signal, a second generator circuit which generates the second clock signal based on the number of the display pixels of the display panel, and an address counter which counts the second clock signal in accordance with the enlargement ratio so that an address used to read the digital data from the frame memory is generated.

The display device may be configured so that the address counter stops counting at a predetermined timing based on the enlargement ratio.

The display device may further comprise a circuit which discriminates the enlargement ratio from horizontal and vertical synchronizing signals contained in the image signal, so that the second circuit controls the counter based on the enlargement ratio thus discriminated.

The above objects of the present invention are also achieved by a method of controlling a display device comprising a display panel having display pixels arranged in matrix formation, the method comprising the steps of: sampling an image signal by a first clock signal synchronized with the image signal; and performing a predetermined process for sampled image data, the predetermined process being carried out by a second clock signal depending on a number of the display pixels of the display panel.

BRIEF DESCRIPTION OF THE DRAWINGS

Other objects, features and advantages of the present invention will become more apparent from the following detailed description when read in conjunction with the accompanying drawings, in which:

FIG. 46 is a diagram showing a relation between synchronizing signals and display mode;

DETAILED DESCRIPTION OF THE PREFERRED EMBODIMENTS

A description will now be given of a liquid crystal display device according to a first embodiment of the present invention.

Figure 1:
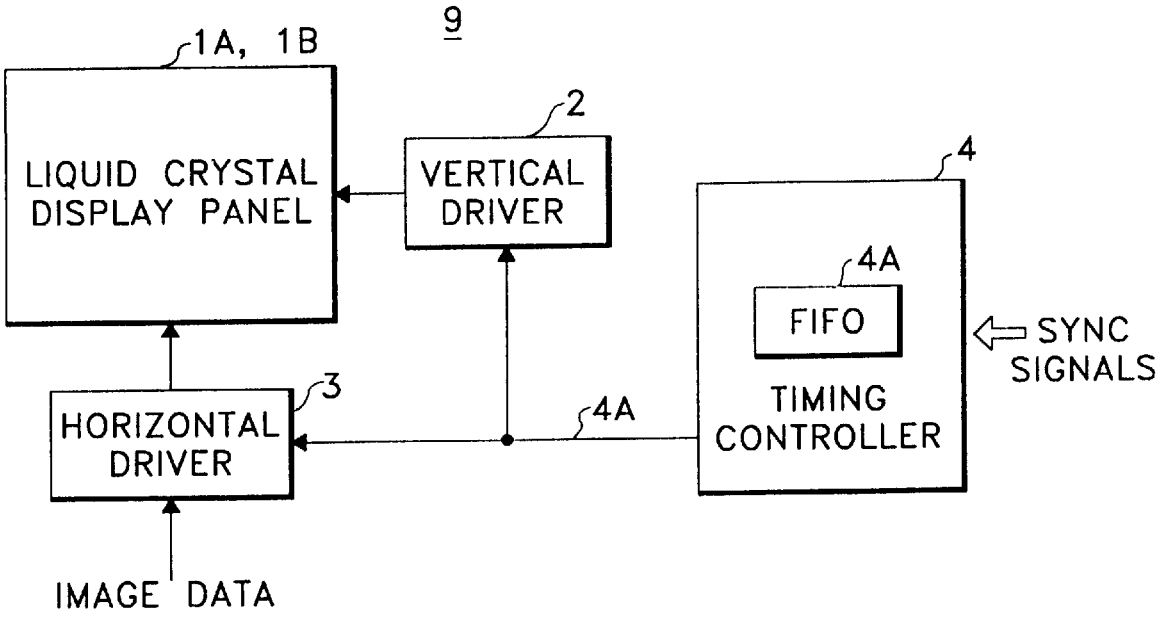
Fig. 1 (PRIOR ART)
FIG. 1 is a block diagram of a conventional liquid crystal display device equipped with an image memory formed of an FIFO memory.
Figure 2:
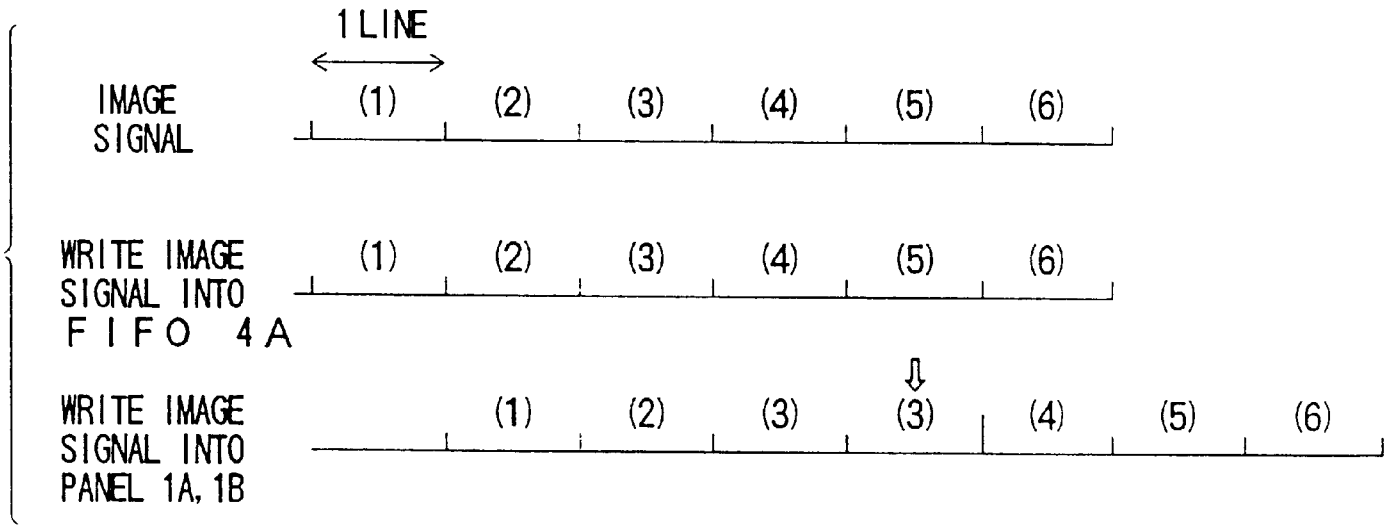
FIG. 2 (PRIOR ART)
FIG. 2 is a timing chart of an operation of the liquid crystal display device shown in FIG. 1.
Figure 3:
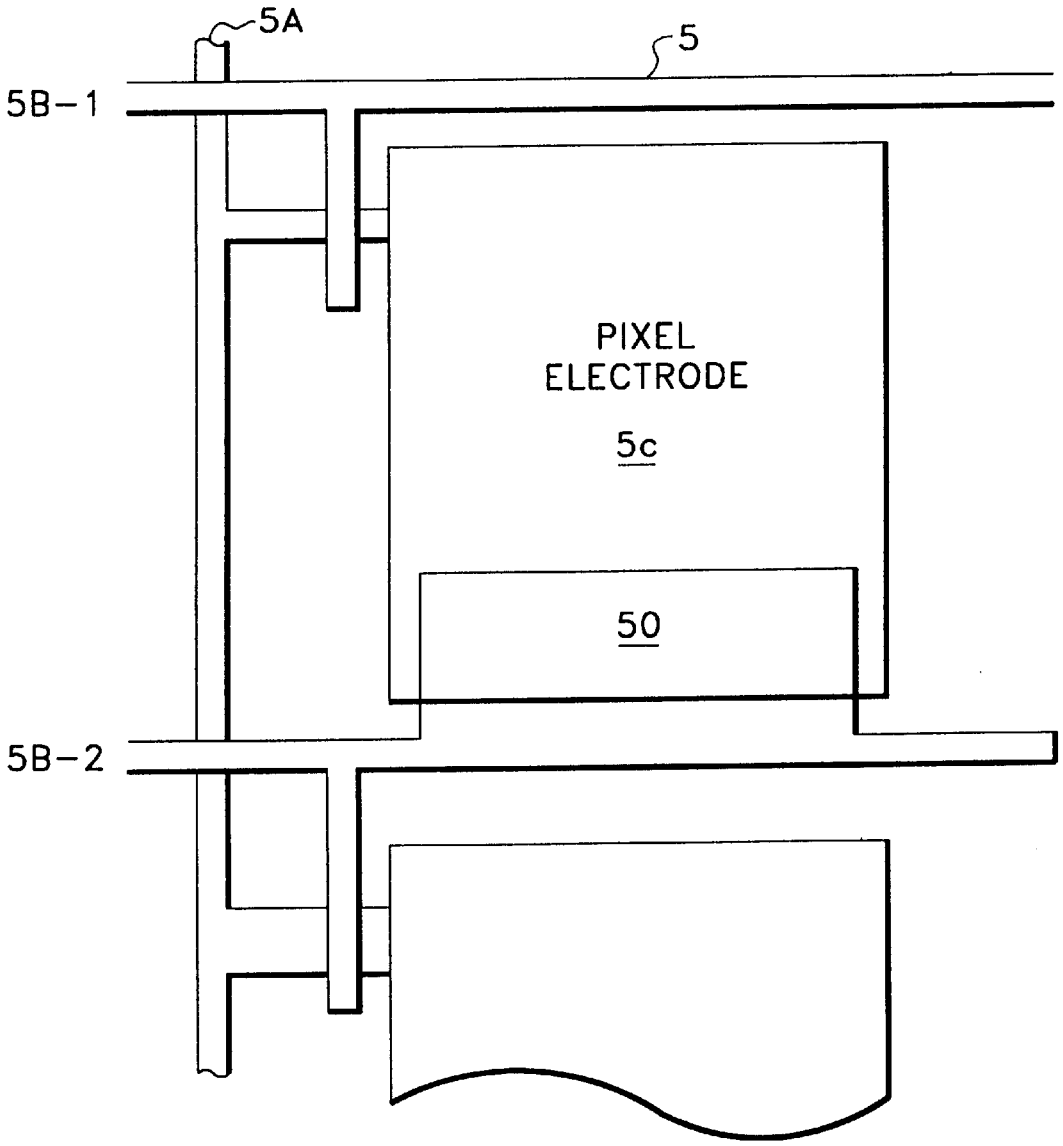
Fig. 3 (PRIOR ART)
FIG. 3 is an enlarged plan view of a matrix-type liquid crystal display panel of a matrix electrode structure called CS-ON-GATE.
Figure 4:
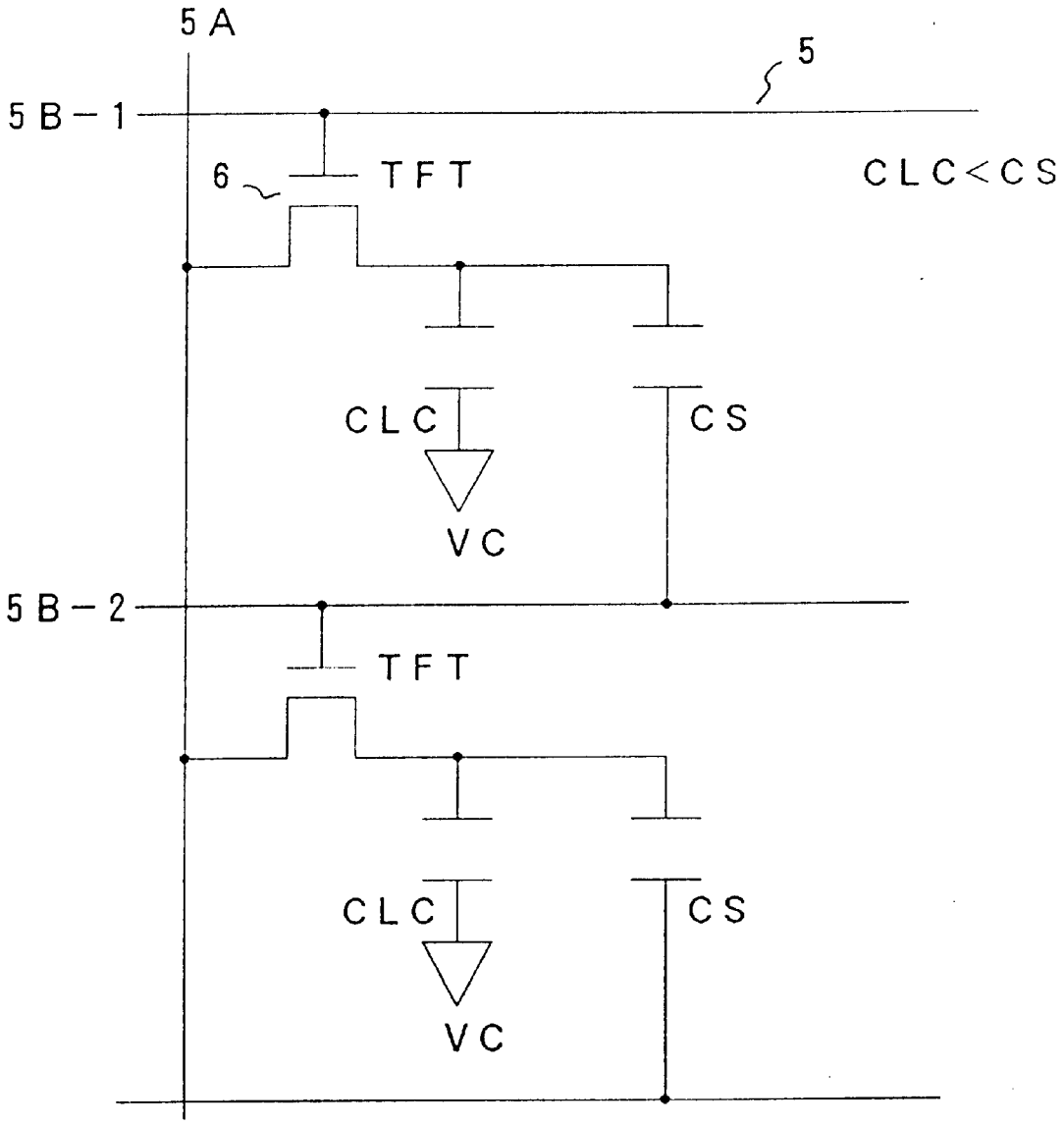
FIG. 4 (PRIOR ART)
FIG. 4 is a circuit diagram of the structure shown in FIG. 3 and its peripheral portion.
Figure 5:
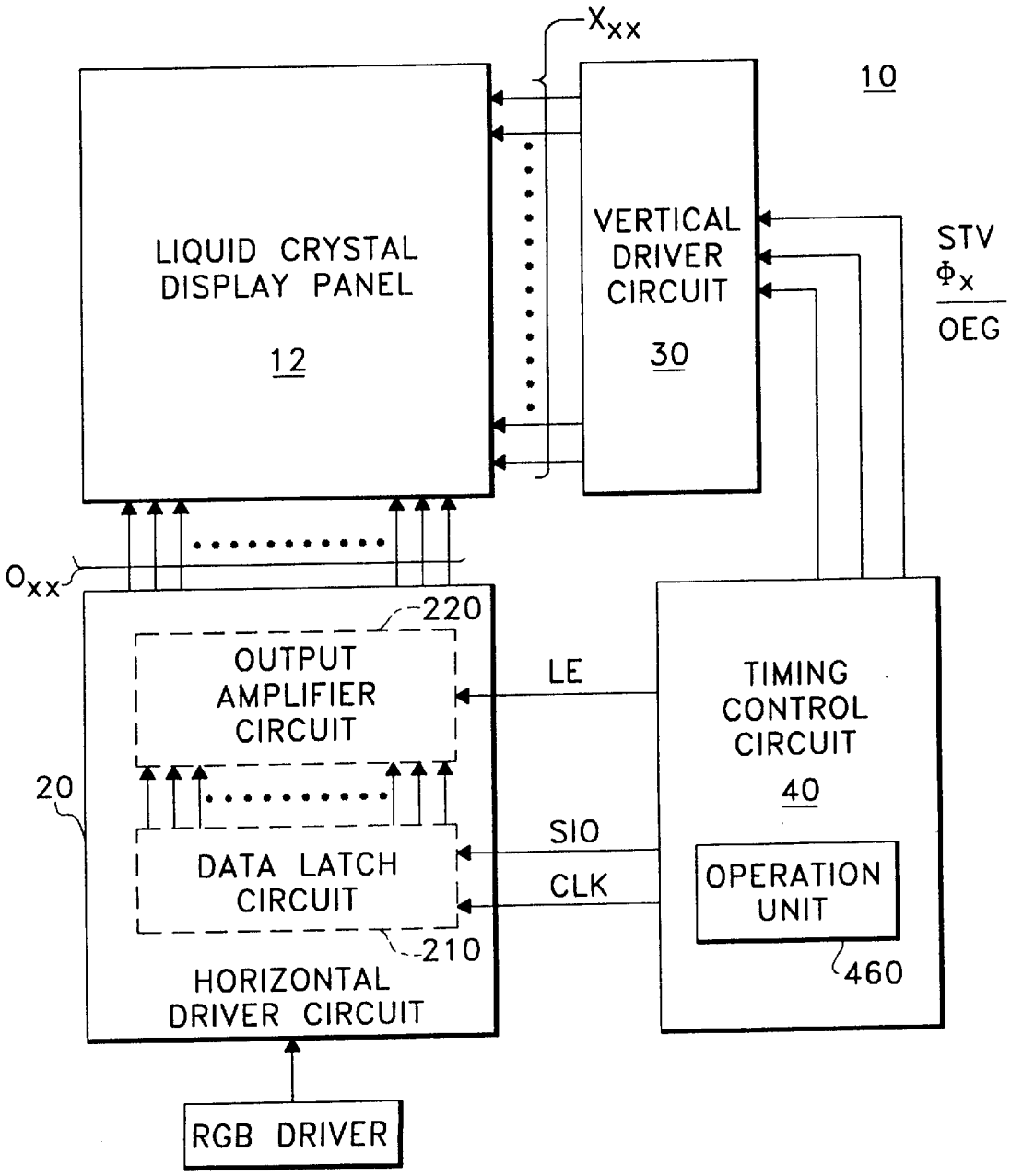
FIG. 5 is a block diagram of a liquid crystal display device according to a first embodiment of the present invention.
Figure 6:
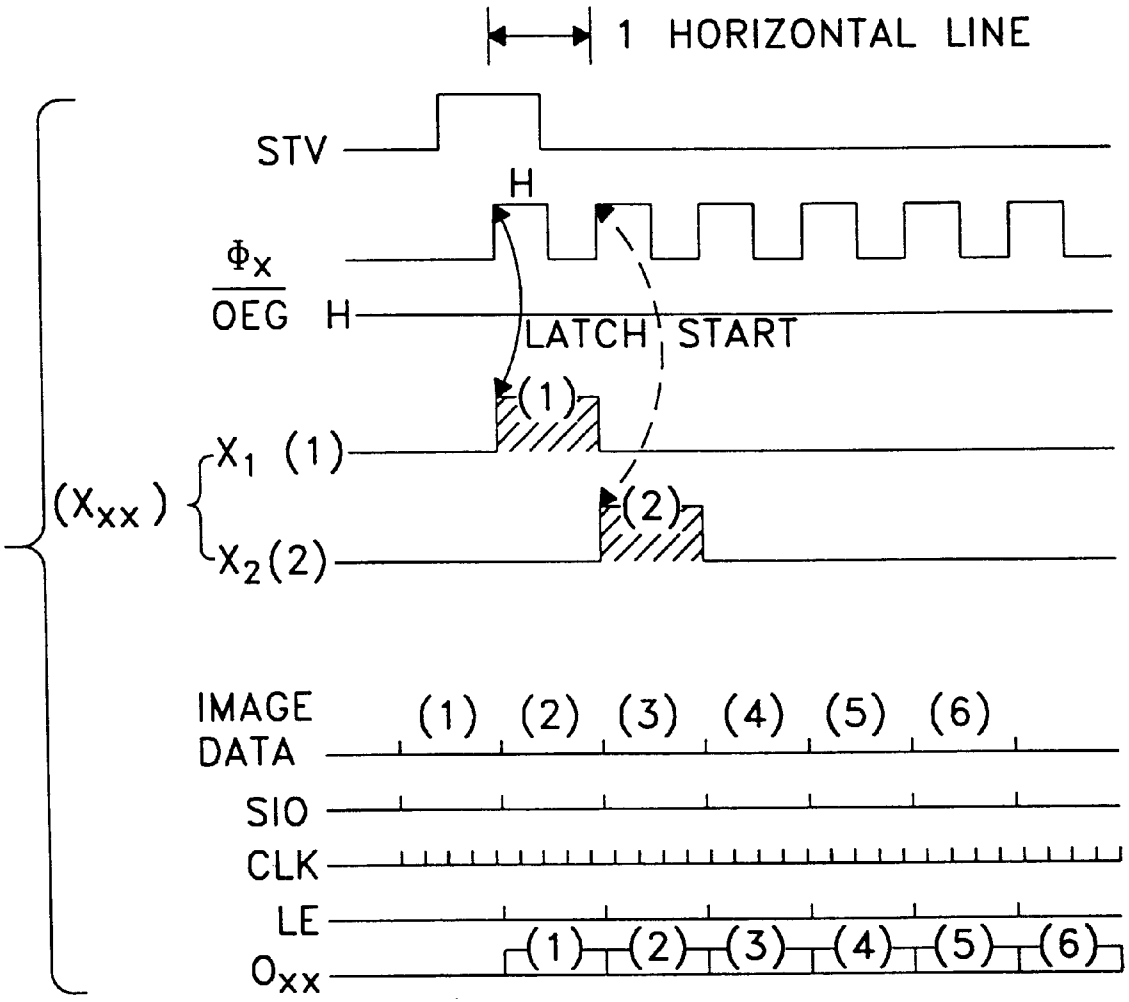
FIG. 6 is a timing chart of an operation of the liquid crystal display device shown in FIG. 5 in which an image is not enlarged (the enlargement ratio is equal to 1)

FIG. 5 is a block diagram of a liquid crystal display device 10 according to the first embodiment of the present invention. FIG. 6 is a timing chart of an operation of the display device 10 to be carried out in a normal display mode in which an image is not enlarged. The display device 10 includes a matrix-type liquid crystal display panel 12, a horizontal driver circuit 20, a vertical driver circuit 30 and a timing control circuit 40.

The matrix-type liquid crystal display panel 12 includes a plurality of pixels arranged in matrix formation. Switching elements for display are provided at respective crosspoints of the matrix formation.

The horizontal driver circuit 20 performs a display control in response to a horizontal driver start signal SIO. In the display control, image data equal to one horizontal line is serially written into the switching elements equal to one horizontal line in synchronism with a shift clock signal CLK for the horizontal direction. The horizontal driver circuit 20 includes a data latch circuit 210 and an output amplifier circuit 220. The data latch circuit 210 latches serial image data supplied from an RGB driver in synchronism with each rise of the shift clock signal CLK while the horizontal driver start signal SIO is in a logically high (H) level. The RGB driver is included in, for example, a personal computer. The image data equal to one horizontal line is latched in the data latch circuit 210, and then a latch enable signal LE is changed to the high level. Thereby, the image data latched in the data latch circuit 210 is transferred to the output amplifier circuit 220, which is connected to given input terminals of the matrix-type liquid crystal display panel 12. Then, the image data equal to one horizontal line is transferred to the matrix-type liquid crystal display panel 12.

The vertical driver circuit 30 receives a vertical driver start signal STV, and starts to perform a write timing control in which the switching elements equal to one vertical line are serially selected in synchronism with a shift clock signal Φx.

More particularly, as shown in FIG. 6, vertical driver output signals Xxx are output, one by one, to given input terminals of the matrix-type liquid crystal display panel 12 in response to each rise of the shift clock signal Φx while the vertical driver start signal STV is at the high level (H). The horizontal lines are serially selected one by one by the corresponding vertical driver output signals Xxx. In FIG. 6, the first horizontal line is selected by vertical driver output signal $X_1$, and the second horizontal line is selected by vertical driver output signal $X_2$. During the time when the vertical driver output signals are serially applied to the liquid crystal display panel 12, an output enable signal /OEG generated by the timing control circuit 40 is maintained at the high level.

The timing control circuit 40 performs the above-mentioned normal timing control (normal display mode) shown in FIG. 6, and a specific timing control which is to be carried out when an image should be enlarged in an enlargement display mode. In the enlargement display mode, identical image data equal to one horizontal line is written into two consecutive horizontal lines every n horizontal lines where n is an integer and depends on the value of the enlargement ratio, as shown in FIG. 7.

Figure 7:
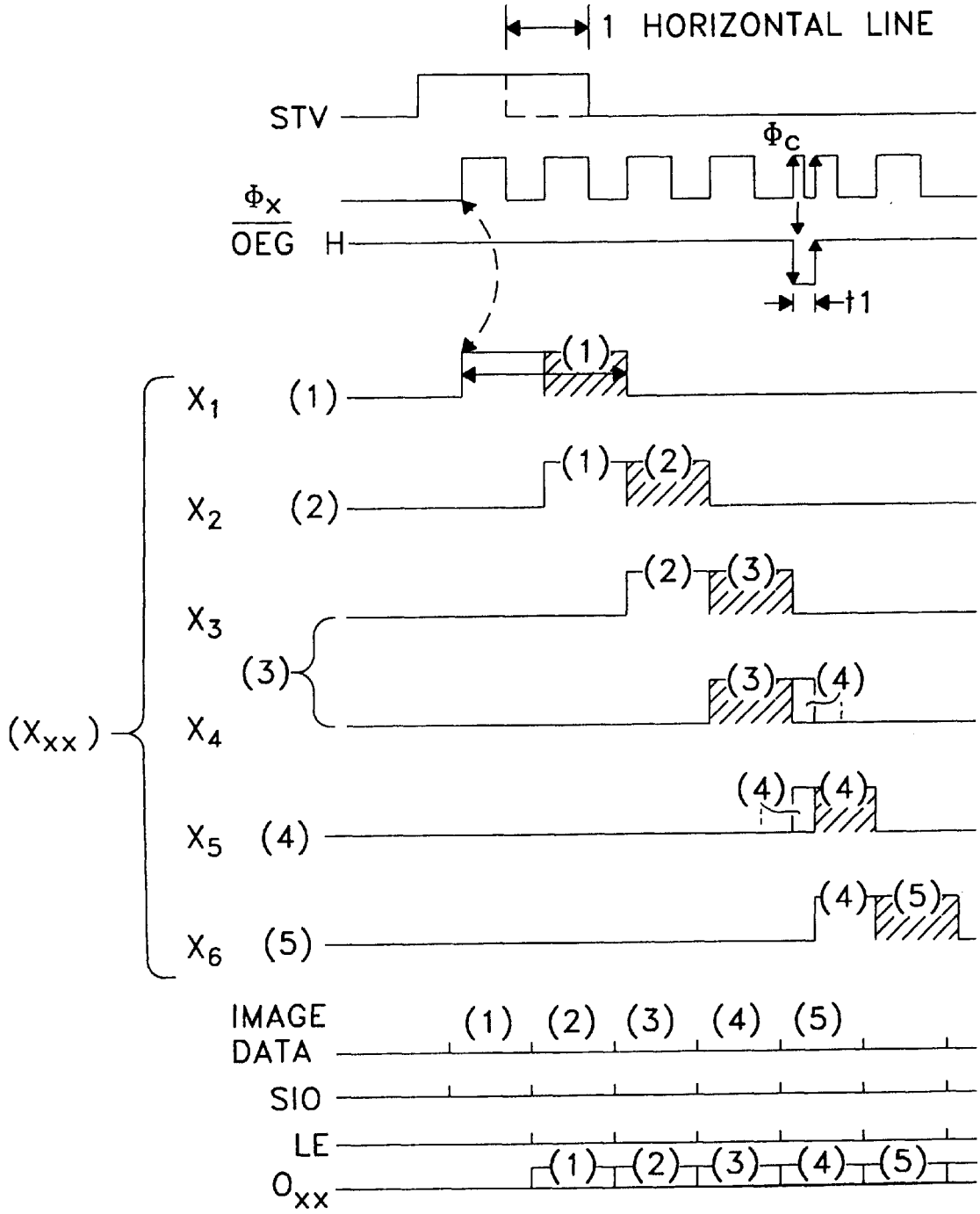
FIG. 7 is a timing chart of another operation of the liquid crystal display device shown in FIG. 5 in which an image is enlarged at an enlargement ratio of 4/3.

FIG. 7 is a timing chart of an operation in which identical image data is simultaneously written into two horizontal lines every three horizontal lines. As shown in FIG. 7, the vertical driver start signal STV has a pulse duration that is twice that of the signal STV used in the normal display mode and shown in FIG. 6. While the vertical driver start signal STV is at the high level, the shift clock signal Φx supplied from the timing control circuit 40 rises twice, as shown in FIG. 7. Thus, the vertical driver output signals $X_1$, $X_2$, . . . have a write time equal to two horizontal lines as long as the output enable signal /OEG is at the high level. Further, the horizontal lines of the liquid crystal display panel 12 respectively applied to the vertical driver output signals $X_1$, $X_2$, . . . are serially driven in synchronism with the rises of the shift clock signal Φx.

Hence, for example, image data (1) and (2) are serially written into the second horizontal line to which the vertical driver output signal $X_2$ is applied, and image data (2) and (3) are serially written into the third horizontal line to which the vertical driver output signal $X_3$ is applied. It is to be noted that image data (2) is simultaneously written into each of the second and third horizontal lines. It is also to be noted that image data (2) is written into the second horizontal line immediately after image data (1) is written therein, so that image data (2) is stored in the second horizontal line.

Image data is written into the fourth and fifth horizontal lines in a way different from the above-mentioned way related to the first to third horizontal lines. In order to realize an enlargement operation in which identical image data is written into two consecutive horizontal lines per three horizontal lines, identical image data should be written into the third and fourth horizontal lines. That is, image data (3) which is written into the third horizontal line should also be written into the fourth line, as shown in FIG. 7. In other words, it is necessary to prevent image data (4) from being written into the fourth line.

In order to achieve the above operation, a correction pulse Φc having a duration time $t_1$ is included in the shift clock signal Φx, as shown in FIG. 7. In response to the rise of the correction pulse Φc, the output enable signal /OEG is switched to the low level, and is then returned to the high level in response to the next rise of the shift clock signal Φx. Since the output enable signal /OEG is switched to the low level, image data (4) is not written into the fourth horizontal line and the fifth horizontal line, as shown in FIG. 7. When the output enable signal /OEG is returned to the high level, image data (4) is written into the fifth line, while image data (4) is not written into the fourth line, as shown in FIG. 7. In the above-mentioned manner, image data (3) is simultaneously written into the third and fourth horizontal lines, and image data (4) is written into the fifth horizontal line.

It is noted that image data (4) is written into the fifth horizontal line for a period shorter than one cycle of the shift clock signal Φx. As the duration time $t_1$ of the correction pulse Φc becomes shorter, the time for image data (4) to be written into the fifth horizontal line becomes longer. If the duration time $t_1$ is unnecessarily too long, a sufficient time to write image data (4) into the fifth horizontal line will not be obtained. It is thus preferable to determine the pulse duration time $t_1$ so that image data (4) is assuredly written into the fifth horizontal line and held therein. In practice, it is possible to ensure a sufficient write time because image data (4) can be written into the fifth horizontal line during a period longer than half of the cycle of the shift clock signal Φx.

The timing control circuit 40 shown in FIG. 5 has an operation unit 460, which controls the timing signal generating operation so that the timing signals STV, Φx and /OEG shown in FIG. 7 can be output to the vertical driver circuit 30.

Figure 8:
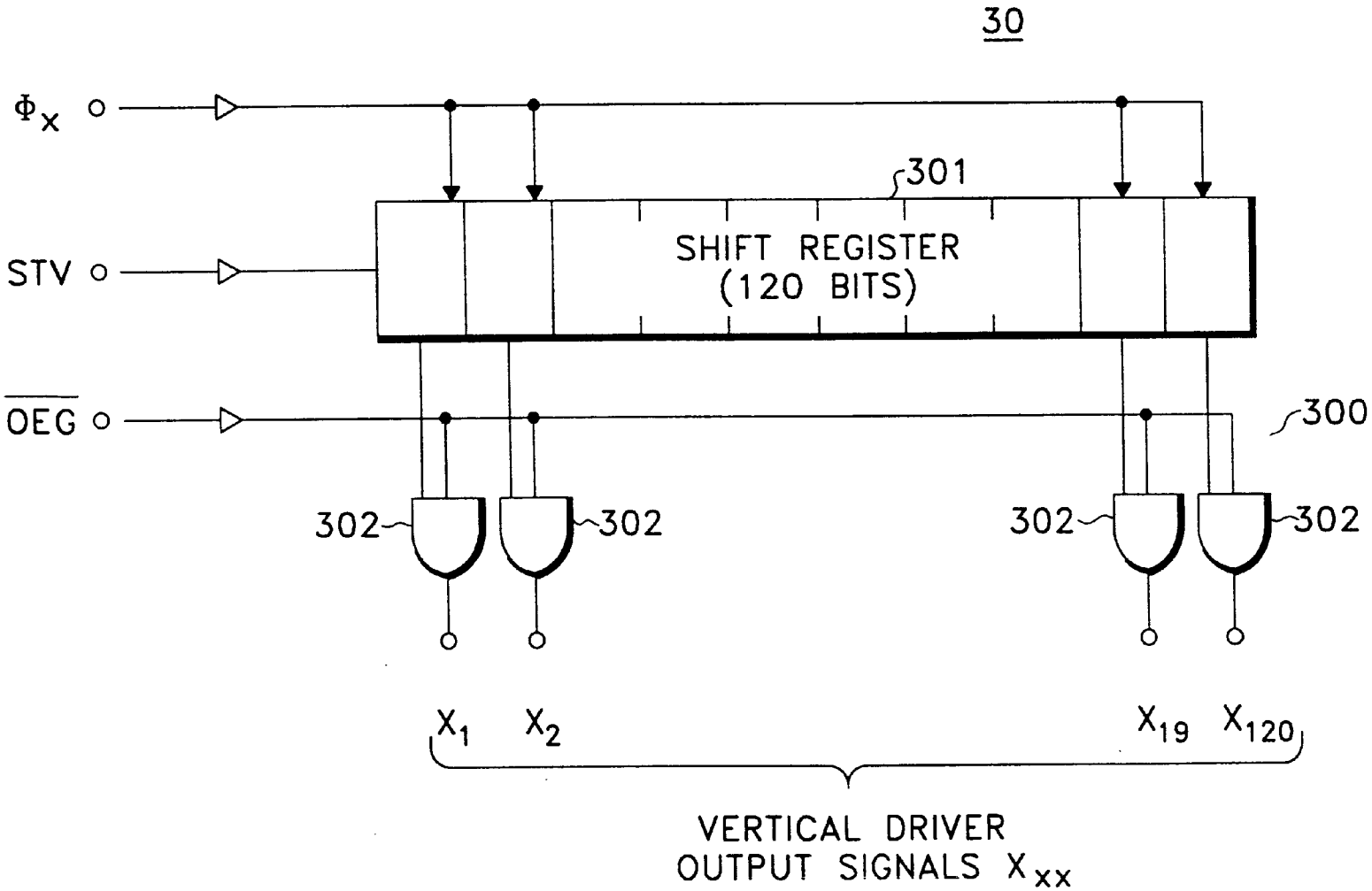
FIG. 8 is a block diagram of a vertical driver circuit shown in FIG. 5.

The vertical driver circuit 30 shown in FIG. 5 is configured as shown in FIG. 8. As has been described previously, when the vertical driver start signal STV is at the high level, the vertical driver circuit 30 shifts the vertical driver output signal Xxx by one horizontal line in response to each rise of the shift clock signal Φx. When the output enable signal /OEG is maintained at the low level for time $t_1$ in response to the correction pulse Φc, the vertical driver circuit 30 maintains the vertical driver output signal Xxx at the low level for time $t_1$.

Referring to FIG. 8, the vertical driver circuit 30 is made up of a 120-bit shift register 301, and an AND gate circuit 300 including 120 AND gates 302. The shift register 301 is supplied with the vertical driver start signal STV, and the 120 one-bit shifters of the shift register 301 are supplied with the shift clock signal Φx. The shift register 301 starts the shift operation upon receipt of the vertical driver start signal STV. The signal STV having the pulse duration (two bits) equal to two cycles of the shift clock signal Φx is shifted in synchronism with the shift clock signal Φx. The output terminals of the one-bit shifters of the shift register 301 are connected to the respective AND gates 302, which also receive the output enable signal /OEG. When the output enable signal /OEG is at the high level, the AND gates 302 allow the received signals from the one-bit shifters to pass therethrough. When the output enable signal /OEG is at the low level, the AND gates 302 prevent the received signal from passing therethrough. In the above manner, the vertical driver output signals Xxx as shown in FIG. 7 are applied to the panel 12.

Figure 9:
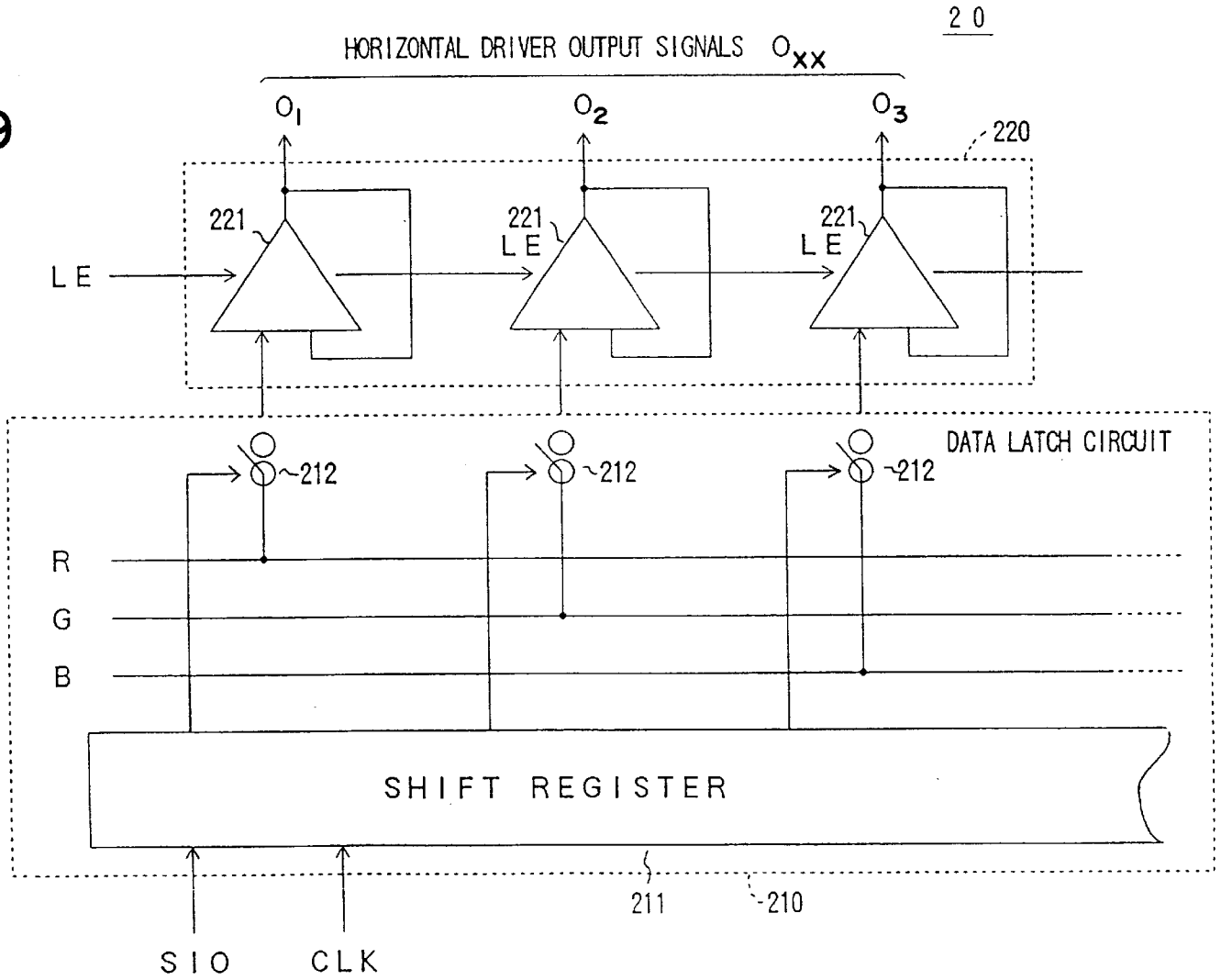
FIG. 9 is a block diagram of a horizontal driver circuit shown in FIG. 5.

FIG. 9 is a block diagram of the horizontal river circuit 20 shown FIG. 5. The horizontal driver circuit 20 is made up of the data latch circuit 210 and the output amplifier circuit 220. The data latch circuit 210 includes a shift register 211 and latch elements 212, and the output amplifier circuit 220 includes output amplifiers 221. The output terminals of the output amplifiers 221 are connected to the corresponding input terminals of the vertical lines of the liquid crystal display panel 12.

Figure 10:
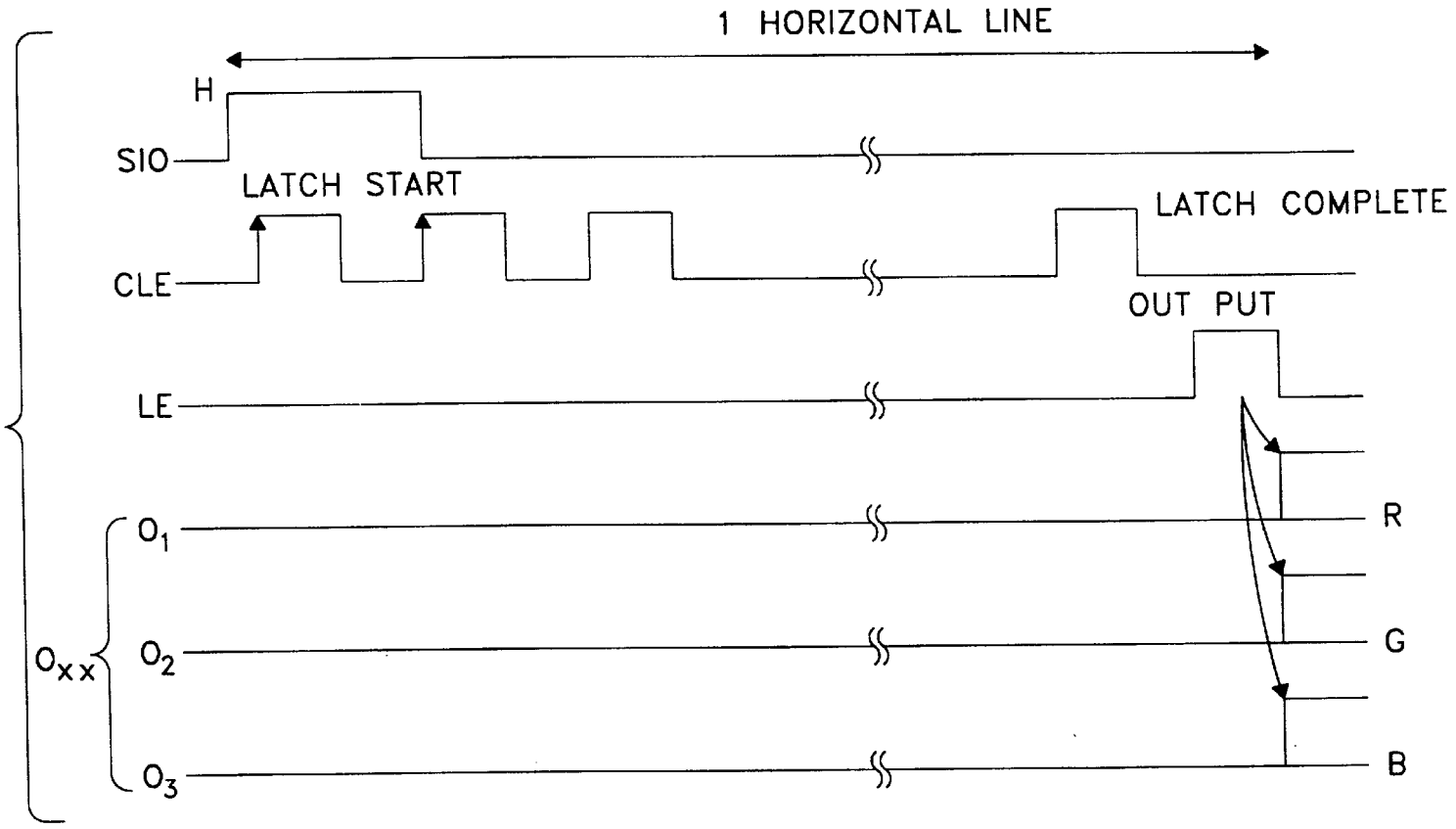
FIG. 10 is a timing chart of an operation of the horizontal driver circuit shown in FIG. 9.

FIG. 10 is a timing chart of an operation of the horizontal driver circuit 20 shown in FIG. 9. The shift register 211 shifts the horizontal driver start signal SIO in synchronism with the shift clock signal CLK. Hence, the output signals of the shift register 211 cause the latch elements 212 to respectively latch R, G and B signals. In the above manner, three latch elements 212 are enabled in response to the shift clock signal CLK, and latches R, G and B signals. When the latch operation for one horizontal line is completed, the latch enable signal LE is switched to the high level at which the output amplifiers 221 are enabled. Then, the latched image data (R, G, B) equal to one horizontal line is output, as horizontal driver output signals Oxx ($O_1$, $O_2$, . . . ), to the vertical lines of the liquid crystal display panel 12.

Figure 11:
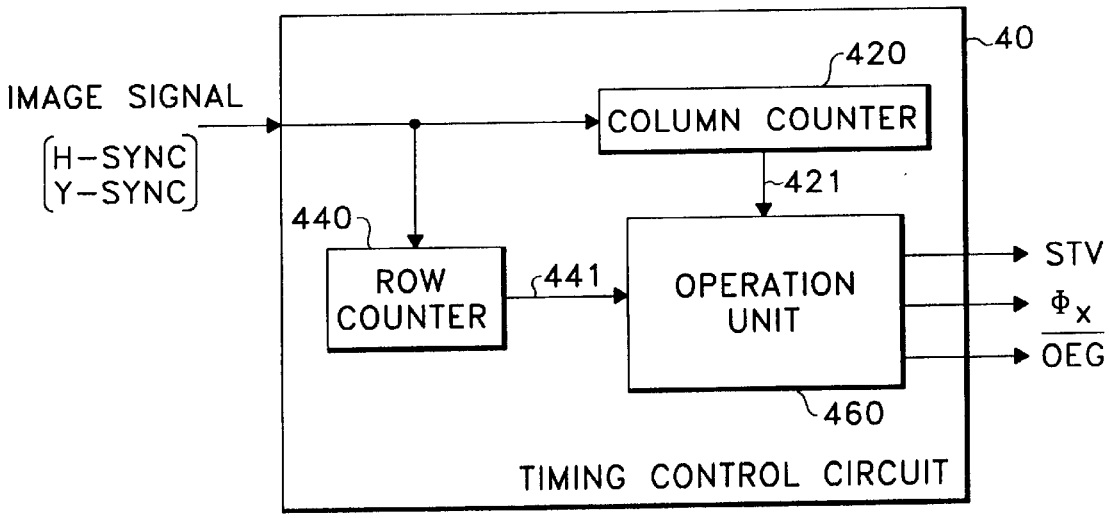
FIG. 11 is a block diagram of a timing control circuit shown in FIG. 5.

FIG. 11 is a block diagram of the timing control circuit 40 shown in FIG. 5. The timing control 40 is made up of a column counter 420, a row counter 440 and an operation unit 460. The column counter 420 counts a horizontal synchronizing signal H-SYNC extracted from the image signal and derives therefrom column count data 421. The row counter 440 counts a vertical synchronizing signal V-SYNC extracted from the image signal and derives therefrom row count data 441.

Figure 12:
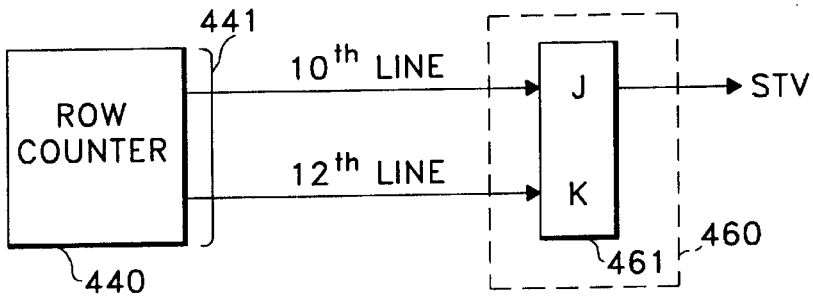
FIG. 12 is a block diagram of a part of an operation unit shown in FIG. 11, the above portion generating a vertical driver start signal.

As shown in FIG. 12, the operation unit 460 shown in FIG. 11 includes a J-K flip-flop 461. When the row counter 440 counts a predetermined horizontal line, for example, the tenth horizontal line, the J-K flip-flop 461 is set and the vertical driver start signal STV is switched to the high level. When the row counter 440 counts another predetermined horizontal line dependent on an enlargement ratio, for example, the twelfth horizontal line, the J-K flip-flop 461 is reset and the vertical driver start signal STV is switched to the low level. The horizontal line at which the vertical driver start signal STV is enabled can be determined so that an enlarged image can be displayed in the center of the display screen (panel). If the vertical driver start signal STV is enabled in the first horizontal line, an enlarged image may be displayed in an upper-of-center area of the display screen.

Figure 13:
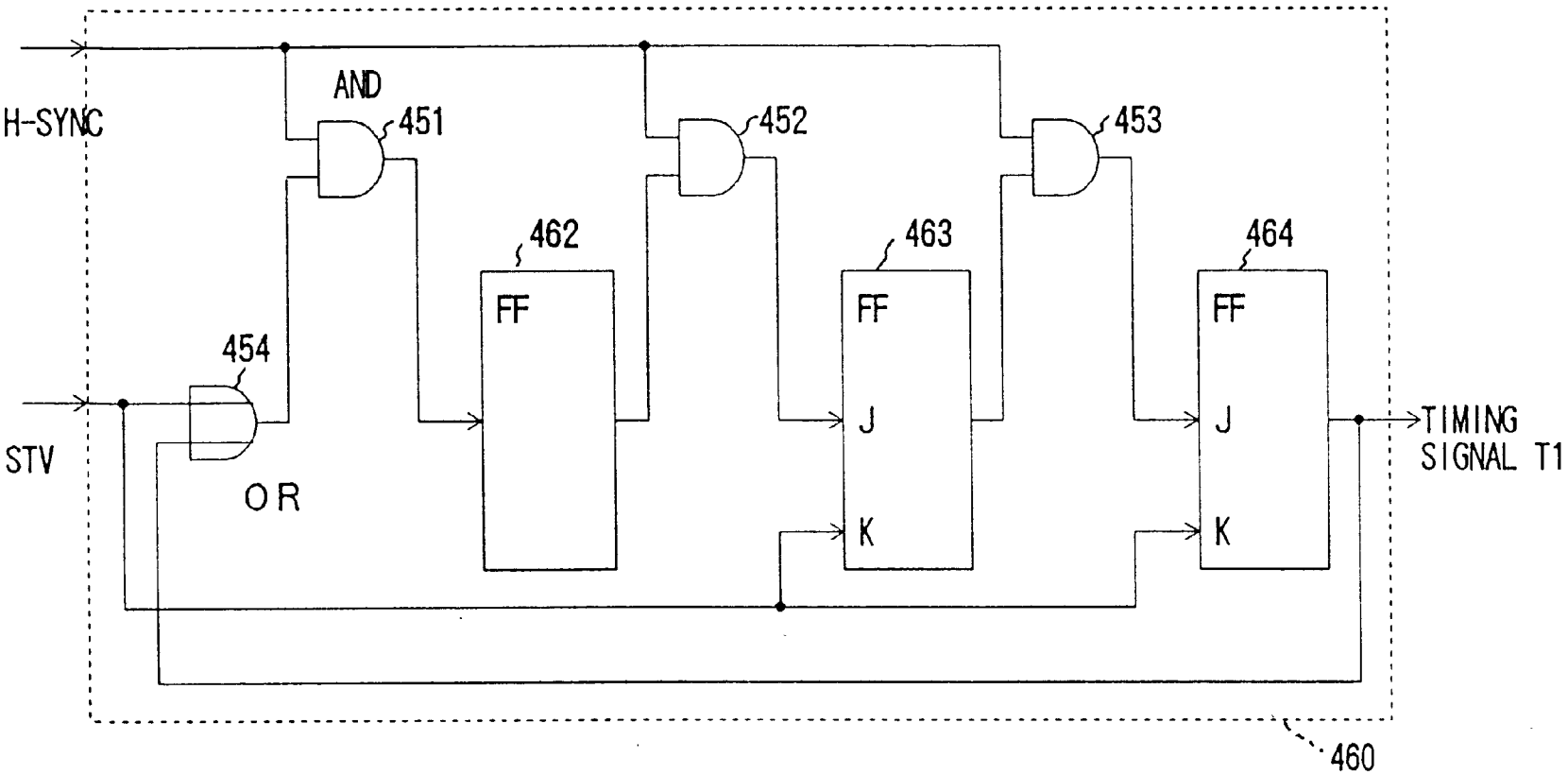
FIG. 13 is a block diagram of another part of the operation unit shown in FIG. 11, the above part generating a timing signal which enables identical image data to be simultaneously written into two consecutive horizontal lines.

FIG. 13 is a circuit portion of the operation unit 460 shown in FIG. 11. The circuit portion shown in FIG. 13 is used to generate the shift clock signal Φx and the output enable signal /OEG, and generate a timing signal T1 which instructs that identical image data be simultaneously written into two consecutive horizontal lines. The circuit portion of the operation unit 460 shown in FIG. 13 is made up of flip-flops 462, 463 and 464, AND gates 451, 452 and 453 and an OR gate 454. The horizontal synchronizing signal H-SYNC is applied to the flip-flops 462, 463 and 464 via the AND gates 451, 452 and 453. The vertical driver start signal STV is applied to the OR gate 454 and the flip-flops 463 and 464. The output signal of the flip-flop 464 is fed back to the OR gate 454. The timing signal T1 indicates an operation timing at which image data forming the image of the last line of every three horizontal lines is written into the next horizontal line (the enlargement ratio is 4/3 in this case). In other words, identical image data is written into the last two lines of each set of four horizontal lines. The timing signal T1 is applied to a circuit portion of the timing control circuit 40 shown in FIG. 14.

Figure 14:
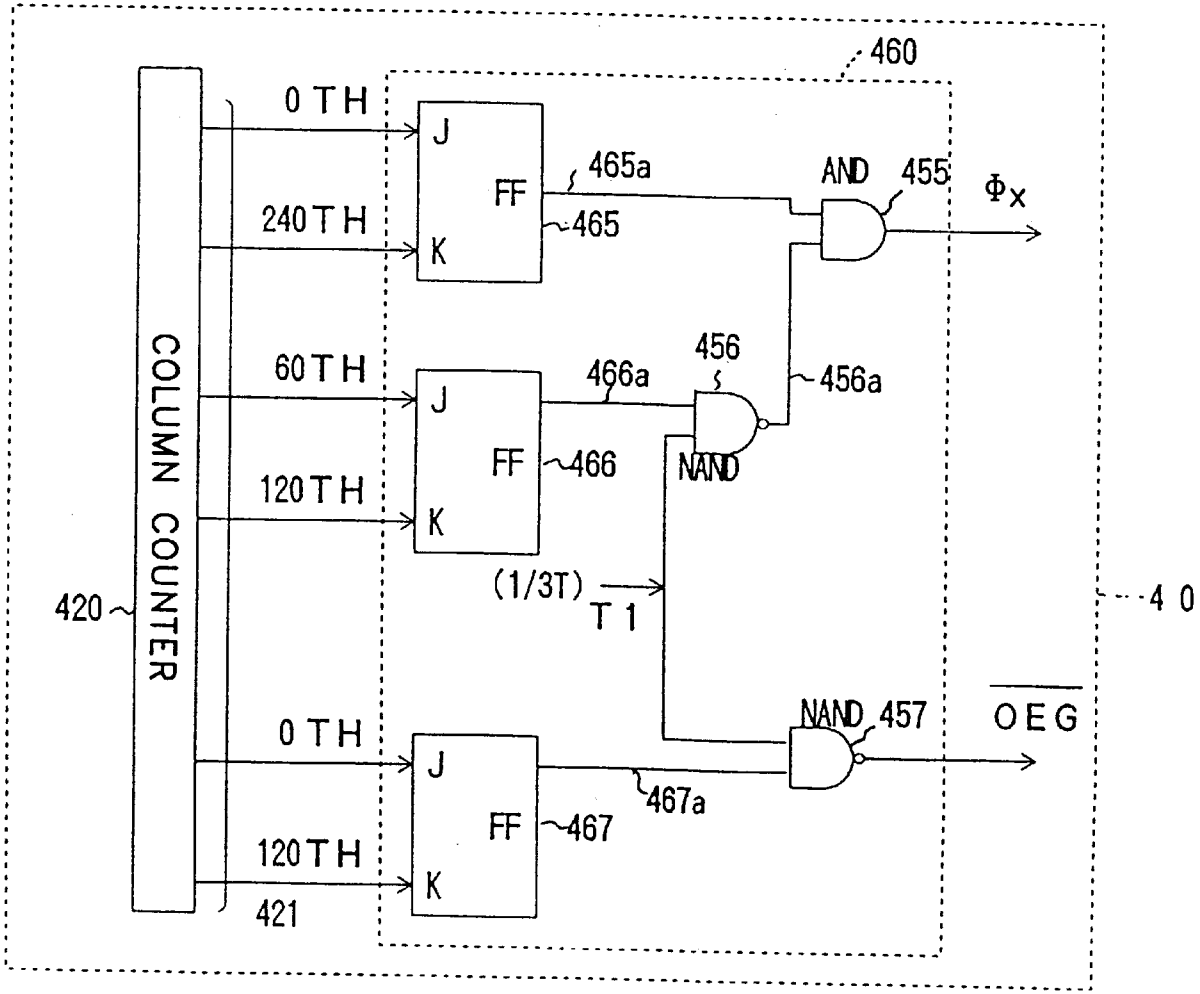
FIG. 14 is a block diagram of a part of the timing control circuit used in the first embodiment of the present invention, the above part generating a shift clock signal and an output enable signal which signals are supplied to the vertical driver circuit.

As shown in FIG. 14, the operation unit 460 further includes J-K flips flops 465, 466 and 467, an AND gate 455, and two NAND gates 456 and 457. The J-K flip-flops 465–467 receive the respective, predetermined counter values (column count data 421) output from the column counter 420. When the column counter 420 is capable of counting 480 columns and the same image data as that of the last line of every three horizontal lines is simultaneously written into the next horizontal line next to the above last line, the flip-flop 465 receives the counter value indicating the zeroth column and the counter value indicating the 240th column. The flip-flop 466 receives the counter value indicating the 60th column and the counter value indicating the 120th column. The flip-flop 467 receives the counter value indicating the zeroth column and the counter value indicating the 120th column. An output signal 465*a* of the flip-flop 465 is applied to the AND gate 455. An output signal 466*a* of the flip-flop 466 is applied to the NAND gate 456. An output signal 467*a* of the flip-flop 467 is applied to the NAND gate 457. The timing signal T1 is applied to the NAND gates 456 and 457. An output signal 456*a* of the NAND gate 456 is applied to the AND gate 455. The output signal of the AND gate 455 serves as the shift clock signal Φx, and the output signal of the NAND gate 457 serves as the output enable signal /OEG.

Figure 15:
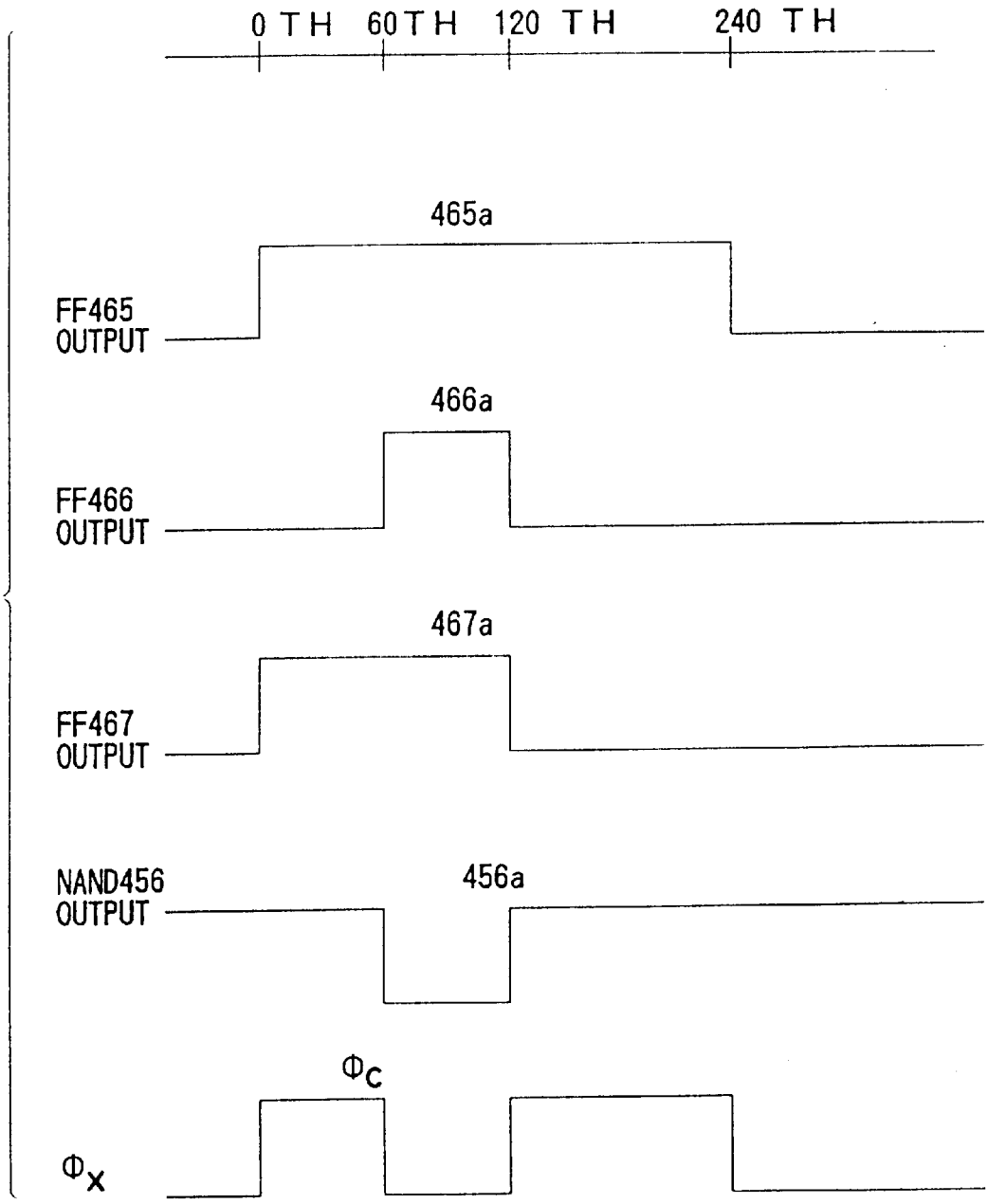
FIG. 15 is a timing chart showing how the shift clock signal is generated in the timing control circuit.

FIG. 15 is a timing chart of the operation of the circuit shown in FIG. 14. As shown in FIG. 15, the correction pulse Φc having the duration between the zeroth column and the 60th column is included in the shift clock signal Φx. As shown in FIGS. 14 and 15, the pulse width of the correction pulse Φc is defined by the flip-flops 465 and 466, and the timing of the generation of the correction pulse Φc is defined by the timing signal T1. As described above, when the timing signal T1 is once generated every three horizontal lines, an enlargement ratio of 4/3 (approximately equal to 1.33) can be realized.

It will be seen from the above that when the timing signal T1 is once generated every two horizontal lines, an enlargement ratio of 3/2 (equal to 1.5) can be obtained. When the timing signal T1 is generated every four horizontal lines, an enlargement ratio of 5/4 (equal to 1.25) can be obtained. When the timing signal T1 is generated every five horizontal lines, an enlargement ratio of 6/5 (equal to 1.2) can be obtained.

According to the first embodiment of the present invention, it is possible to perform the enlargement process without any image memory formed of an FIFO memory or the like and any control circuit for controlling such an image memory. It is to be noted that a sufficient time to write image data into the horizontal line can be ensured without any image memory and a high-quality image can be displayed.

A description will now be given of a liquid crystal display device according to a second embodiment of the present invention. The second embodiment of the present invention is directed to realizing an enlargement ratio of 5/4 (equal to 1.25) by writing the same image data as that of the fourth (last) line of every four horizontal lines into the next horizontal line next to the above fourth line. Such an enlargement process can be realized by modifying the first embodiment of the present invention as follows.

Figure 16:
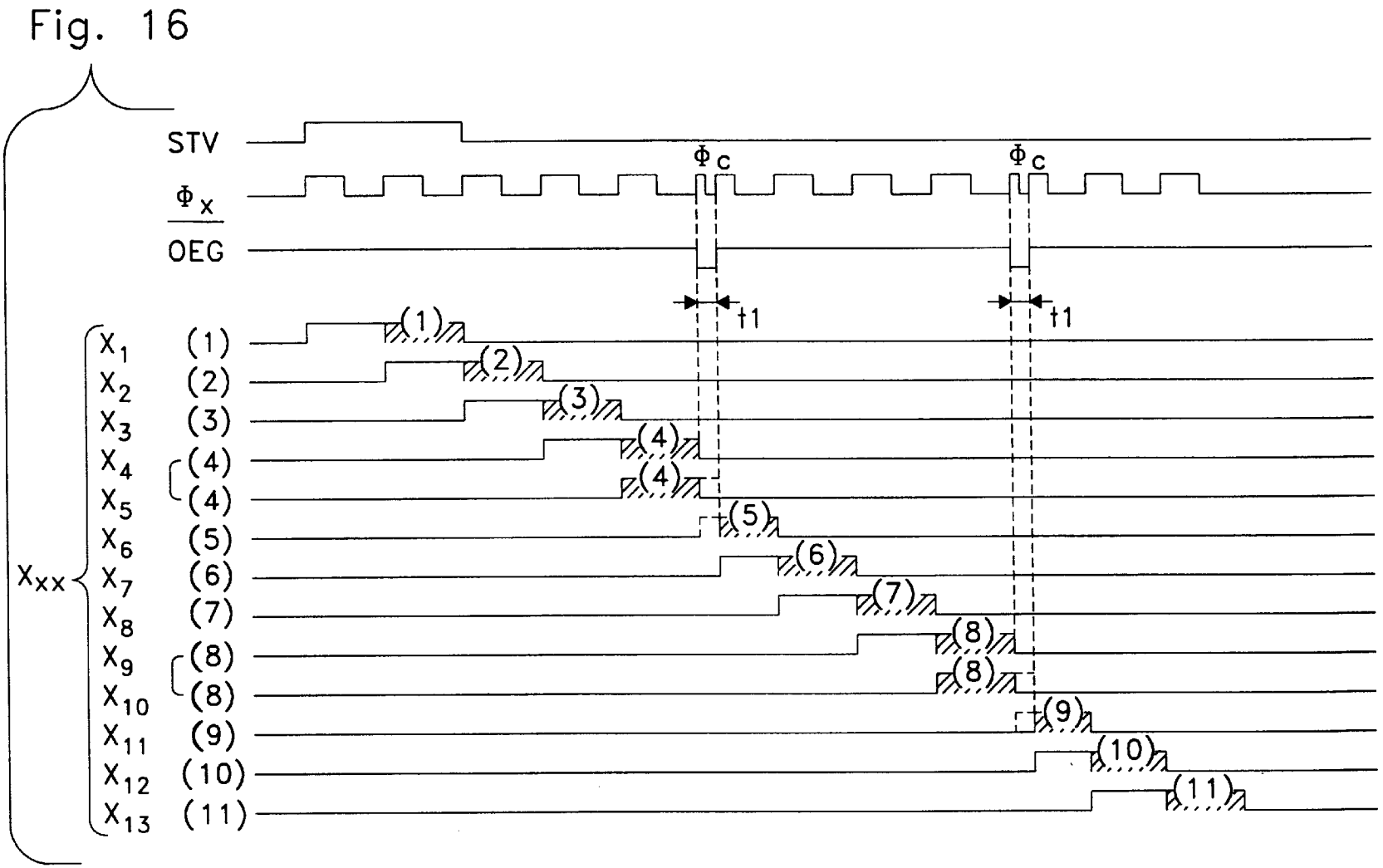
FIG. 16 is a timing chart of an operation of a liquid crystal display device according to a second embodiment of the present invention.

FIG. 16 is a timing chart of the second embodiment of the present invention in which an image is enlarged at an enlargement ratio of 5/4. According to the second embodiment of the present invention, image data forming the last (fourth) horizontal line of every four horizontal lines is written into the next horizontal line following the above fourth horizontal line. More particularly, the vertical driver start signal STV has a pulse duration equal to two cycles of the shift clock signal Φx, in which the correction pulse Φc having the pulse duration $t_1$ is generated every four cycles. Image data (4) is simultaneously written into the fourth and fifth horizontal lines $X_4$ and $X_5$. Since the output enable signal /OEG is switched to the low level in response to the correction pulse Φc, image data (5) is not written into the fifth. Hence, image data (4) is held in the fifth horizontal line $X_5$. Similarly, image data (8) is simultaneously written into the ninth and tenth horizontal lines $X_9$ and $X_{10}$. Since the output enable signal /OEG is switched to the low level in response to the correction pulse Φc, image data (9) is not written into the tenth line $X_{10}$. Hence, image data (8) is held in the tenth horizontal line $X_{10}$.

It should be noted that image data (5) is prevented from being written into the sixth horizontal line $X_6$ for the period $t_1$ and image data (9) is prevented from being written into the eleventh horizontal line $X_{11}$. However, as has been described previously, a sufficient time to write image data into these horizontal lines can be ensured.

Figure 17:
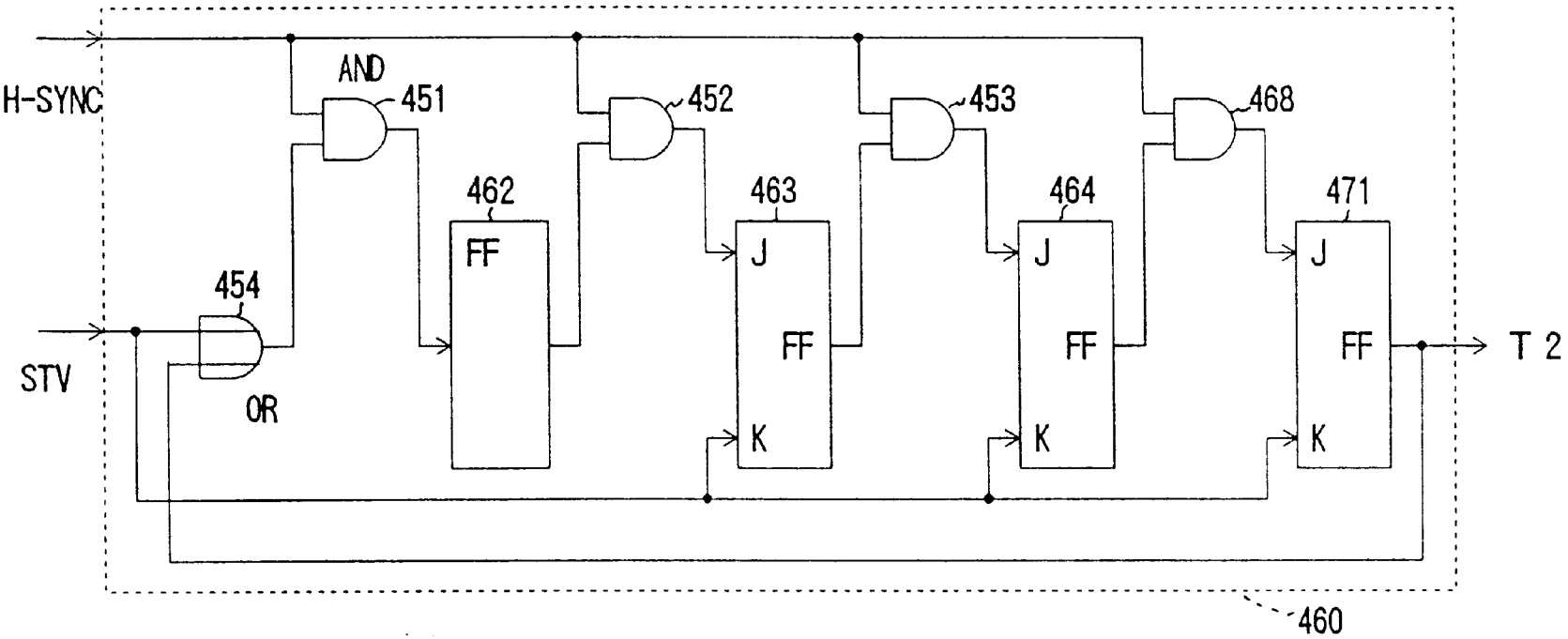
FIG. 17 is a block diagram of a part of an operation unit used in the second embodiment of the present invention, the above part generating a timing signal which enables identical image data to be simultaneously written into two consecutive horizontal lines.

FIG. 17 is a block diagram of the operation unit 460 used in the second embodiment of the present invention. In FIG. 17, parts that are the same as those shown in FIG. 13 are given the same reference numbers. As will be seen from FIGS. 13 and 17, a J-K flip-flop 471 and an AND gate 468 are added to the configuration shown in FIG. 13. The output signal of the flip-flop 471 serves as a timing signal T2, which is used instead of the aforementioned timing signal T1. The timing signal T2 is generated every four cycles of the shift clock signal Φx. The timing signal T2 thus generated is applied to the NAND gates 456 and 457 shown in FIG. 14.

In the above-mentioned first and second embodiments of the present invention, an image is enlarged in the vertical direction. In this case, it is preferable to enlarge the image in the horizontal direction so that the enlarged image has the same vertical/horizontal ratio as that of the normal image (not enlarged). In order to enlarge an image in the horizontal direction, the timing control circuit 40 has a configuration as shown in FIG. 17.

The timing control circuit 40 includes the aforementioned column counter 420, selectors 472, 473 and 474, a J-K flip-flop 469 and an AND gate 470. The selector 472 selects either the counter value indicating the zeroth column and the counter value indicating the 20th column in response to a normal/enlarge display mode selecting signal C3 supplied from, for example, an external device such as a personal computer. The selected counter value is applied to the flip-flop 469. The selector 473 selects either the counter value indicating the 80th column or the counter value indicating the 100th column in response to the normal/enlarge display mode selecting signal C3. The selected counter value is applied to the flip-flop 469. The output signal of the flip-flop 469 is applied to the AND gate 470. The selector 474 selects either a relatively low-speed clock signal C1 for the horizontal direction or a relatively high-speed clock signal C2 for the horizontal direction in response to the normal/enlarge display mode selecting signal C3. The selected clock signal is applied to the AND gate 470. The output signal of the NAND gate 470 forms the shift clock signal CLK for the horizontal direction.

Figure 18:
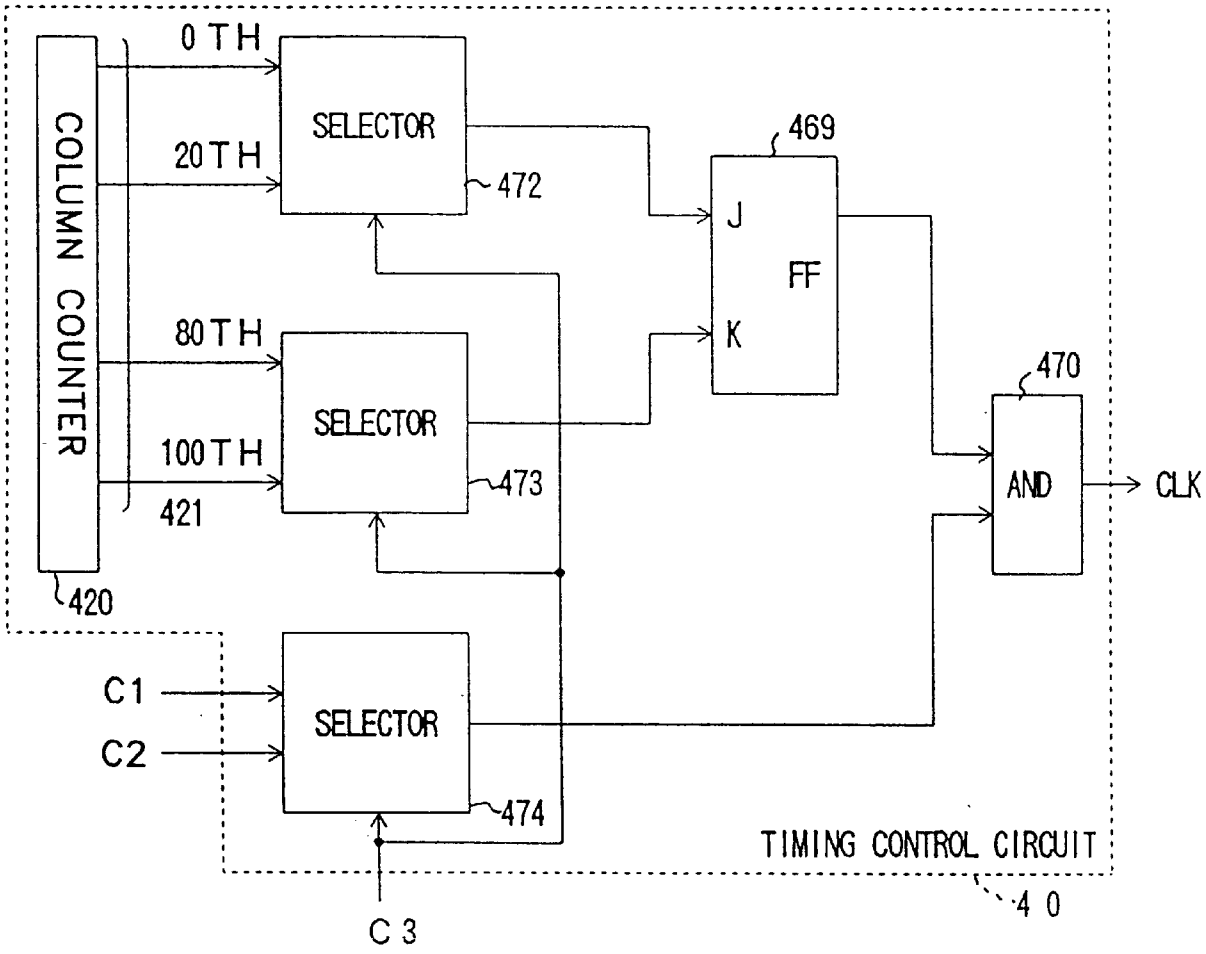
FIG. 18 is a block diagram of a circuit which enables an image to be enlarged in the horizontal direction in the configuration shown in FIG. 5.

In the configuration shown in FIG. 18, the image data in the horizontal direction is equally segmented into 100 columns, and the column counter 420 the counts 100 segmented columns. The selectors 472 and 473 respectively select the zeroth column and the 100th column in the normal display mode, and respectively select the 20th column and the 80th column in the enlarge display mode.

Figure 19:
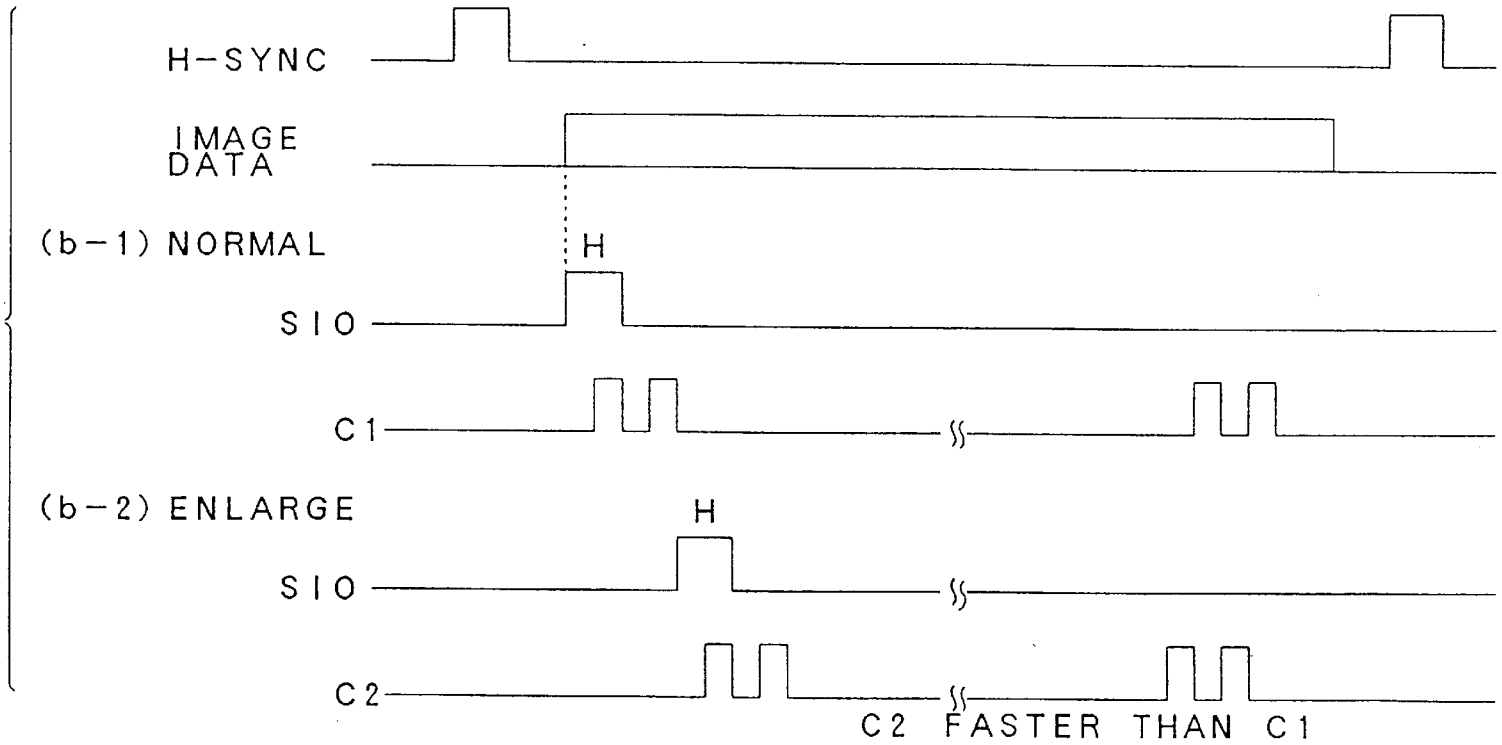
FIG. 19 is a timing chart of the circuit shown in FIG. 18.

FIG. 19 is a timing chart of the operation of the configuration of the timing control circuit 40 shown in FIG. 18. When the normal display mode is specified by the signal C3, the clock signal C1 is selected by the selector 474. In response to the horizontal driver start signal SIO, the number of clocks of the clock signal C1 equal to the number of dots arranged in one horizontal line is applied between the zeroth column and the 100th column. When the enlargement display mode is specified by the signal C3, the clock signal C2 that is faster than the clock signal C1 is selected by the selector 474. In the enlargement display mode, the selector 472 selects the signal indicating the 20th column and the selector 473 selects the signal indicating the 80th column. Between the 20th column and the 80th column, the number of clocks of the clock signal C2 equal to the number of dots arranged in one horizontal line is applied. In this case, the enlarged image can be displayed in the center portion between the 20th column and the 80th column.

The frequency of the clock signal C2 depends on the enlargement ratio. In other words, the range between the starting column selected by the selector 472 and the ending column selected by the selector 473 depends on the enlargement ratio.

It will now be assumed that the liquid crystal display panel 12 shown in FIG. 5 has 234 lines in the vertical direction and 480 dots in the horizontal direction, wherein a set of R, G and B forms one dot. In the normal operation mode, a display area has a vertical area between the first line and 234th line and a horizontal area between the first dot and the 480th dot. When the same image data as that forming the last line of every three lines is written into the next line following the above last line, a display area has a vertical area between the 29th line and the 204th line and a horizontal area between the 60th dot and the 420th dot. Hence, an enlarged image can be displayed on the central portion defined by the above display area. When the same image data as that forming the last line of every four lines is written into the next line following the above last line, a display area has a vertical area between the 23th line and the 210th line and a horizontal area between the 48th dot and the 432th dot. Hence, an enlarged image can be displayed on the central portion defined by the above display area.

A description will now be given of a third embodiment of the present invention. The third embodiment of the present invention is intended to further improve the quality of an enlarged image displayed on the panel 12.

In the operation shown in FIG. 7, the time during which image data (4) is written into the fifth horizontal line $X_5$ is shorter than the time during which the image data (1), (2) or (3) is written into the first, second or third (and fourth) horizontal line. In this case, strictly speaking, a completely uniform image may not be displayed on the panel 12. For example, an image forming the fifth horizontal line $X_5$ may be slightly darker than the images of the first through fourth horizontal lines $X_1$–$X_4$. With the above in mind, the third embodiment of the present invention which will be described below is directed to forming a uniform enlarged image.

Figure 20:
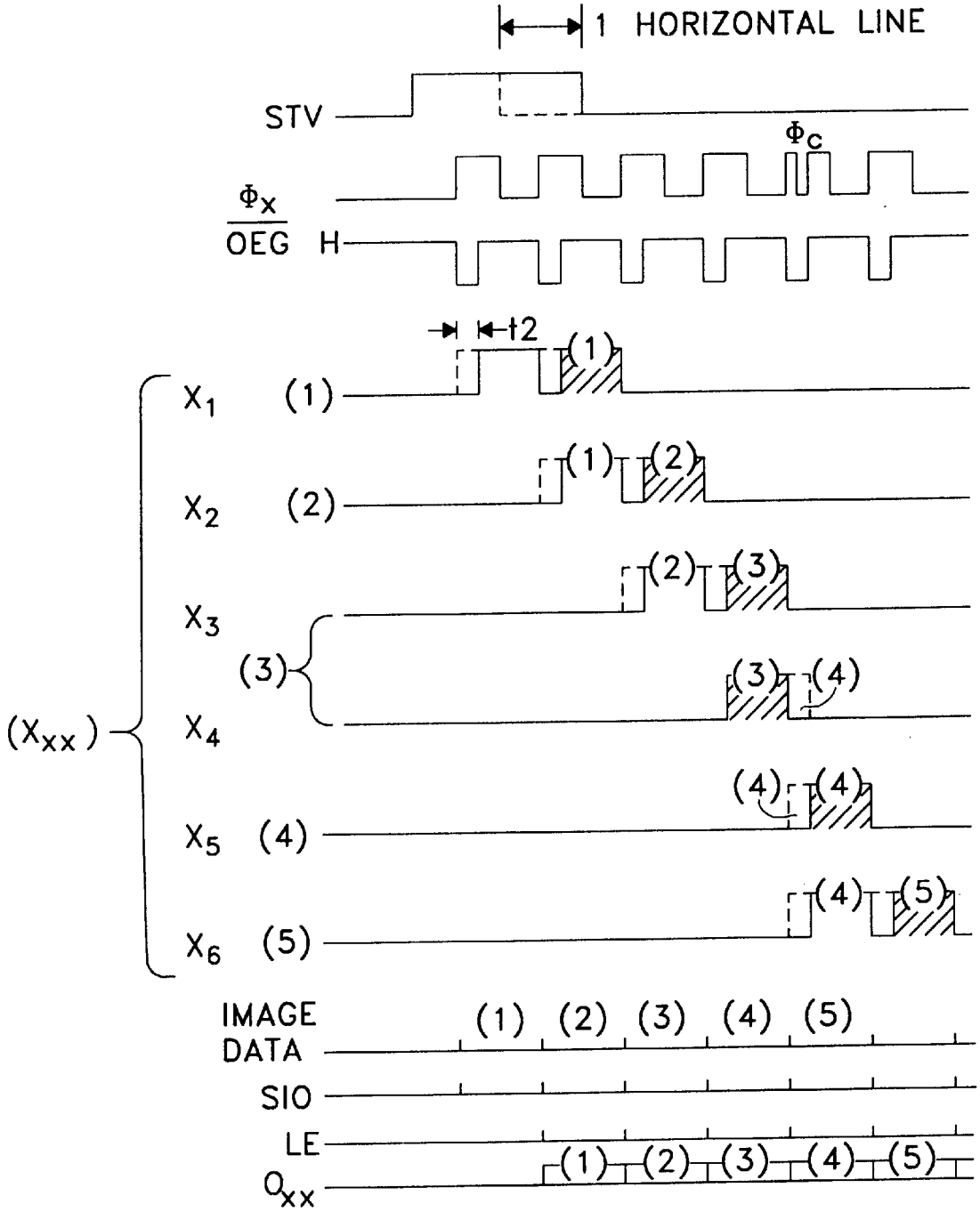
FIG. 20 is a timing chart of an operation of the liquid crystal display device according to a third embodiment of the present invention.

FIG. 20 is a timing chart of the operation of the third embodiment of the present invention. The output enable signal /OEG has a low-level section $t_2$ in each cycle of the shift clock signal Φx. While the output enable /OEG is at the low level, the write operation of image data is prevented. Hence, image data is written into each line during a period Tw equal to (one cycle of the shift clock signal Φx)–$t_2$. The time Tw is selected so that it is equal to the time during which image data (4) is written into the fifth horizontal line $X_5$. Hence, it is possible to form a uniform enlarged image. It will be noted that the time it takes to write image data in each horizontal line is longer than half the cycle of the shift clock signal Φx but less than Tw, and is thus sufficient.

Figure 21:
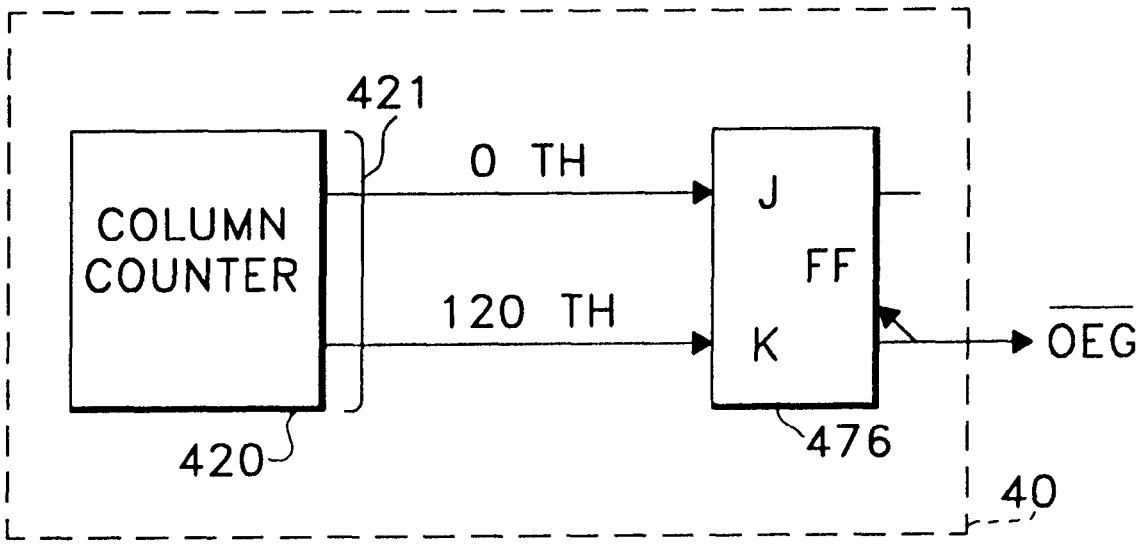
FIG. 21 is a block diagram of a part of a timing control circuit used in the third embodiment of the present invention.

The output enable signal /OEG shown in FIG. 20 can be generated by a configuration of the timing control circuit 40 shown in FIG. 21. The timing control circuit 40 has a J-K flip-flop 476, which receives predetermined counter values included in column count data 421 output by the column counter 420. For example, the flip-flop 476 receives the counter value indicating the zeroth column and the counter value indicating the 120th column. The output enable signal /OEG is switched to the low level when receiving the counter value indicating the zeroth column and is switched to the high level when receiving the counter value indicating the 120th column.

A description will now be given of a fourth embodiment of the present invention. The fourth embodiment of the present invention is directed to making it possible to change the enlargement ratio and the display starting line.

Figure 22:
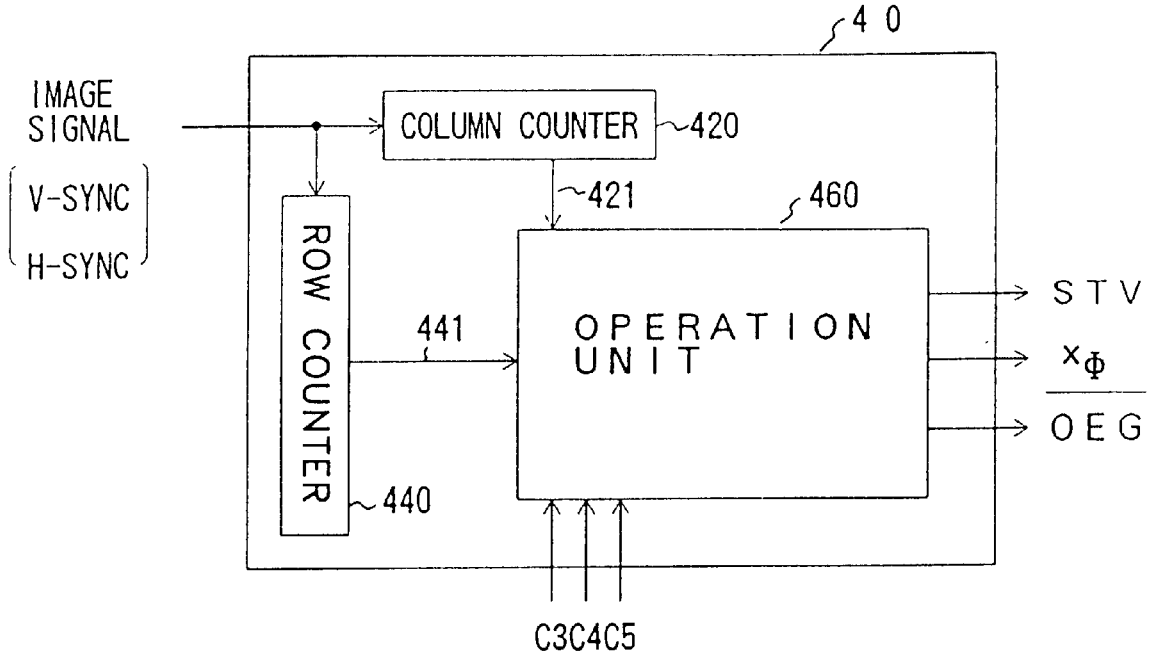
FIG. 22 is a block diagram of a part of a timing control circuit used in a fourth embodiment of the present invention.

FIG. 22 is a block diagram of the timing control circuit 40 used in the fourth embodiment of the present invention. The block configuration shown in FIG. 22 is almost the same as that shown in FIG. 11. The operation unit 460 shown in FIG. 22 receives the aforementioned normal/enlarge display mode selecting signal C3, an enlargement ratio indicating signal C4 and a display start line selecting signal C5.

Figure 23:
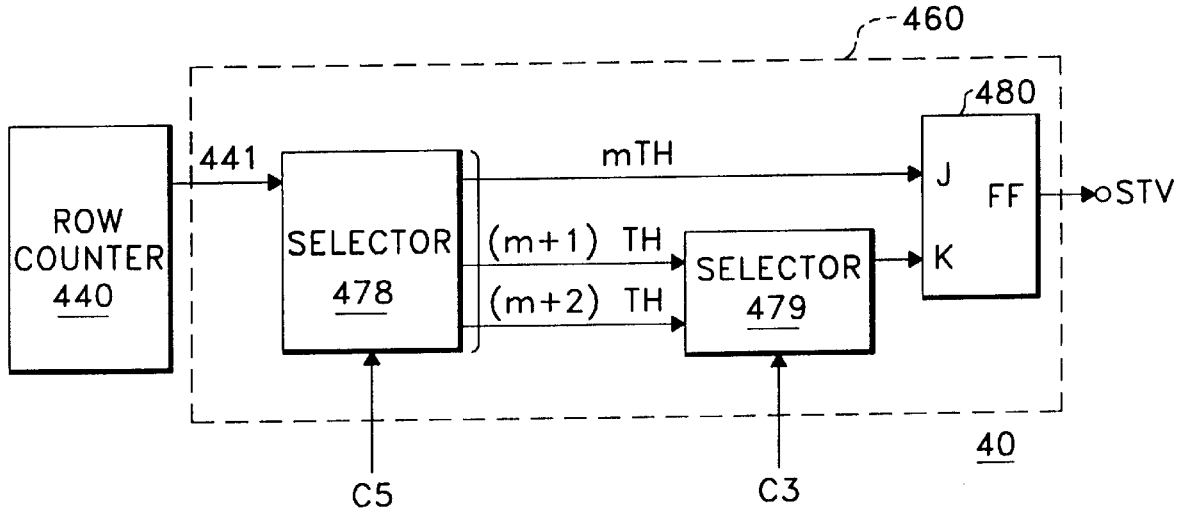
FIG. 23 is a block diagram of a part of an operation unit shown in FIG. 22.

FIG. 23 is a block diagram of a circuit portion of the operation unit 460 shown in FIG. 22, the circuit portion generating the vertical driver start signal STV. The operation unit 460 includes a selector 478, a selector 479 and a J-K flip-flop 480. The selector receives the row count data 441 from the row counter 440, and extracts therefrom the counter values respectively indicating mth, m+1th and m+2th rows in accordance with the display starting line selecting signal C5. If the display starting line selecting signal C5 indicates the 10th row (m=10), the selector 478 selects the counter values respectively indicating the tenth, eleventh and twelfth rows (m, m+1, m+2). The counter value indicating the mth row is applied to the J-K input terminal of the flip-flop 480.

Figure 24A:
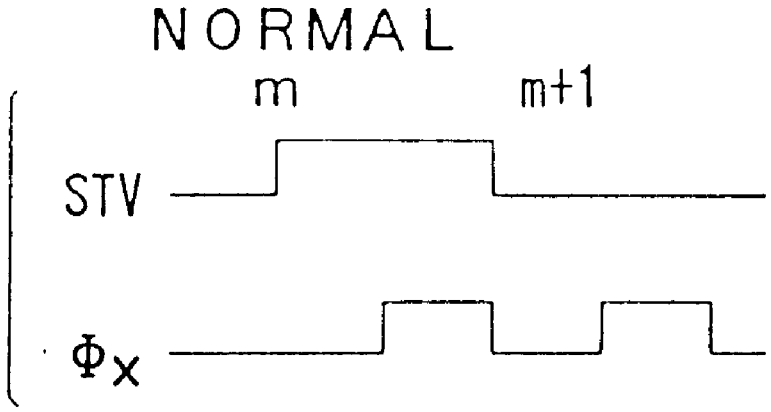
FIGS. 24A and 24B are timing charts showing phase relations between a vertical driver start signal and a shift clock signal used in the embodiments of the present invention.
Figure 24B:
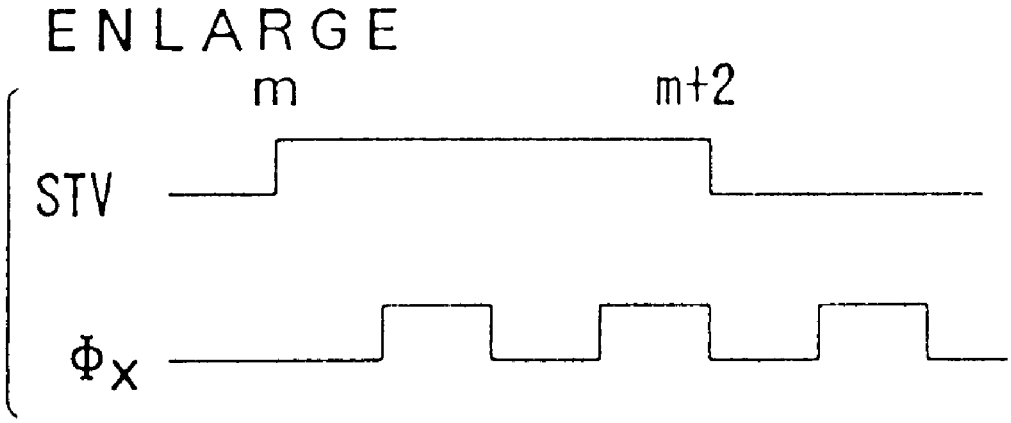

The counter values respectively indicating the m+1th and m+2th rows are applied to the selector 479, which selects either the m+1th row or the m+2th row in response to the normal/enlarge display mode selecting signal C3. When the normal display mode is indicated by the signal C3, the selector 479 selects the m+1th row. When the enlargement display mode is indicated by the signal C3, the selector 479 selects the m+2th row. The flip-flop 480 maintains the vertical driver start signal STV at the high level between the mth row and the m+1th row in the normal display mode, as shown in FIG. 24A. The flip-flop 480 maintains the vertical driver start signal STV at the high level between the mth row and the m+2 row in the enlargement display mode, as shown in FIG. 24B.

Figure 25:
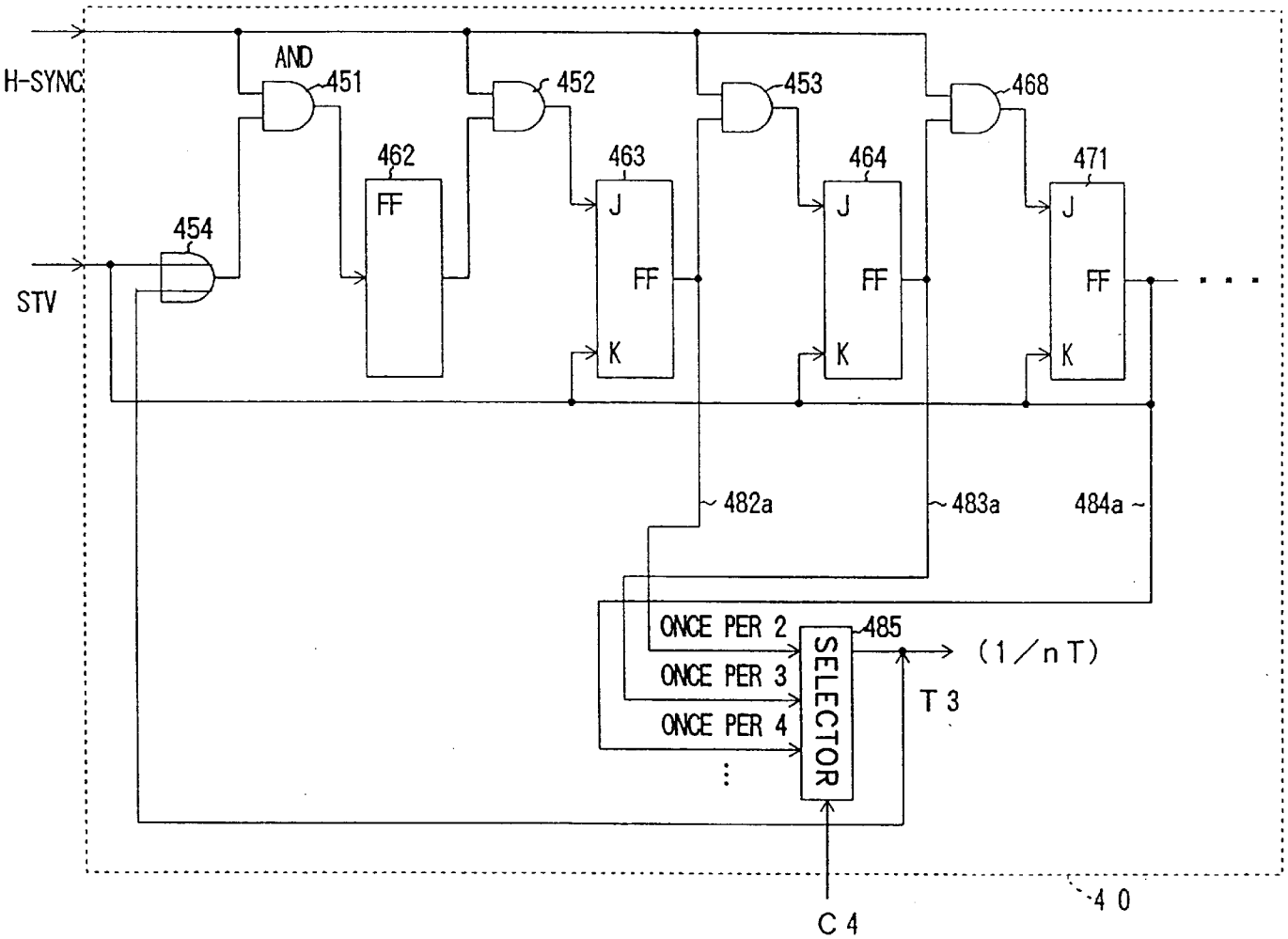
FIG. 25 is a block diagram of a part of the timing control circuit used in the fourth embodiment of the present invention, the above part generating a timing signal which enables identical image data to be simultaneously written into two consecutive horizontal lines at a selectable enlargement ratio.

FIG. 25 is a block diagram of a circuit portion of the timing control circuit 40, the circuit portion generating a timing signal T3 [(1/n)T]. The circuit portion shown in FIG. 25 is based on the circuit portion shown in FIG. 17. A plurality of J-K flip-flops such as 463, 464 and 471 can be connected, as shown in FIG. 25, and the output signals of the respective J-K flip-flops are applied to a selector 485. The selector 485 selects one of the received output signals in accordance with the enlargement ratio indicated by the enlargement ratio selecting signal C4. If an enlargement ratio of 4/3 (n=3) is specified, the selector 485 selects the output signal 483*a* of the J-K flip-flop 464. As has been described previously, the same image data as that of the last (third) horizontal line of every three consecutive horizontal lines is written into the next horizontal line following the above last horizontal line.

Figure 26:
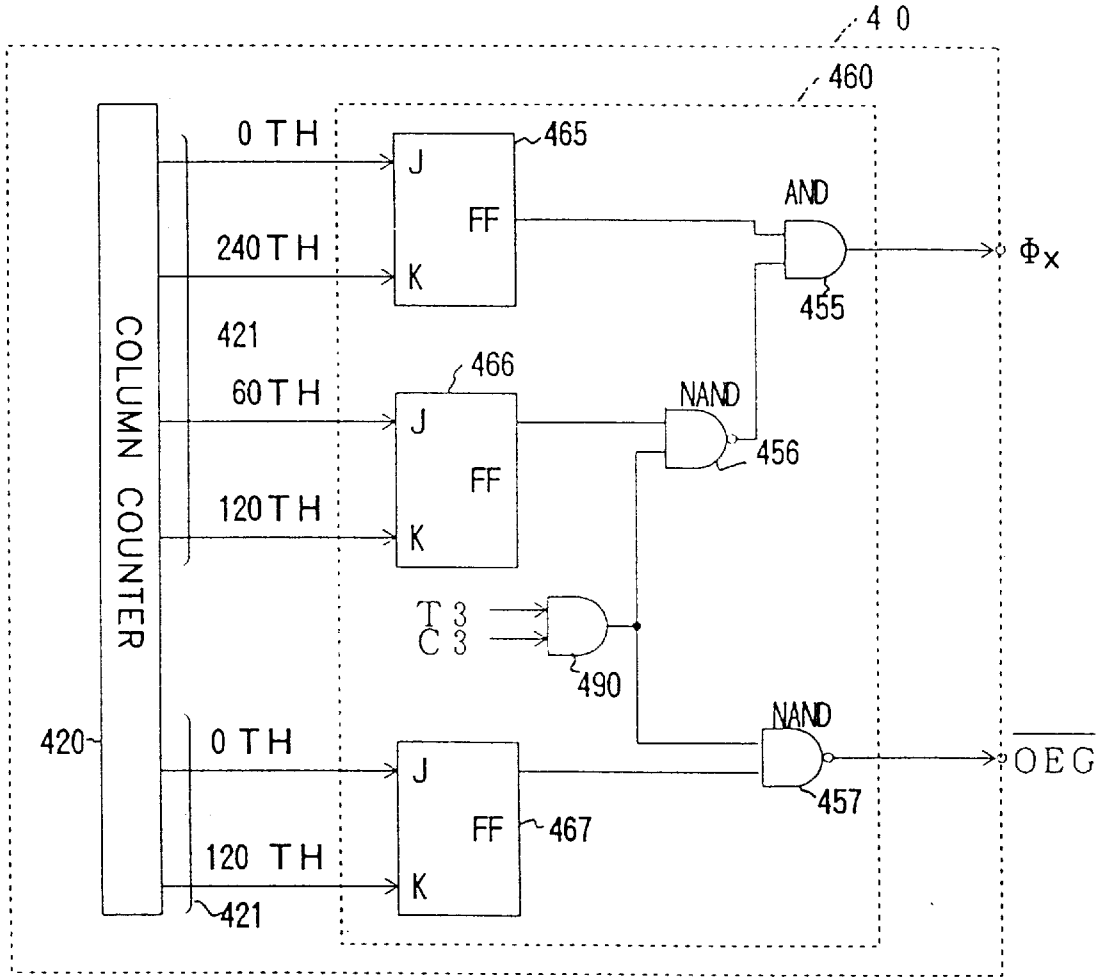
FIG. 26 is a block diagram of a part of the timing control circuit used in the fourth embodiment of the present invention, the above part generating a shift clock signal and an output enable signal, which signals are supplied to the vertical driver circuit.

The timing signal T3 thus generated is applied to a circuit configuration of the operation unit 460 shown in FIG. 26, in which parts that are the same as those shown in FIG. 14 are given the same reference numbers. An AND gate 490 is provided as shown in FIG. 26. The AND gate 490 receives the timing signal T3 and the normal/enlarge display mode selecting signal C3. The output signal of the AND gate 490 is applied to the NAND gates 456 and 457. In the normal display mode in which the signal C3 is low, the AND gate 490 does not pass the timing signal T3. In the enlargement display mode in which the signal C3 is high, the AND gate 490 passes the timing signal T3. The other operation of the circuit shown in FIG. 26 is the same as has been described with reference to FIG. 14.

A description will now be given, with reference to FIG. 27, of a liquid crystal display device according to a fifth embodiment of the present invention. The fifth embodiment of the present invention is directed to eliminating the aforementioned problems of the CS-ON-GATE type device.

Figure 27:
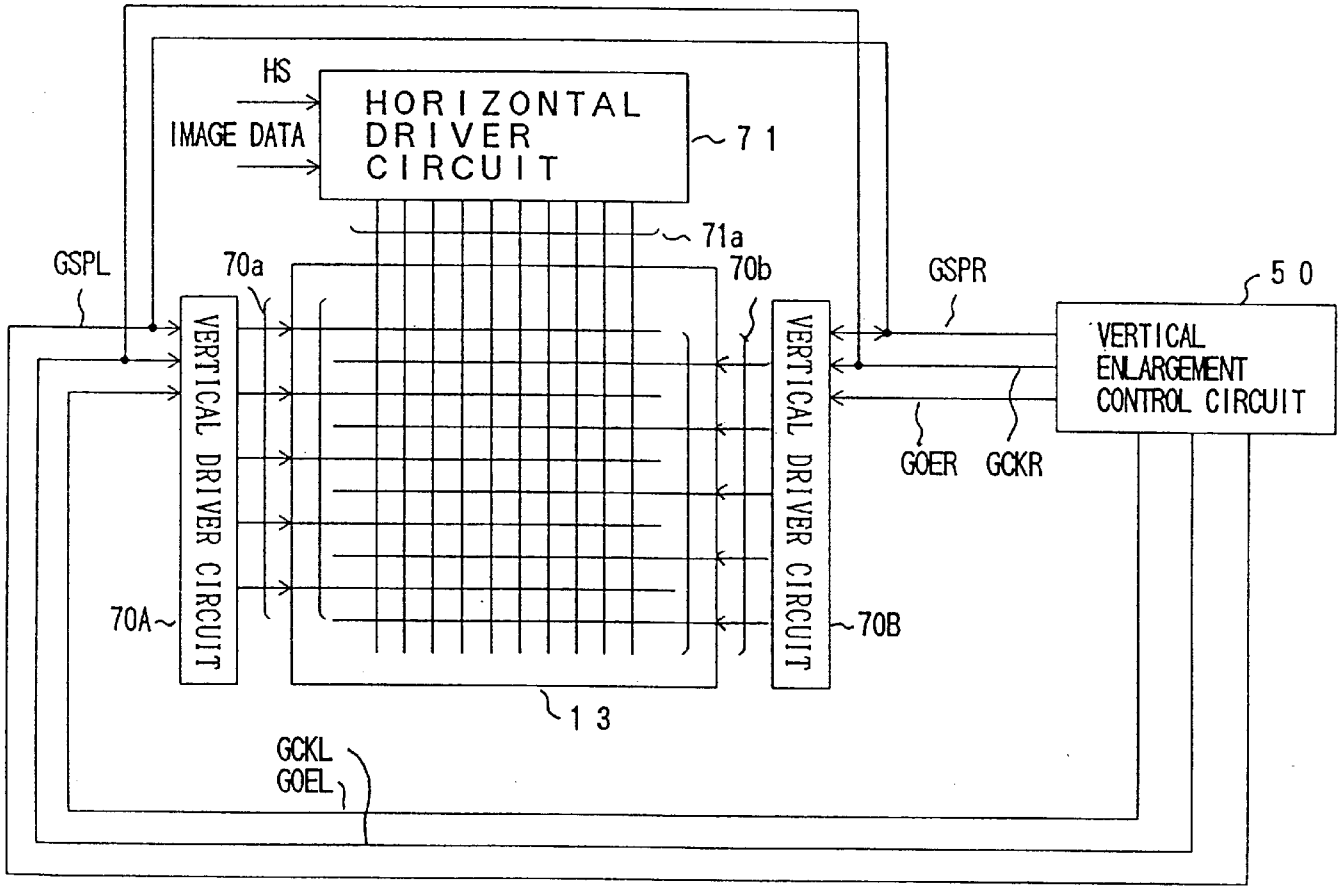
FIG. 27 is a block diagram of a liquid crystal display panel according to a fifth embodiment of the present invention.

A liquid crystal display device 11 shown in FIG. 27 includes a liquid crystal display panel 13 of the CS-ON-GATE type, a vertical enlargement control circuit 50, two vertical driver circuits 70A and 70B, and a horizontal driver circuit 71. The horizontal driver circuit 71 is located at the upper side of the panel 13, and the vertical driver circuits 70A and 70B are located at left and right sides of the panel 13 so that the panel 13 is sandwiched therebetween. Electrodes (scan bus lines) extend toward the right side from the vertical driver circuit 70A, and electrodes (scan bus lines) extend toward the left side from the vertical driver circuit 70B. The electrodes extending from the vertical driver circuit 70A and the electrodes extending from the vertical driver circuit 70B are alternately arranged. Data bus lines extend from the horizontal driver circuit 71.

The horizontal driver circuit 71 latches image data equal to one horizontal line in one cycle of a horizontal synchronizing signal HS, and outputs voltages 71*a* corresponding to image data latched in the previous one cycle to the electrodes. The signal HS corresponds to the aforementioned horizontal synchronizing signal H-SYNC.

The vertical driver circuit 70A operates in synchronism with a scan clock signal GCKL generated by the control circuit 50, and outputs line select signals 70*a* to the electrodes (scan bus lines) of the CS-ON-GATE type panel 13 after receiving a start signal GSPL generated by the control circuit 50. The scan clock signal GCKL corresponds to the aforementioned shift clock signal CLK. The start signal GSPL corresponds to the aforementioned vertical driver start signal STV. The vertical driver circuit 70A receives an output enable signal GOEL which can specify that the line select signals 70*a* are valid or invalid.

The vertical driver circuit 70B operates in synchronism with a scan clock signal GCKR generated by the control circuit 50, and outputs line select signals 70*b* to the electrodes (scan bus lines) of the CS-ON-GATE type panel 13 after receiving a start signal GSPR generated by the control circuit 50. The scan clock signal GCKR corresponds to the aforementioned shift clock signal CLK. The start signal GSPR corresponds to the aforementioned vertical start signal STV. The vertical driver circuit 70B receives an output enable signal GOER which can specify that the line select signals 70*b* are valid or invalid.

The vertical enlargement control circuit 50 generates the start signals GSPL and GSPR, the scan clock signals GCKL and GCKR, and the output enable signals GOEL and GOER. The vertical enlargement control circuit 50 is capable of enlarging an image at an enlargement ratio which is equal to an integer multiple but also a value other than an integer multiple.

Figure 28:
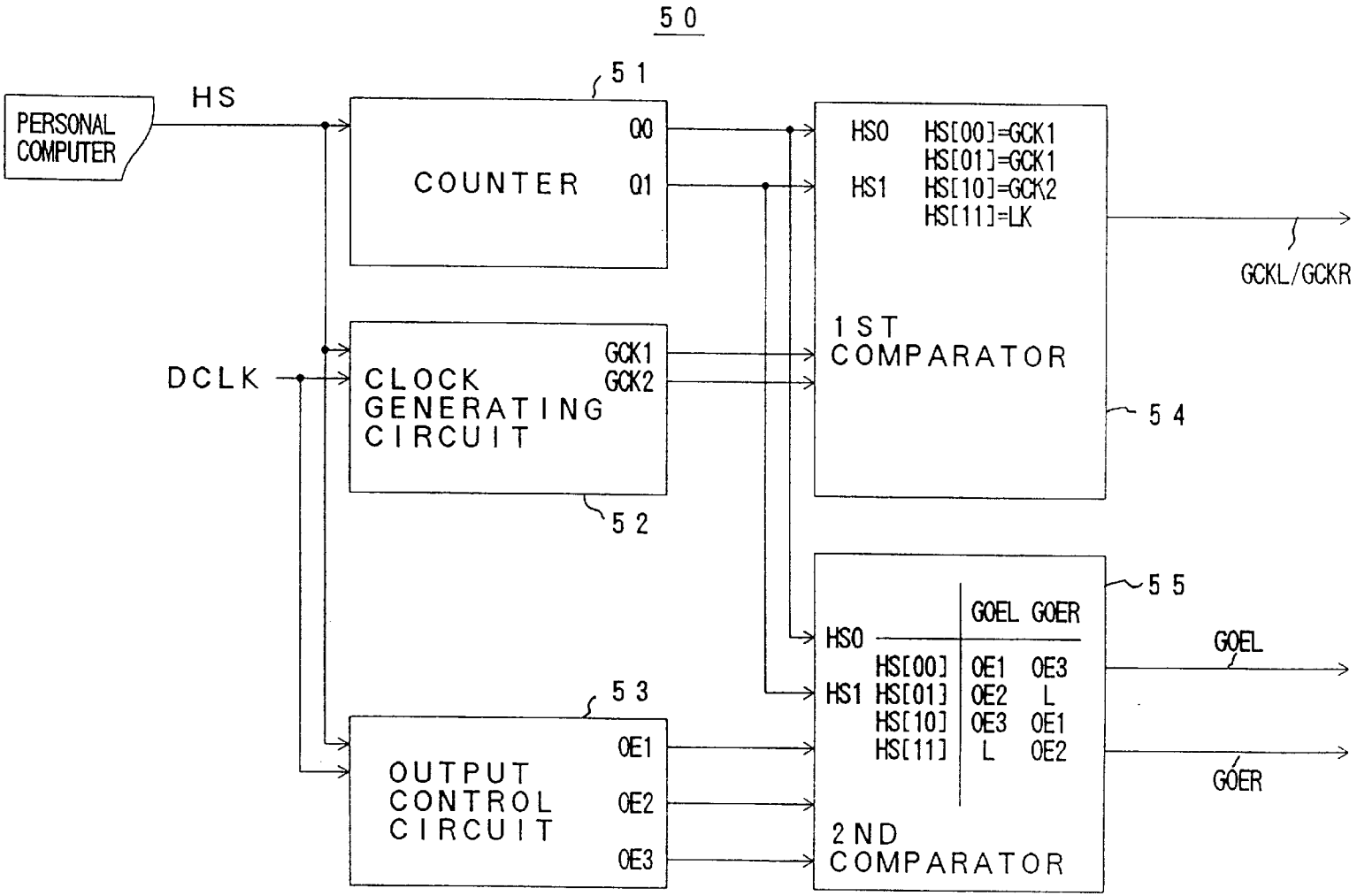
FIG. 28 is a block diagram of a vertical enlargement control circuit shown in FIG. 27.

FIG. 28 is a block diagram of the vertical enlargement control circuit 50. As shown in FIG. 28, the vertical enlargement control circuit 50 is made up of a horizontal synchronizing signal counter 51, a clock generating circuit 52, an output control circuit 53, a first comparator circuit 54, and a second comparator circuit 55.

The clock generating circuit 52 produces clock signals GCK1 and GCK2 from the horizontal synchronizing signal HS contained in an image signal supplied from a personal computer or the like and the clock signal DCLK synchronized with the horizontal synchronizing signal HS.

Figure 29:
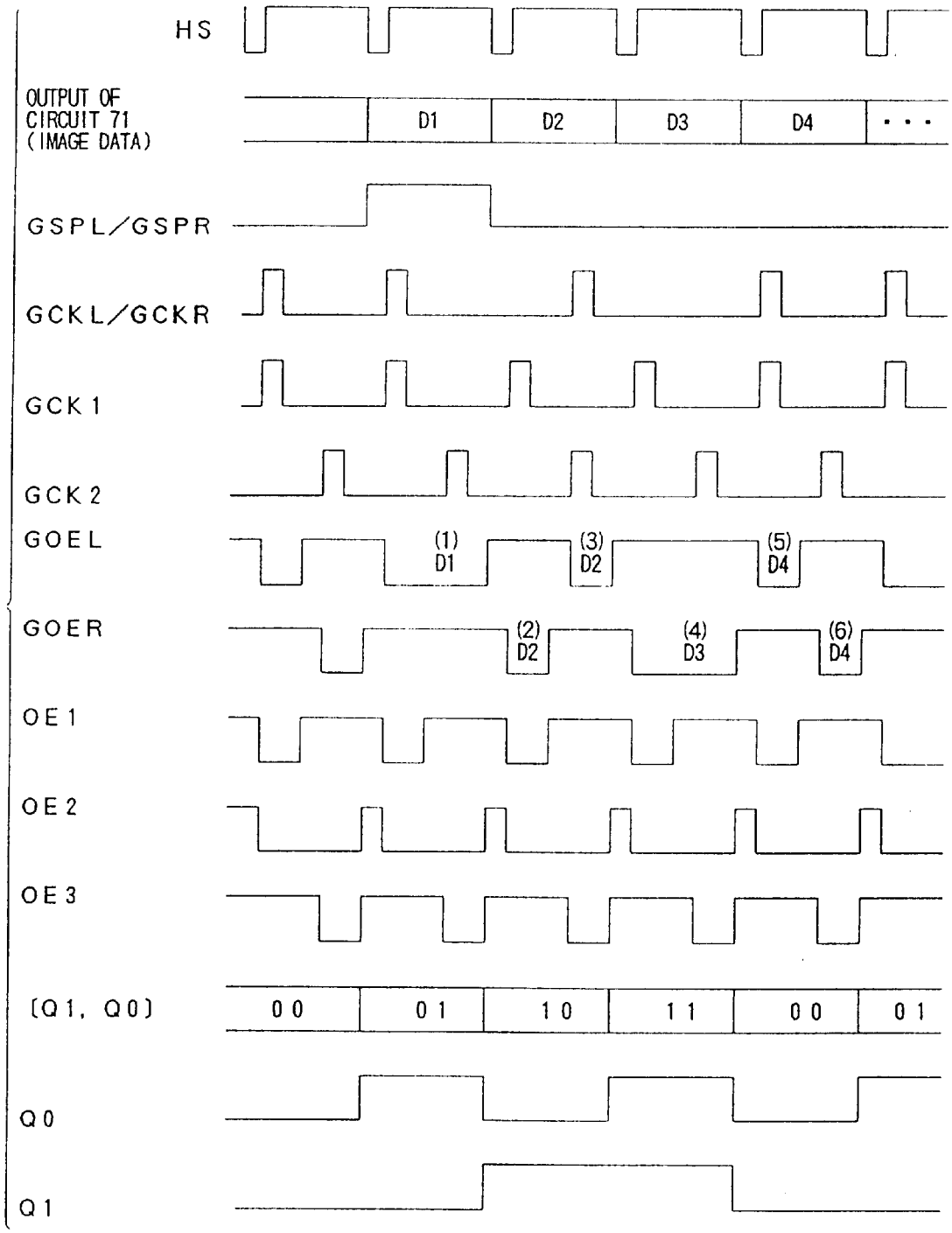
FIG. 29 is a timing chart of an operation of the vertical enlargement control circuit shown in FIG. 28.

The horizontal synchronizing signal counter 51 is formed of a two-bit counter, which counts the horizontal synchronizing signal HS and count signals Q0 and Q1 as shown in FIG. 29. The output control circuit 53 produces pulse output control signals OE1, OE2 and OE3 from the clock signal DCLK. As shown in FIG. 29, each of the pulse output control signals OE1, OE2 and OE3 has one respective pulse in one cycle of the horizontal synchronizing signal HS.

The first comparator circuit 54 compares the count signals Q0 and Q1, and selects one of the signals GCK1, GCK2 or a low-level signal on the basis of the result of the comparison. The selected signal is commonly used as the scan clock signal GCKL or GCKR. More particularly, when Q0=0 and Q1=0 or 1, the clock signal GCK1 is selected. When Q0=1 and Q1=0, the clock signal GCK2 is selected. When Q0=1 and Q1=1, the low-level signal is output. The scan clock signal GCKL or GCKR has three pulses in four cycles of the horizontal synchronizing signal HS. This operation corresponds to an enlargement ratio of 3/2.

The second comparator circuit 55 compares the count signals Q0 and Q1, and selects two of the output control signals OE1, OE2 and OE3 and the low-level signal as the output enable signals GOEL and GOER. More particularly, when Q0=0 and Q1=0, the output enable signals OE1 and OE3 are respectively selected as GOEL and GOER. When Q0=1 and Q1=1, the output enable signal OE2 and the low-level signal L are output as GOEL and GOER. When Q0=1 and Q1=0, the output enable signals OE3 and OE1 are respectively selected as GOEL and GOER. When Q0=1 and Q1=1, the low-level signal L and the output enable signal OE2 are selected as GOEL and GOER.

As shown in FIG. 29, the output enable signals GOEL and GOER do not simultaneously indicate the output enable states of the vertical drivers 70A and 70B.

A description will now be given, with reference to FIGS. 29 and 30, of an operation of the liquid crystal display device 11 shown in FIG. 27 in which an image is enlarged at an enlargement ratio of 3/2.

Figure 30:
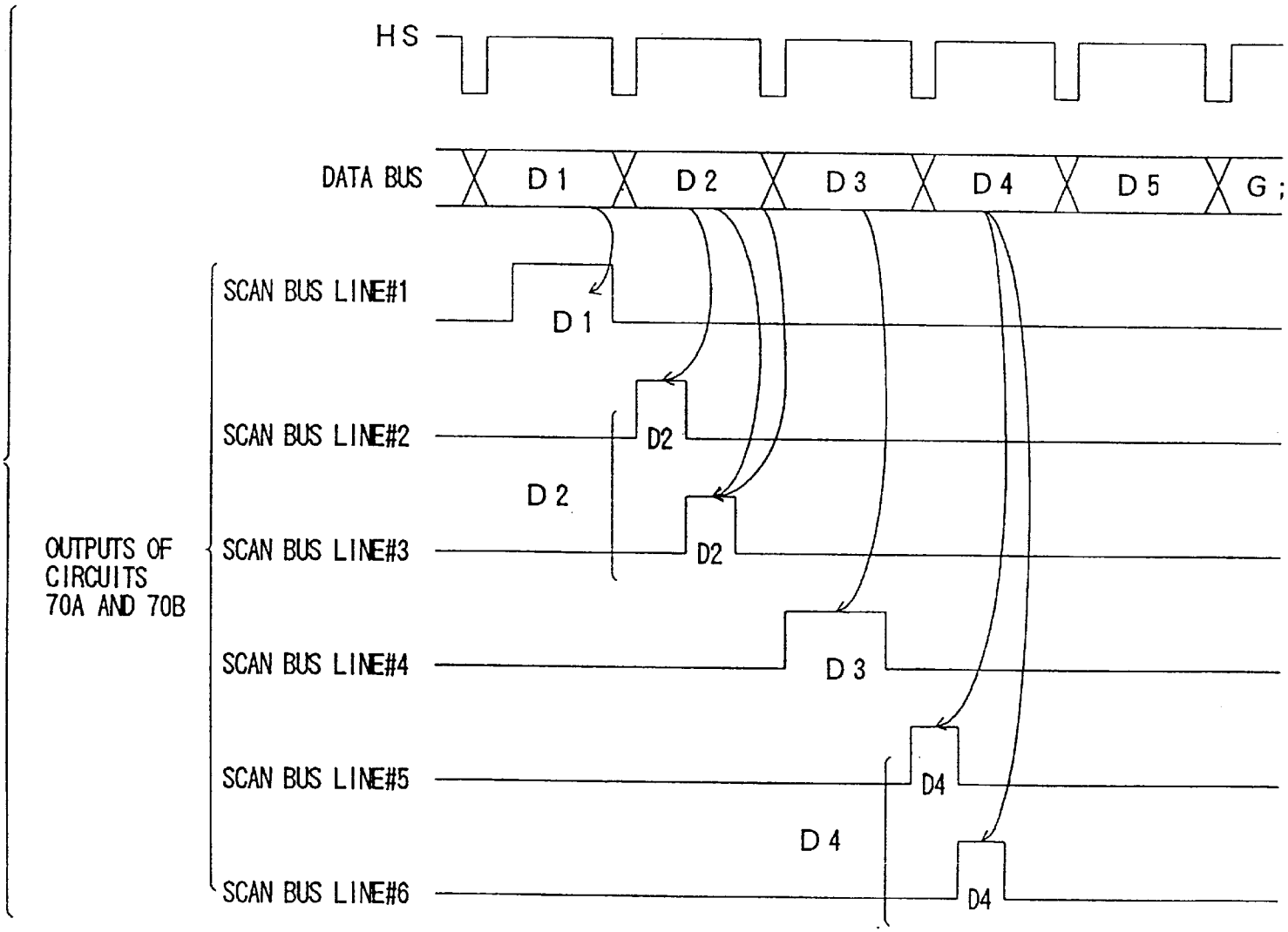
FIG. 30 is a timing chart of a vertical driver circuit shown in FIG. 28.

FIG. 30 is a timing chart of the vertical driver circuits 70A and 70B shown in FIG. 27. Image data amounting to two horizontal lines is used to form three horizontal lines so that an enlargement ratio of 3/2 can be realized.

Referring to FIGS. 29 and 30, the vertical driver circuit 70A receives the output enable signal GOEL from the enlargement control circuit 50, and outputs the line select signal 70*a* within the low-level period of the output enable signal GOEL. In the case shown in FIGS. 29 and 30, scan bus line (horizontal line) #1 is driven. The output enable signals GOEL and GOER are not simultaneously low in order to prevent two adjacent lines from being simultaneously driven. As shown in FIGS. 29 and 30, image data D1 is written into the scan bus line #1.

In the next cycle of the horizontal synchronizing signal HS, the output enable signal GOER is switched to the low level while the output enable signal GOEL is high. Hence, the vertical driver circuit 70B outputs the line select signal 70*b*, so that image data is written into the driven horizontal line #2 by the vertical driver circuit 70B. It should be noted that the output enable signal GOER is low in the first half of the cycle of the horizontal synchronizing signal HS. In the second half of the cycle of the horizontal synchronizing signal HS, the output enable signal GOEL is switched to the low level and the output enable signal GOER is switched to the high level. Hence, image data D2 is written into scan bus line #3 by the vertical driver circuit 70A in the second half of the cycle of the horizontal synchronizing signal HS. In the above manner, image data D2 is written into two adjacent scan bus lines #2 and #3.

In the same manner as described above, image data D3 is written into scan bus line #4 by the vertical driver circuit 70B. In the first half of the next cycle, image data D4 is written into scan bus line #5 by the vertical driver circuit 70A, and is written into scan bus line #6 by the vertical driver circuit 70B in the second half of the above cycle.

As described above, identical image data can be written into two consecutive scan bus lines without simultaneously driving these bus lines, so that image can easily be enlarged in the vertical direction at a desired enlargement ratio equal to an integer multiple or an arbitrary value other than the integer multiple.

When an image is enlarged in the vertical direction at a desired enlargement ratio as described above, it is preferable to enlarge the image in the horizontal direction at the same enlargement ratio as that used to enlarge the image in the vertical direction. In order to realize the horizontal enlargement, as shown in FIG. 31, a horizontal enlargement control circuit 60 is provided in the liquid crystal display device according to the fifth embodiment of the present invention shown in FIG. 27.

Figure 31:
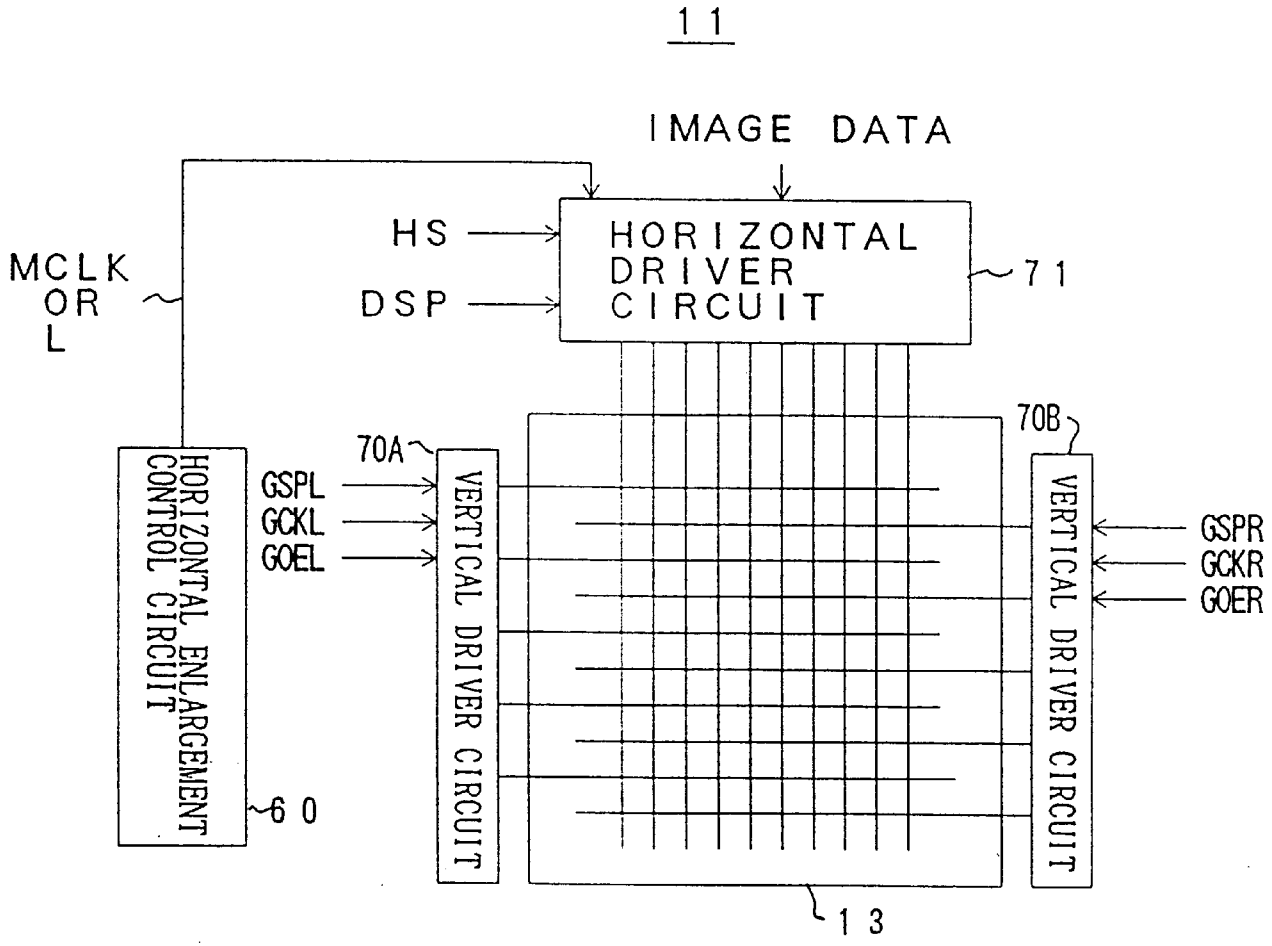
FIG. 31 is a block diagram of a liquid crystal display device capable of enlarging an image in the horizontal direction.

Referring to FIG. 31, the horizontal enlargement control circuit 60 controls the horizontal driver circuit 71 as described below.

Figure 32:
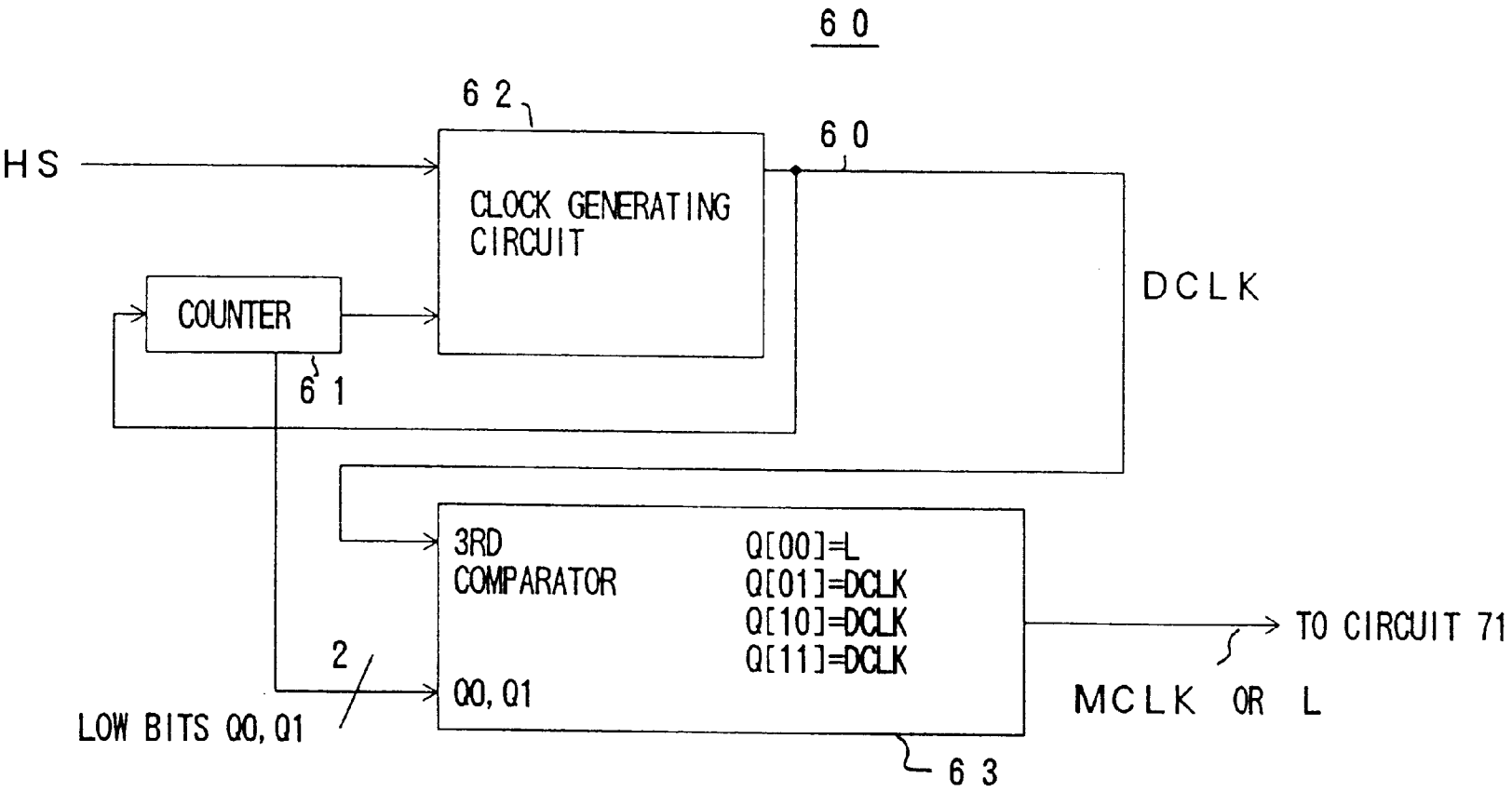
FIG. 32 is a block diagram of a horizontal enlargement control circuit shown in FIG. 31.

FIG. 32 is a block diagram of the horizontal enlargement control circuit 60 shown in FIG. 31. As shown in FIG. 32, the circuit 60 is made up of a counter 61, a clock generating circuit 62, and a third comparator circuit 63. The clock generating circuit 62 produces the clock signal DCLK from the horizontal synchronizing signal HS. The frequency of the clock signal DCLK is twice that of the clock signal synchronized with the image data. The output signal of the counter 61, which counts the clock signal DCLK, is phase-compared with the horizontal synchronizing signal HS, so that the phase of the clock signal DCLK can be stabilized.

The third comparator circuit 63 compares the stabilized clock signal DCLK and the two low bits Q0 and Q1 of the counter value with each other, and outputs a horizontal-direction interpolation signal MCLK when the two low bits Q0 and Q1 are respectively 0 and 1, 1 and 0 or 1 and 1. When the two low bits Q0 and Q1 are both 0, the third comparator circuit 63 outputs a low-level signal L. The output signal of the third counter 63 is supplied to the horizontal driver circuit 71.

Figure 33:
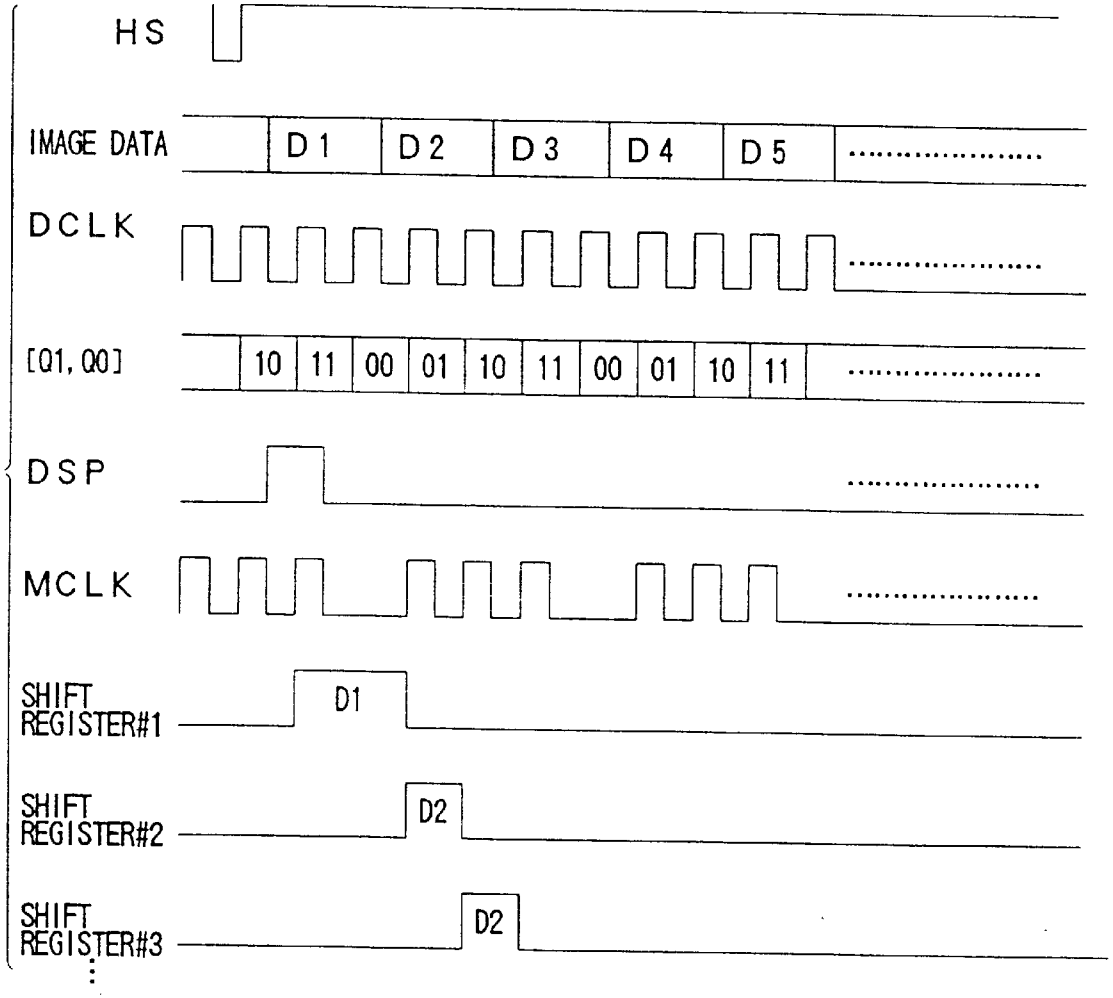
FIG. 33 is a timing chart of an operation of the horizontal enlargement control circuit shown in FIG. 32.

The horizontal driver circuit 71 includes shift registers such as #1, #2 and #3 shown in FIG. 33, to which the output signal of the third comparator circuit 63 (that is, the clock signal MCLK or the low-level fixed signal L) is sequentially applied. In the case shown in FIG. 33, the low-level signal L is applied to the shift register #1 and the one-shot pulses of the clock signal MCLK are respectively applied to the shift registers #2 and #3. These shift registers of the horizontal driver circuit 71 can start the shift operation in response to the start pulse signal DSP (which corresponds to the aforementioned horizontal driver start signal SIO).

The shift register #1 outputs image data D1 in one cycle of the clock signal synchronized with the image data, and the shift registers #2 and #3 output identical image data D2 in the next cycle thereof. The shift register #1 is connected to the first data bus line, and the shift registers #2 and #3 are respectively connected to the second and third data bus lines. The above operation is repeatedly carried out so that all the data lines are supplied with image data. It will be noted that identical image data is supplied to the two data bus lines every three data bus lines and an enlargement ratio of 3/2 can be thus realized.

As a result, an image can be enlarged in the horizontal and vertical directions at an enlargement ratio of 3/2. For example, image data of the VGA (640 dots×480 horizontal lines) can be enlarged at an enlargement ratio of 3/2 and be displayed on the CS-ON-GATE type matrix liquid display panel 13.

A description will now be given of a liquid crystal display device according to a sixth embodiment of the present invention. The sixth embodiment of the present invention modifies the above-mentioned fifth embodiment invention so that the sixth embodiment realizes an enlargement of 1.25 at which an image is enlarged in the vertical direction. The block structure of the sixth embodiment of the present invention is almost the same as shown in FIG. 27. However, the sixth embodiment of the present invention differs from the fifth embodiment thereof in the following.

Figure 34:
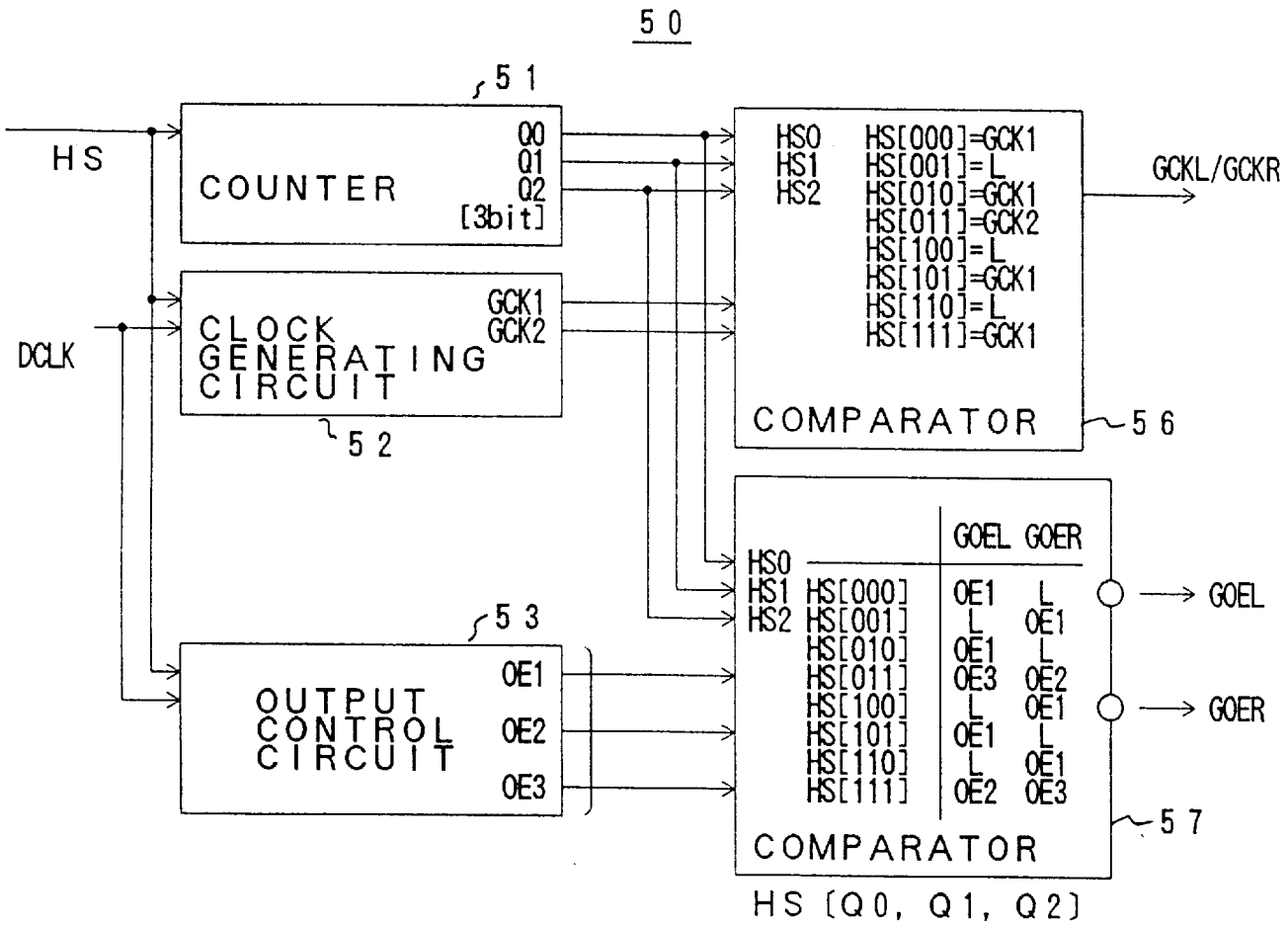
FIG. 34 is a block diagram of a vertical enlargement control circuit of a liquid crystal display device according to a sixth embodiment of the present invention.

The vertical enlargement control circuit 50 is configured as shown in FIG. 34, in which parts that are the same as those shown in FIG. 28 are given the same reference numbers. The configuration shown in FIG. 34 includes a fourth comparator circuit 56 substituted for the first comparator circuit 54 shown in FIG. 28, and a fifth comparator circuit 57 substituted for the second comparator circuit 57 shown in FIG. 28. Further, bit Q2 output by the counter 51 is used in addition to the bits Q0 and Q1.

Figure 35:
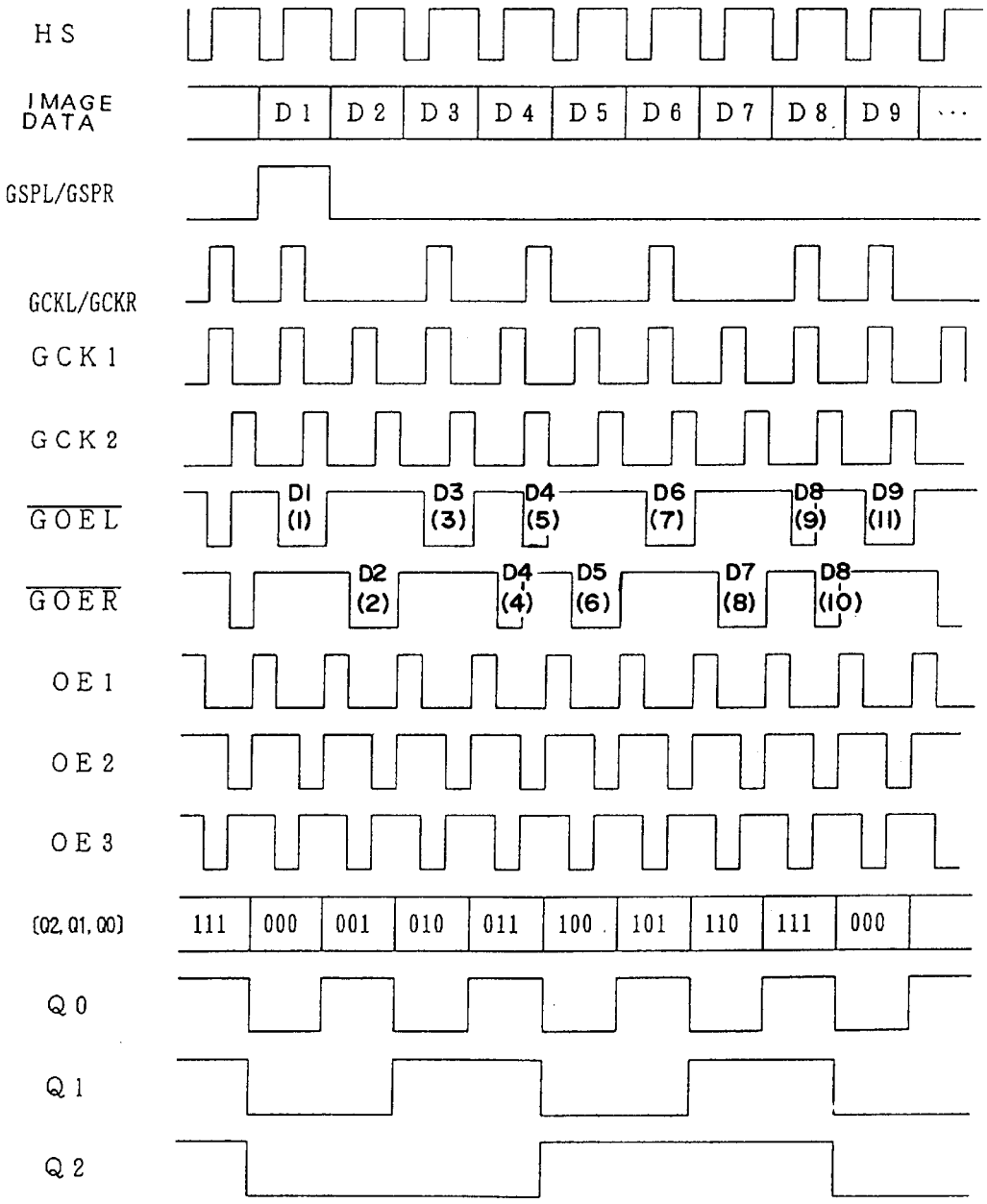
FIG. 35 is a timing chart of the vertical enlargement control circuit shown in FIG. 34.

The vertical enlargement control circuit 50 produces the output enable signals GOEL and GOER as shown in FIG. 35. The output enable signals GOEL and GOER are serially switched to the low level in one cycle of the clock signal synchronized with the image data every four cycles thereof. In the case shown in FIG. 35, image data D4 is serially written into the fourth and fifth horizontal lines (4) and (5) within one cycle, and image data D8 is serially written into the ninth and tenth horizontal lines (9) and (10) within one cycle.

Turning to FIG. 34 again, the fourth comparator circuit 56 operates according to the following table.

| HS [Q2,Q1,Q0] | OUTPUT |
|---|---|
| 000 | GCK1 |
| 001 | L |
| 010 | GCK1 |
| 011 | GCK2 |
| 100 | L |
| 101 | GCK1 |
| 110 | L |
| 111 | GCK1 |

The fifth comparator circuit 57 operates according to the following table.

| HS [Q2,Q1,Q0] | GOEL | GOER |
|---|---|---|
| 000 | OE1 | L |
| 001 | L | OE1 |
| 010 | OE1 | L |
| 011 | OE3 | OE2 |
| 100 | L | OE1 |
| 101 | OE1 | L |
| 110 | L | OE1 |
| 111 | OE2 | OE3 |

The operation of the sixth embodiment of the present invention will now be described with reference to FIG. 35. Image data D1 is written into the first horizontal line (1) by the vertical driver circuit 70A in response to the output enable signal GOEL. In the next cycle, image data D2 is written into the second bus line (2) by the vertical driver circuit 70B in response to the output enable signal GOER. In the next cycle, image data D3 is written into the third horizontal line (3) by the vertical driver circuit 70A in response to the output enable signal GOEL. In the first half of the next cycle, image data D4 is written into the fourth horizontal line (4) by the vertical driver circuit 70B in response to the output enable signal GOER. In the second half of the outstanding cycle, image data D4 is also written into the fifth horizontal line (5) by the vertical driver circuit 70A in response to the output enable signal GOEL. It should be noted that identical image data D4 is written into two consecutive horizontal lines (4) and (5).

In the above-mentioned manner, image data forming the last (fourth) horizontal line of every four horizontal lines is written into the next horizontal line following every four horizontal line within the same cycle after writing the image data into the above last horizontal line. Thus, an enlargement ratio of 5/4 can be realized in the device which includes the CS-ON-GATE type liquid crystal panel 13.

A description will now be given of a liquid crystal display device according to a seventh embodiment of the present invention, which is based on a combination of the aforementioned fifth and sixth embodiments thereof. More particularly, the seventh embodiment of the present invention is directed to selecting either the enlargement ratio 3/2 or the enlargement ratio 5/4 by a mode signal externally supplied to the liquid crystal display device from a personal computer or the like.

Figure 36:
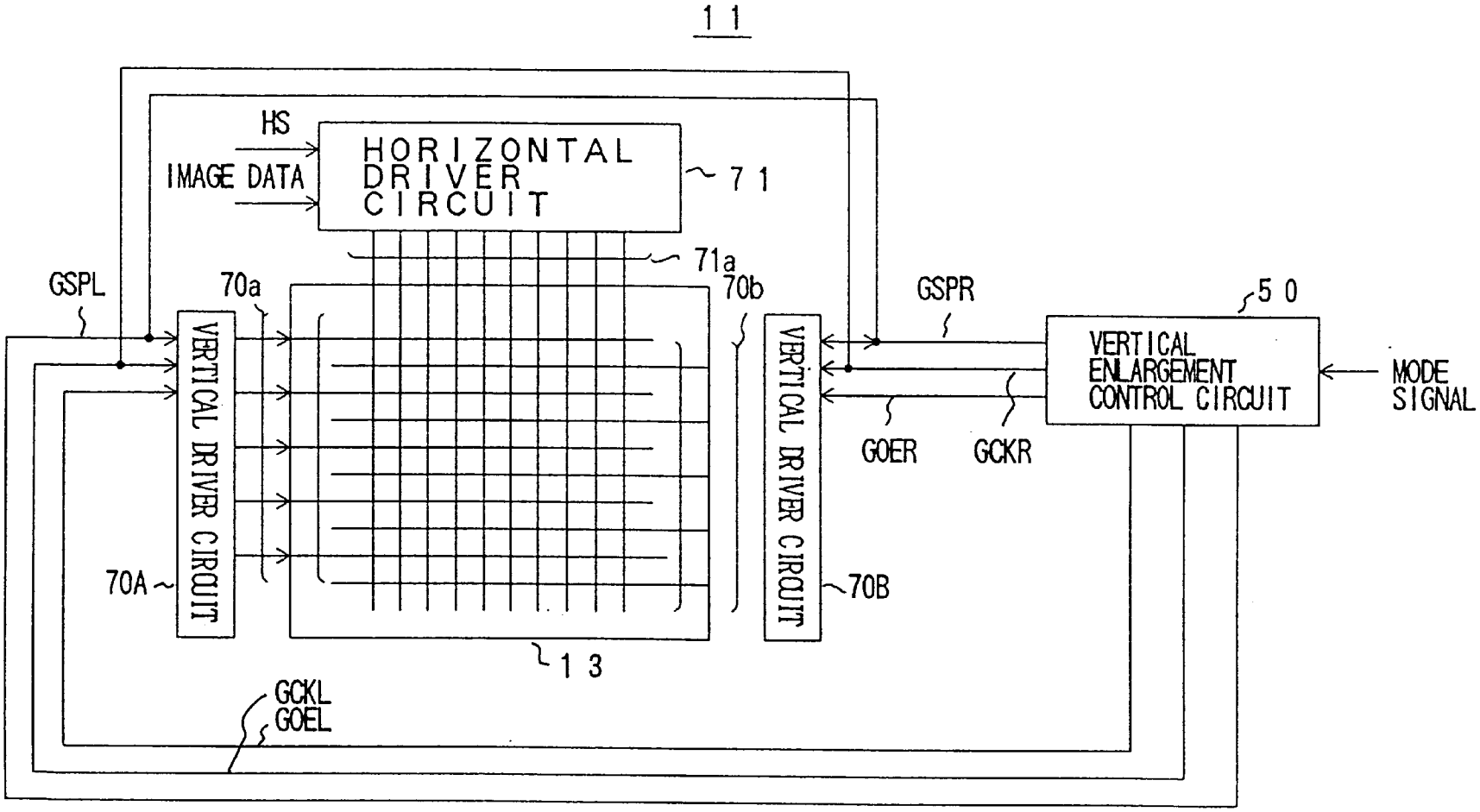
FIG. 36 is a block diagram of a liquid crystal display device according to a seventh embodiment of the present invention.

FIG. 36 is a block diagram of a liquid crystal display device according to the seventh embodiment of the present invention. In FIG. 36, parts that are the same as those shown in FIG. 27 are given the same reference numbers. The vertical enlargement control circuit 50 shown in FIG. 36 receives a mode signal externally supplied to the liquid crystal display device from the personal computer or the like. The mode signal indicates whether the enlargement ratio 3/2 or 5/4 should be selected.

Figure 37:
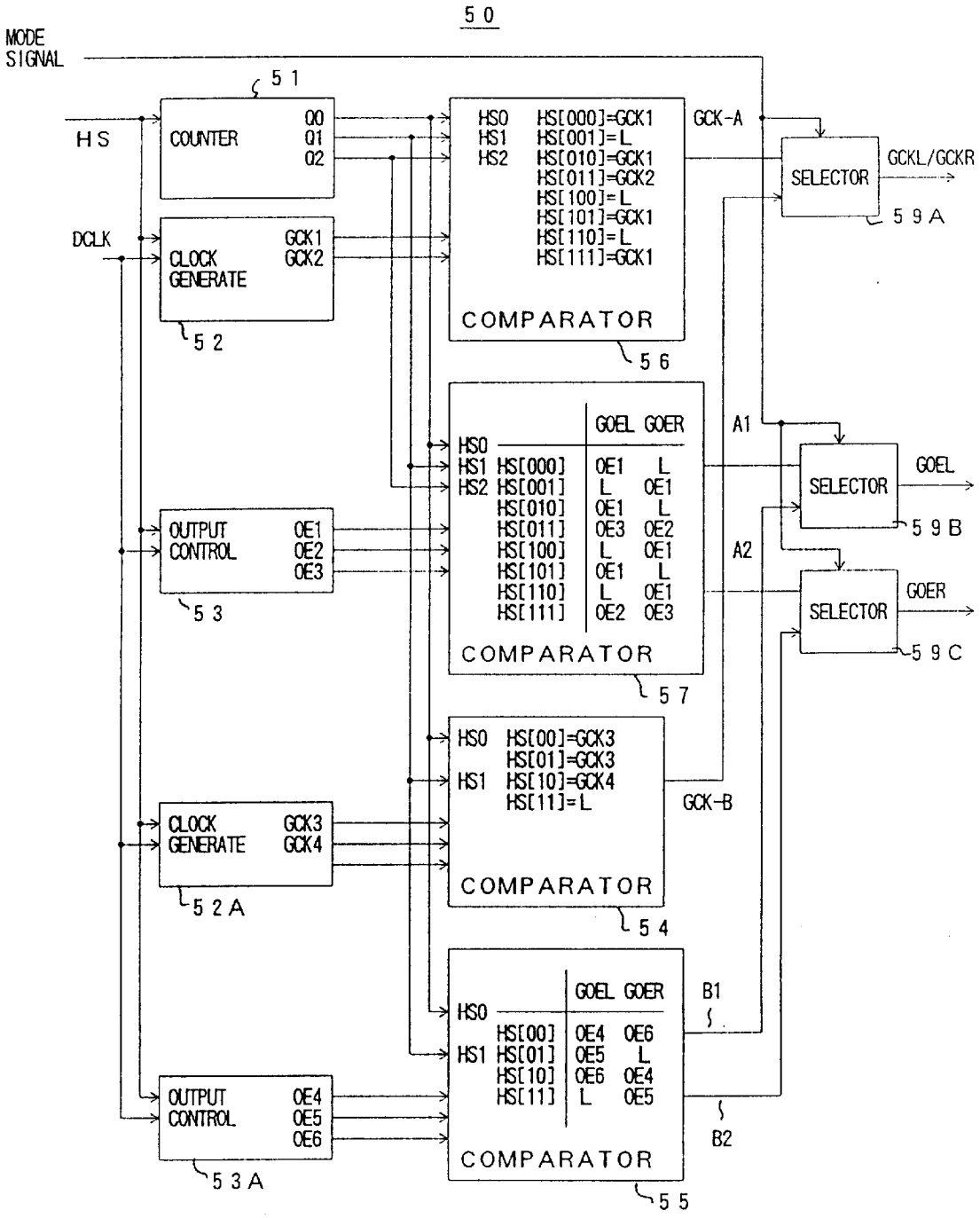
FIG. 37 is a block diagram of a vertical enlargement control circuit shown in FIG. 36.

FIG. 37 is a block diagram of the vertical enlargement control circuit 50 shown in FIG. 36. The circuit 50 includes the horizontal synchronizing signal counter 51, the clock generating circuit 52, the output control circuit 53, the fourth comparator circuit 56 and the fifth comparator circuit 57 shown in FIG. 34. Further, the vertical enlargement control circuit 50 includes all the structural elements shown in FIG. 28 other than the horizontal synchronizing signal counter 51 shown in FIG. 28. The counter 51 shown in FIG. 34 functions as the counter 51 shown in FIG. 28. The clock generating circuit 52 shown in FIG. 28 is indicated by a reference number 52A shown in FIG. 37, and the output control circuit 53 shown in FIG. 28 is indicated by a reference number 53A shown in FIG. 37. Further, the signals GCK1 and GCK2 shown in FIG. 28 are indicated as signals GCK3 and GCK4 shown in FIG. 37, and the signals OE1, OE2 and OE3 shown in FIG. 28 are indicated as signals OE4, OE5 and OE6 in FIG. 37. The output signal of the comparator circuit 54 is denoted as GCK-B, and the output signals GOEL and GOER of the comparator circuit 55 are respectively denoted as B1 and B2. Further, the output signals GOEL and GOER of the comparator circuit 57 are respectively denoted as A1 and A2.

The vertical enlargement control circuit 50 includes selectors 59A, 59B and 59C to which the mode signal is applied. When the mode signal indicates an enlargement ratio of 3/2, the selector 59A selects the comparator circuit 54, and the selector circuits 59B and 59C select the comparator circuit 55. When the mode signal indicates an enlargement ratio of 5/4, the selector 59A selects the comparator circuit 56, and the selector circuits 59B and 59C select the comparator circuit 57.

When an enlargement ratio of 3/2 is indicated by the mode signal, the selector 59A selects the signal GCK-B output from the comparator circuit 54, and the selectors 59B and 59C respectively select the signals B1 and B2 output from the comparator circuit 55. The selected signal GCK-B is applied, as signal GCKL or GCKR, to the vertical driver circuits 70A and 70B. The selected signal B1 is applied, as signal GOEL, to the vertical driver circuit 70A. The selected signal B2 is applied, as signal GOER, to the vertical driver circuit 70B.

Figure 38:
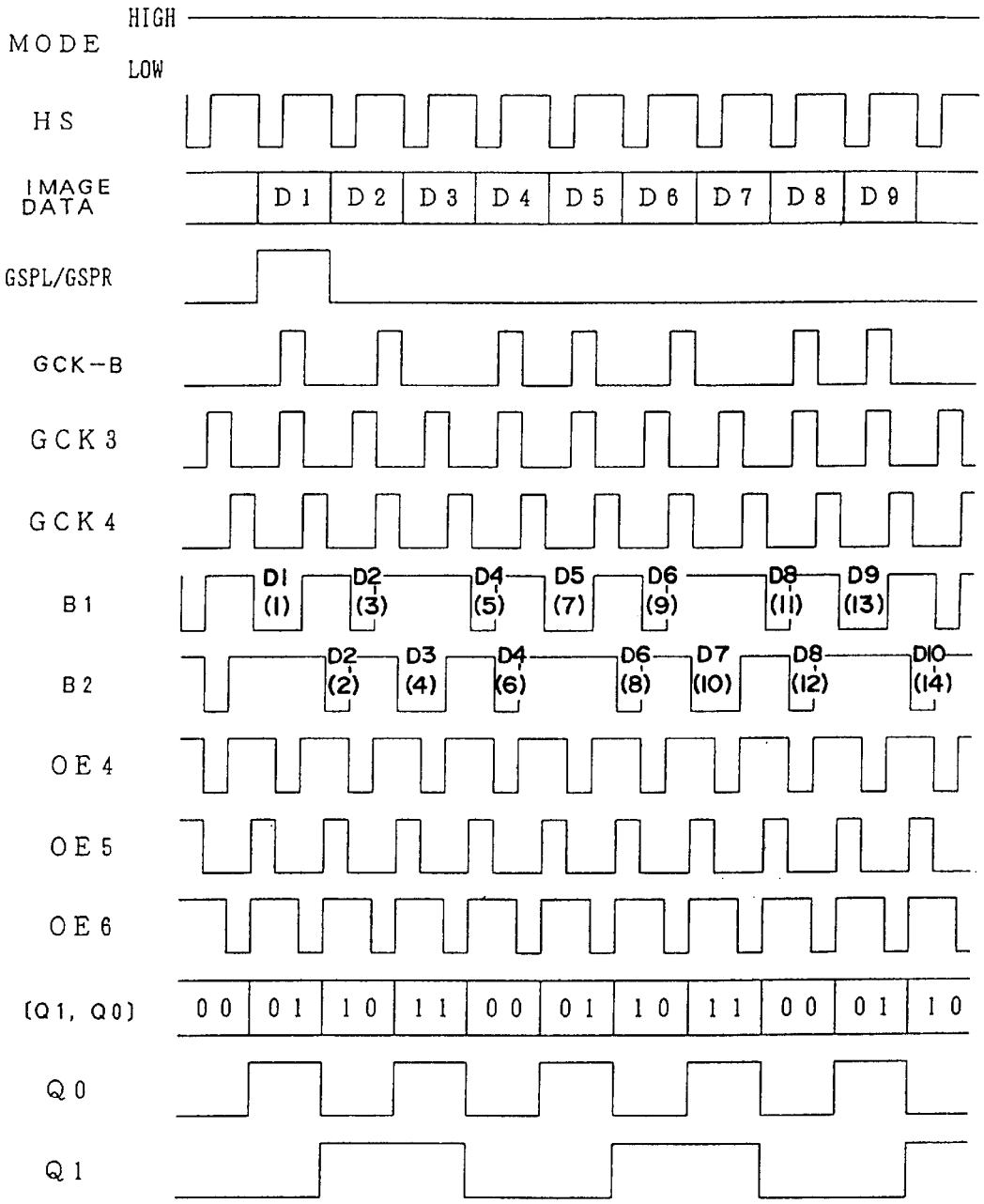
FIG. 38 is a timing chart of an operation of the vertical enlargement control circuit shown in FIG. 37 in which an image is enlarged in the vertical direction at an enlargement ratio of 3/2.

FIG. 38 is a timing chart of the operation of the liquid crystal display device shown in FIG. 36 in which the mode signal is maintained at a high level, which indicates an enlargement ratio of 3/2. The operation shown in FIG. 38 is substantially the same as that shown in FIG. 29, and a description of FIG. 38 will be omitted.

Figure 39:
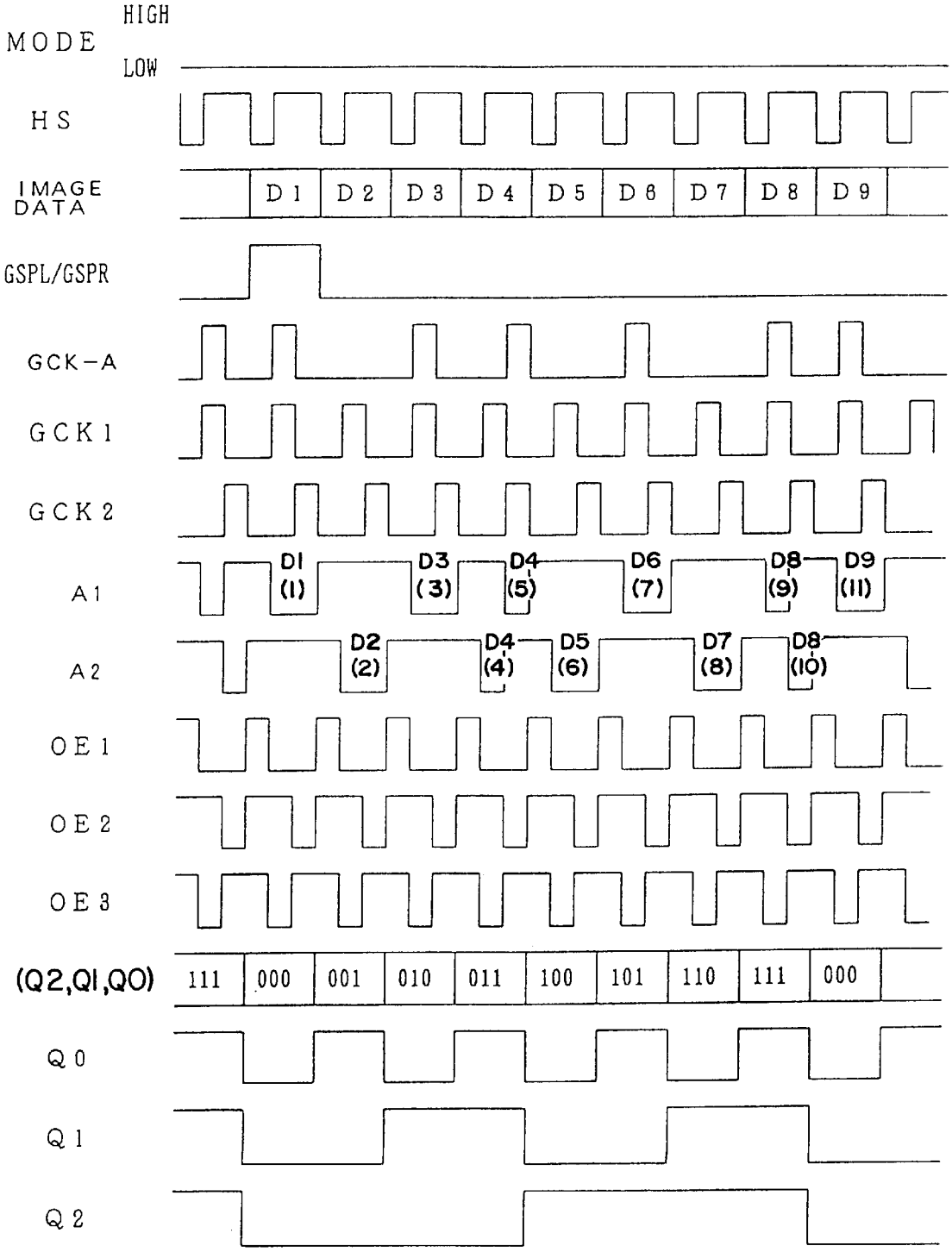
FIG. 39 is a timing chart of another operation of the vertical enlargement control circuit shown in FIG. 37 in which an image is enlarged in the vertical direction at an enlargement ratio of 5/4.

FIG. 39 is a timing chart of the operation of the liquid crystal display device shown in FIG. 36 in which the mode signal is maintained at a low level, which indicates an enlargement ratio of 5/4. The operation shown in FIG. 39 is substantially the same as that shown in FIG. 35, and a description of FIG. 39 will be omitted.

A description will now be given of a liquid crystal display device according to an eighth embodiment of the present invention. The aforementioned fifth through seventh embodiments of the present invention use two vertical driver circuits 70A and 70B. According to the eighth embodiment of the present invention, a single vertical driver circuit is used.

Figure 40:
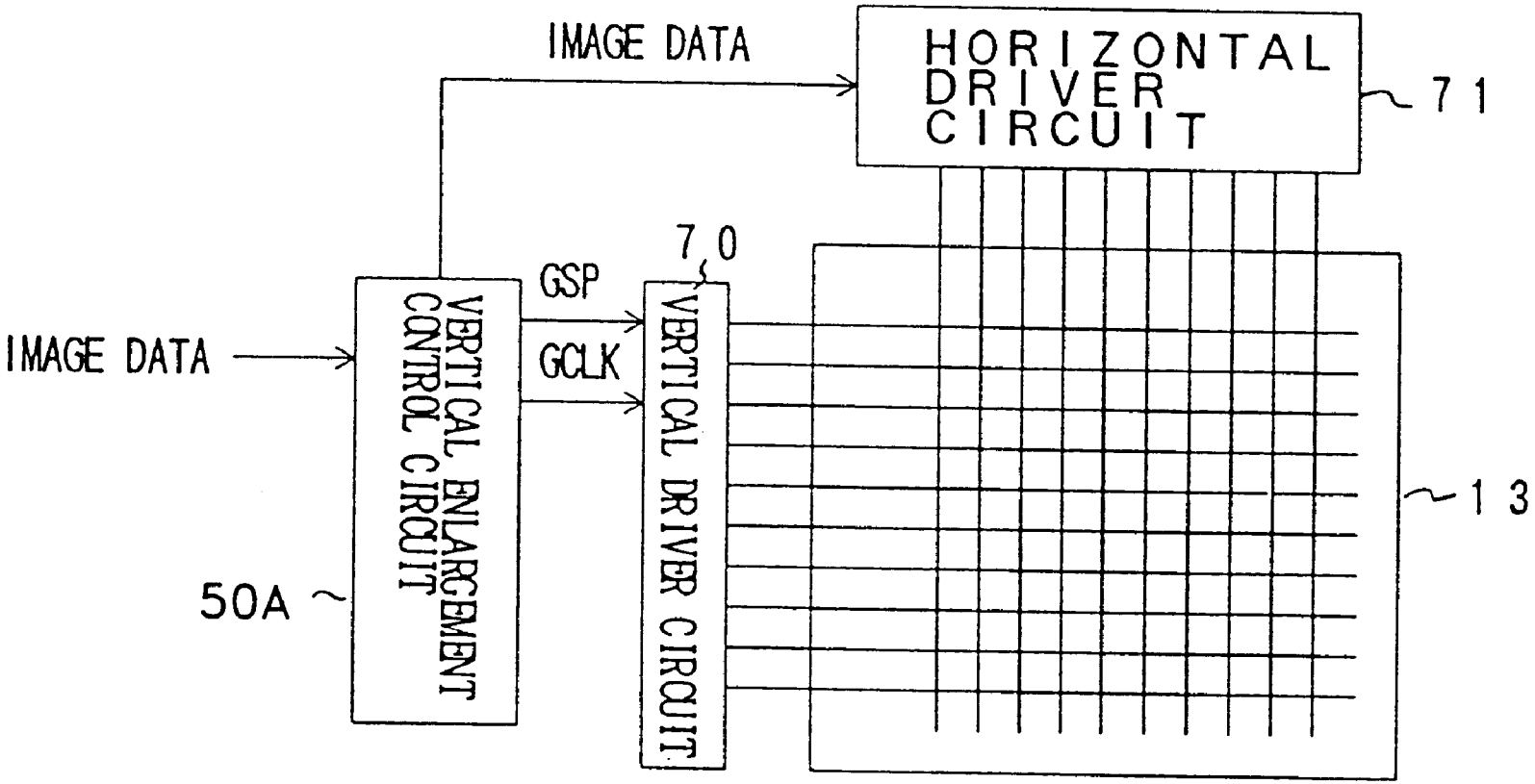
FIG. 40 is a block diagram of a liquid crystal display device according to an eight embodiment of the present invention.

FIG. 40 is a block diagram of a liquid crystal display device according to the eighth embodiment of the present invention. A single vertical driver circuit 70 is provided at the left side of the CS-ON-GATE type liquid crystal panel 13, while the horizontal driver circuit 71 is provided at the upper side of the panel 13. A vertical enlargement control circuit 50A outputs the start signal GSP and a scan clock signal GCLK to the vertical driver circuit 70.

Figure 41:
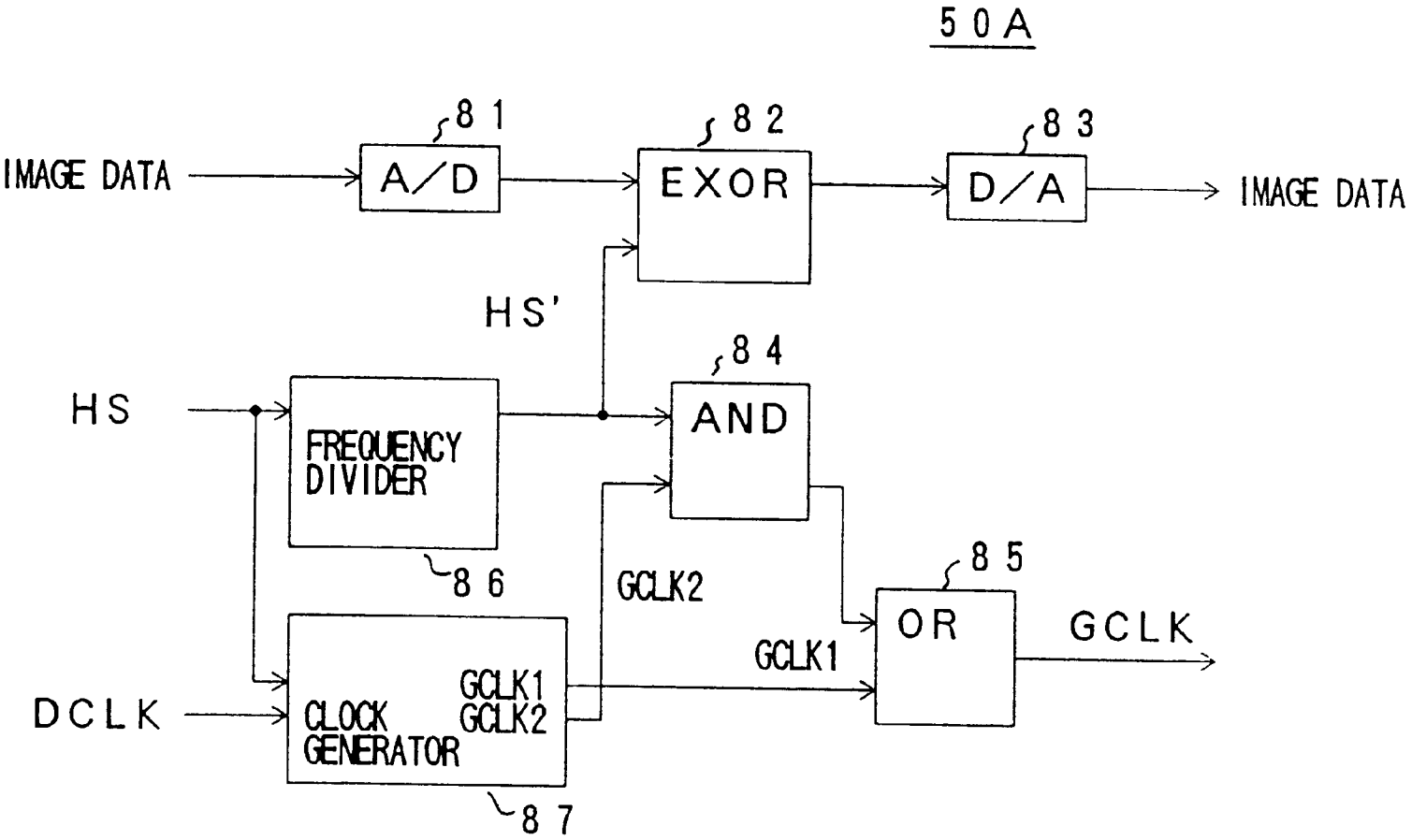
FIG. 41 is a timing chart of an operation of a vertical driver circuit shown in FIG. 40.

FIG. 41 is a block diagram of the vertical enlargement control circuit 50A, which made up of an analog-to-digital (A/D) converter 81, an exclusive-OR (EXOR) gate 82, a digital-to-analog (D/A) converter 83, an AND gate 84, an OR gate 85, a 1/2 frequency divider 86 formed of a PLL circuit, and a clock generating circuit 87.

Figure 42:
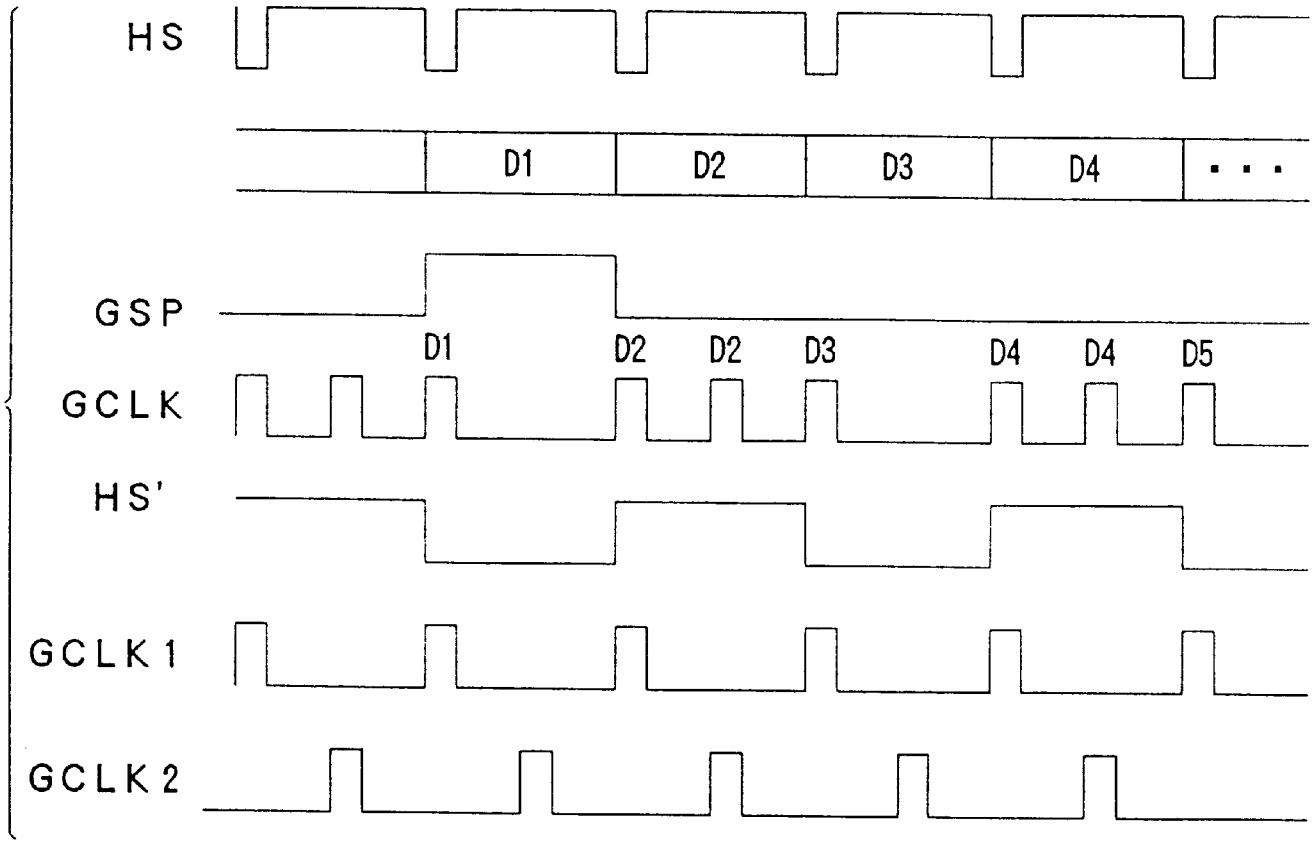
FIG. 42 is a block diagram of a vertical enlargement control circuit shown in FIG. 40.

FIG. 42 is a timing chart of the operation of the vertical enlargement control circuit 50A shown in FIG. 41. The 1/2 frequency divider 86 frequency-divides the horizontal synchronizing signal HS and produces a resultant frequency-divided synchronizing signal HS'. The signal HS' is applied to the EXOR circuit 82 and the AND gate 84. The clock generating circuit 87 produces clock signals GCLK1 and GCLK2 from the clock signal DCLK synchronized with the image data. The clock signals GCLK1 and GCLK2 have different phases. The AND gate 84 performs an AND operation on the signal HS' and the clock signal GCLK2 and outputs a resultant signal to the OR gate 85, which is supplied with the clock signal GCLK1. The OR gate 85 performs an OR operation on the output signal of the AND gate 84 and the clock signal GCLK1, and outputs a resultant signal serving as the clock signal GCLK. The image signal in analog form is converted into a digital image signal. The EXOR gate 82 performs an exclusive-OR operation on the digital image signal and the signal HS'. The result of the exclusive-OR operation is converted into an analog signal by the D/A converter 83. The above analog signal thus obtained is applied, as analog image data, to the horizontal driver circuit 71 shown in FIG. 40.

Referring to FIG. 42, the clock signal GCLK has a single pulse with respect to image data D1, and two pulses with respect to image data D2. Further, the clock signal GCLK has a single pulse with respect to image data D3, and two pulses with respect to image data D4. Hence, image data D1 is supplied to the first horizontal line in a cycle, and image data D2 is supplied to the second and third horizontal lines within the next cycle. Similarly, image data D3 is supplied to the fourth horizontal line, and image data D4 is supplied to the fifth and sixth horizontal lines within the same cycle. Hence, an image can be enlarged in the vertical direction at an enlargement ratio of 3/2. Since two adjacent horizontal lines are not simultaneously driven, identical image data can be written on two adjacent horizontal lines within the same cycle.

The enlargement of images in the horizontal direction is realized by the configuration shown in FIGS. 31, 32 and 33. The following description is mainly directed to other configurations which realize the enlargement of images in the horizontal direction.

Figure 43A:
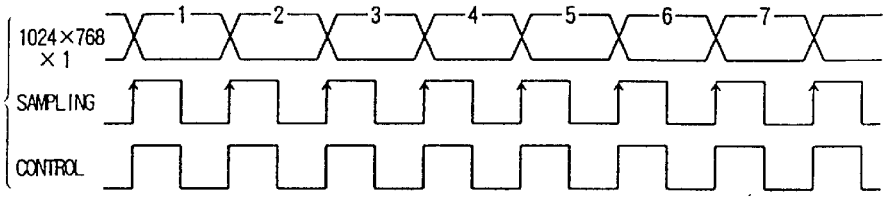
FIGS. 43A, 43B and 43C are respectively timing charts of the principle of a liquid crystal display device according to a ninth embodiment of the present invention.

FIG. 43A is a timing chart of a panel driving operation of the 1024×768 panel. Image data 1, 2, . . . , of the XGA format is sampled by a sampling clock signal. FIG. 43A also shows a clock signal (which is also referred to as a control clock signal) synchronized with image data (each pixel).

Figure 43B:
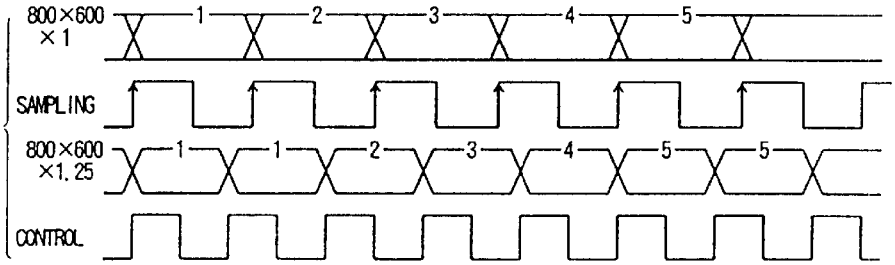

FIG. 43B is a timing chart of a panel driving operation of the 1024×768 panel in which image data of the SVGA format (800×600) is enlarged in the horizontal direction at an enlargement ratio of 5/4 (=1.25) and is displayed on the 1024×768 panel. In this case, one piece of image data (one pixel) among four consecutive pieces of image data (four pixels) is serially written into two consecutive vertical lines (data bus lines). For example, image data 1 which is one of image data 1, 2, 3 and 4 is supplied to two consecutive vertical lines.

Figure 43C:
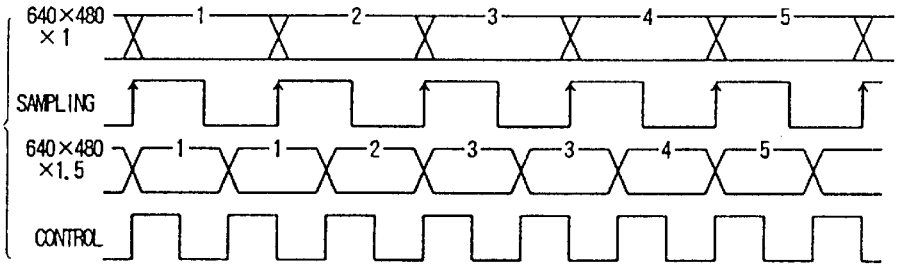

FIG. 43C is a timing chart of a panel driving operation of the 1024×768 panel in which image data of the VGA format (640×480) is enlarged in the horizontal direction at an enlargement ratio of 3/2 (=1.5) and is displayed on the 1024×768 panel. In this case, one piece of image data (one pixel) among two consecutive pieces of image data (two pixels) is serially written into two consecutive vertical lines. For example, image data 1 which is one of image data 1 and 2 is supplied to two consecutive vertical lines, and image data 3 which is one of image data 3 and 4 is supplied to two consecutive vertical lines.

As shown in FIGS. 43B and 43C, image data sampled by the sampling clock (corresponding to a sampling clock CLK1 which will be described later) is synchronized with the image signal. The sampled image (one pixel) is serially displayed twice every predetermined number of pixels in synchronism with the control clock (corresponding to a control clock CLK2 which will be described later) having a frequency which matches the number of pixels forming the panel.

Figure 44:
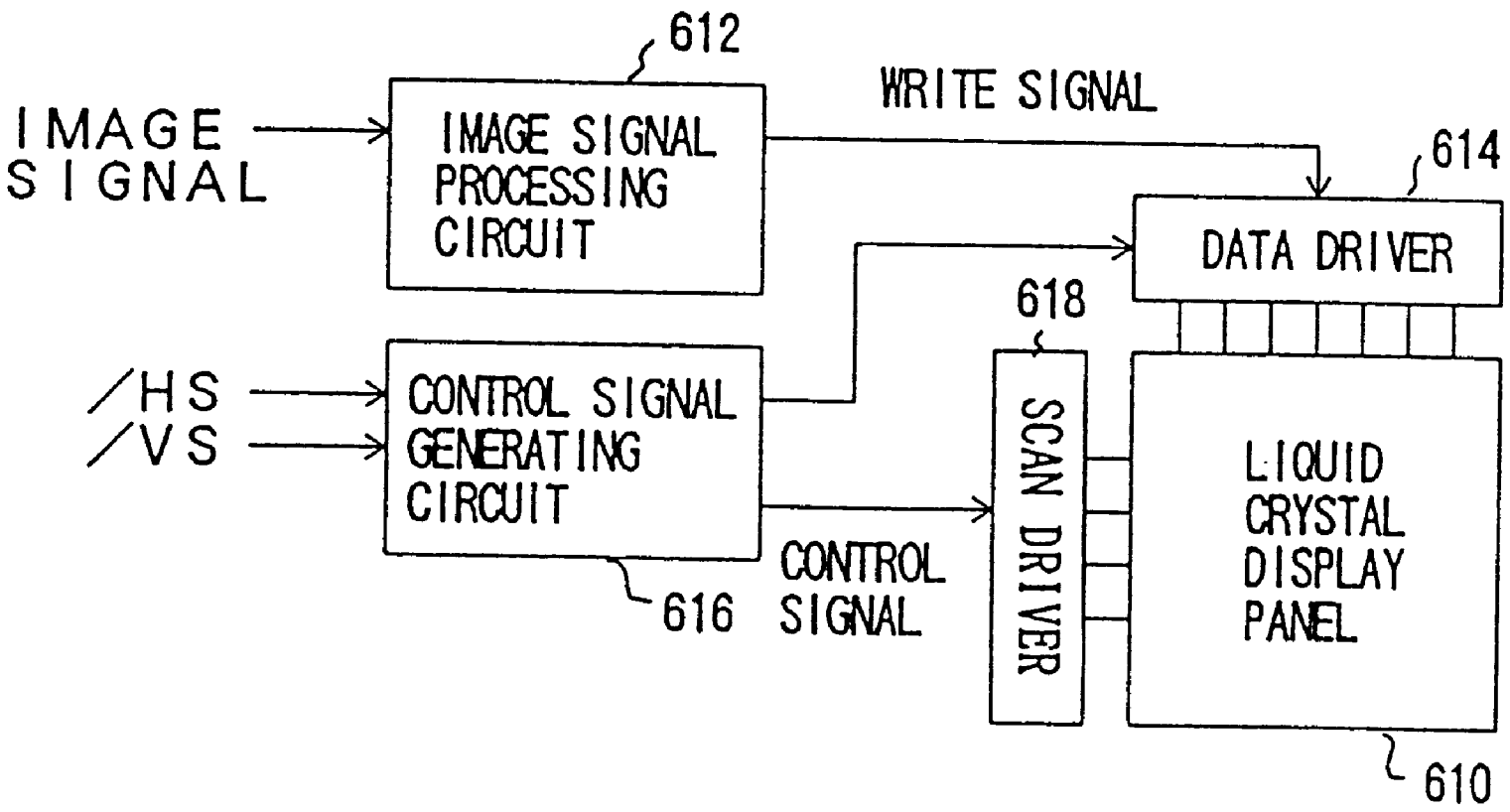
FIG. 44 is a block diagram of a liquid crystal display device according to the ninth embodiment of the present invention.

FIG. 44 is a block diagram of a liquid crystal display device according to a ninth embodiment of the present invention. The liquid crystal display device shown in FIG. 44 includes a liquid crystal display panel 610, an image signal processing circuit 612, a data driver (horizontal driver circuit) 614, a control signal generating circuit 616, and a scan driver (vertical driver circuit) 618.

The image signal processing circuit 612 receives an image signal from a personal computer, a workstation or the like, and performs a signal process which will be described later. Then, the image signal processing circuit 612 outputs a write signal. The control signal generating circuit 616 receives a horizontal synchronizing signal /HS and a vertical synchronizing signal /VS, and performs a signal process which will be described later. Then, the control signal generating circuit 616 generates a control signal for controlling the image signal processing circuit 612 and control signals for controlling the data driver 614 and the scan driver 618. The data driver 614 latches the write signal amounting to one horizontal line supplied from the image signal processing circuit 612, and outputs the latched write signal to the liquid crystal display panel 610 in accordance with the control signal from the control signal generating circuit 616. The scan driver 618 serially scans the horizontal lines one by one in synchronism with the control signal from the control signal generating circuit 618. The liquid crystal display panel 610 has a 1024×768 configuration. The panel 610 can be of the CS-ON-GATE type or another type.

Figure 45:
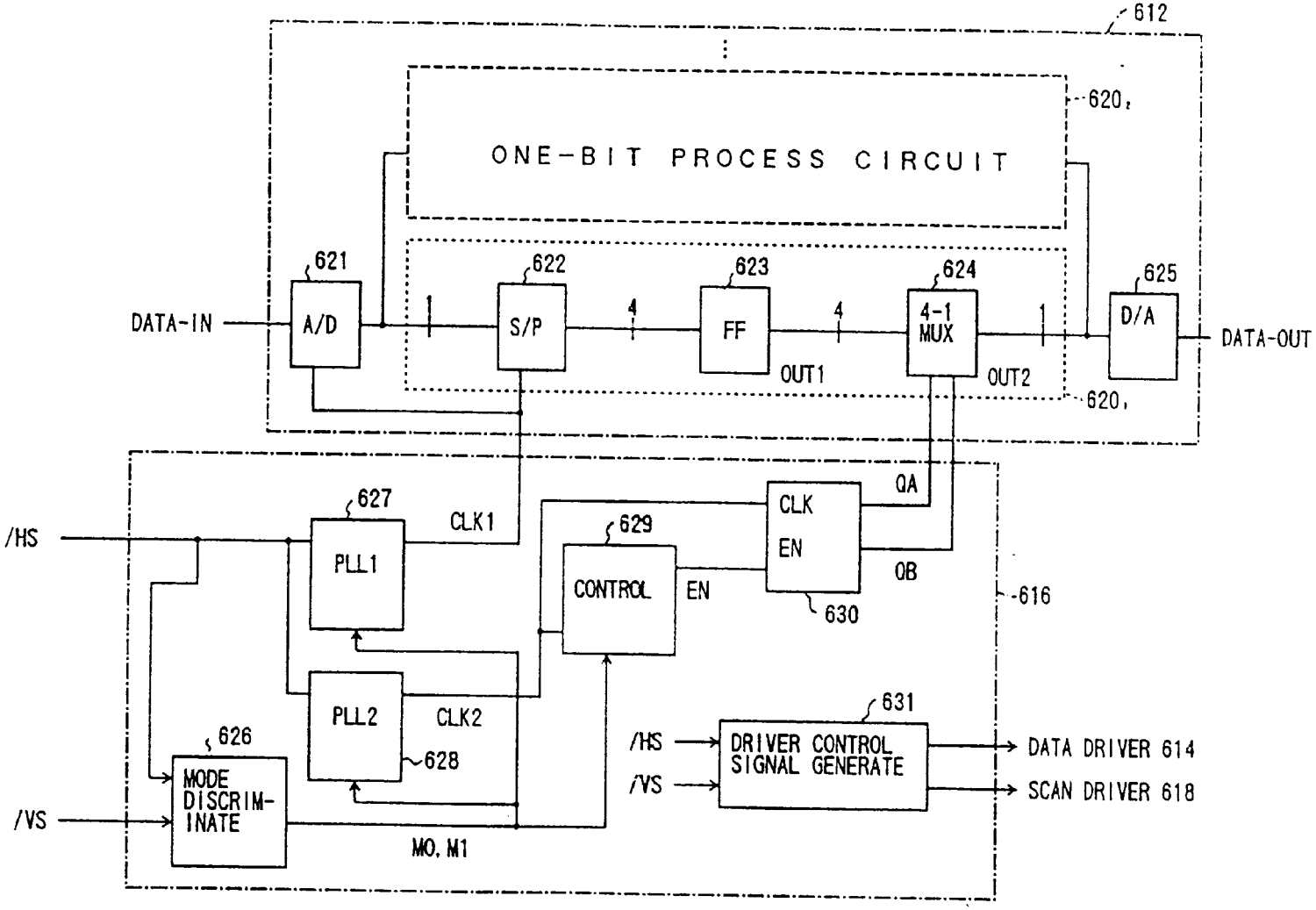
FIG. 45 is a block diagram of an image signal processing circuit and a control signal generating circuit shown in FIG. 44.

FIG. 45 is a block diagram of the image signal processing circuit 612 and the control signal generating circuit 616. The image signal processing circuit 612 is made up of an A/D converter 621, a plurality of one-bit process circuits including $\mathbf{620}_1$ and $\mathbf{620}_2$, and a D/A converter 625. When the input image signal DATA-IN applied to the A/D converter 621 consists of n bits (n is an integer), n identical one-bit process circuits $\mathbf{620}_1$–$\mathbf{620}_n$ are provided in the image signal processing circuit 612.

The A/D converter 621 converts the analog image signal DATA-IN into n-bit digital signals, which are supplied to the respective one-bit process circuits $\mathbf{620}_1$–$\mathbf{620}_n$. The sampling timing of the A/D converter 621 is defined by a control signal produced by the control signal generating circuit 616.

The one-bit process circuit $\mathbf{620}_1$ includes a serial-to-parallel converter (S/P) 622, a latch circuit (FF) 623, and a multiplexer circuit (MUX) 624. The S/P converter 622 serially inputs four one-bit image data (four one-bit pixel data) and outputs a four-bit parallel data. The timing of the above S/P converting process is indicated by a control signal produced by the control signal generating circuit 616. The latch circuit 623 latches the parallel data output by the s/P converter 622. The multiplexer circuit 624 sequentially selects one of the four-bit parallel data, and supplies the selected one-bit data to the D/A converter 625. The selecting operation of the multiplexer circuit 624 is defined by a control signal from the control signal generating circuit 616. The D/A converter 625 converts n-bit pixel data received from the n one-bit process circuits $\mathbf{620}_1$–$\mathbf{620}_n$ into an analog signal, which is output as a write signal DATA-OUT to the data driver 614.

The control signal generating circuit 616 includes a display mode discrimination circuit 626 formed of a microcomputer or the like, a first PLL circuit (PLL1) 627, a second PLL circuit (PLL2) 628, an enable control circuit 629, a counter circuit 630, and a driver control signal generating circuit 631. The control signal generating circuit 616 is commonly provided to the n one-bit process circuits $\mathbf{620}_1$–$\mathbf{620}_n$.

The display mode discrimination circuit 626 inputs the horizontal synchronizing signal /HS and the vertical synchronizing signal /VS, and identifies the display mode indicated by pulses included in these synchronizing signals. FIG. 46 is a diagram showing the relation between the display mode and the periods of the horizontal and vertical synchronizing signals. The display mode discrimination circuit 626 outputs the mode signal consisting of two bits M0 and M1. An example of the relation between the bits M0 and M1 and the display mode is as follows:

| | |
|---|---|
| M0 = 1, M1 = 1 | XGA mode |
| M0 = 0, M1 = 1 | SVGA mode |
| M0 = 1, M1 = 0 | VGA mode |
| M0 = 0, M1 = 0 | VGA mode. |

The mode bits M0 and M1 are supplied to the PLL circuits 627 and 628 and the enable control circuit 629.

The first PLL circuit 627 inputs the horizontal synchronizing signal /HS and produces therefrom the first clock signal CLK1 synchronized with the input image signal DATA-IN.

Figure 47:
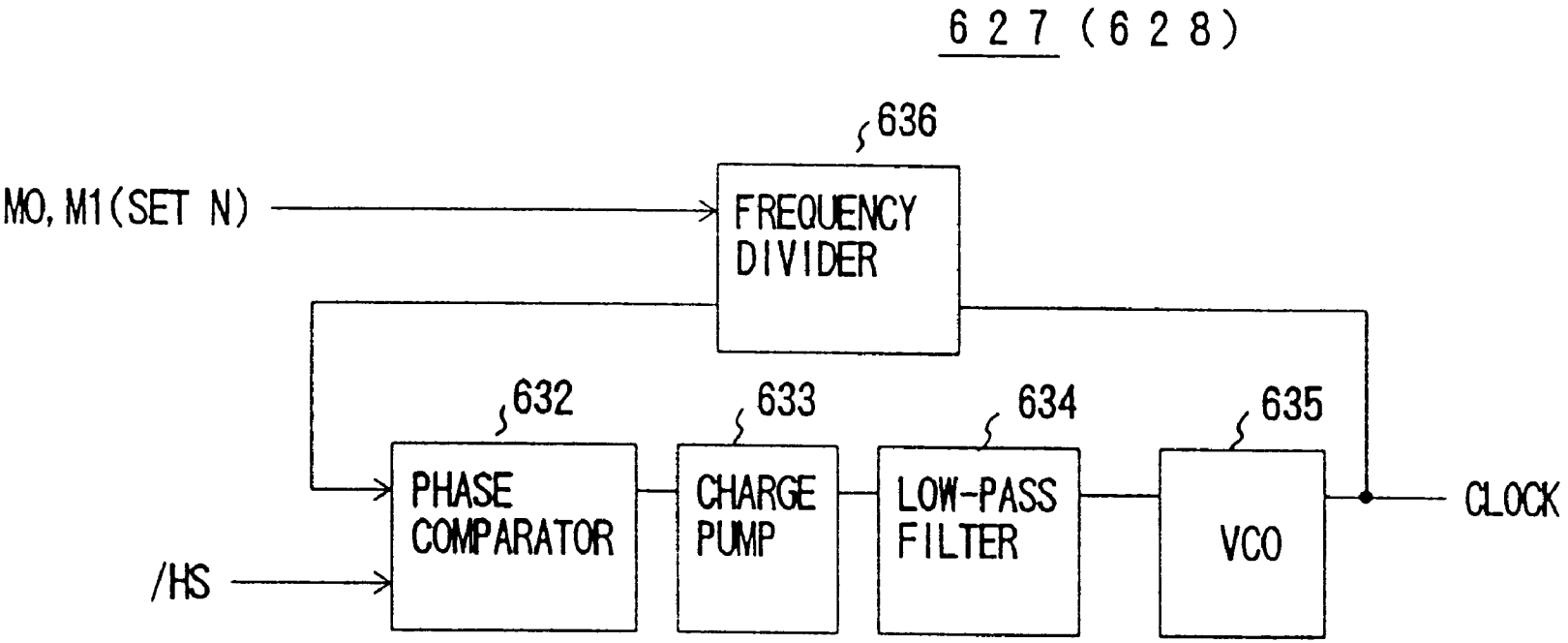
FIG. 47 is a block diagram of first and second PLL circuits shown in FIG. 45.

FIG. 47 is a block diagram of the first PLL circuit 627. The second PLL circuit 628 is configured as shown in FIG. 47. The first PLL circuit 627 is made up of a phase comparator 632, a charge pump 633, a low-pass filter 634, a voltage-controlled oscillator (VCO) 635, and a frequency divider 636 having a frequency dividing ratio N determined by the values of the mode bits M0 and M1. Hence, the frequency dividing ratio can be selected (varied) on the basis of the display mode. The frequency divider 636 divides the frequency of the output signal of the VCO 635 at the frequency dividing ratio N indicated by the mode bits M0 and M1, and outputs the frequency-divided signal to the phase comparator 632. The phase comparator 632 compares the phase of the output signal of the frequency divider 636 with the phase of the horizontal synchronizing signal /HS, and outputs a voltage signal based on the phase difference therebetween. The voltage signal is integrated by the charge pump 633, and the output voltage thereof is applied to the VCO 635 via the low-pass filter 634.

The second PLL circuit 628 inputs the horizontal synchronizing signal /HS, and produces the second clock signal CLK2 based on the number of pixels of the liquid crystal display panel 610. The frequency of the second clock signal CLK2 can be varied based on the display mode. The second clock signal CLK2 is applied to the enable control circuit 629 and the counter circuit 630.

The enable control circuit 629 shown in FIG. 45 inputs the second clock signal CLK2, and outputs an enable signal EN based on the values of the mode bits M0 and M1 to an enable terminal EN of the counter circuit 630. As will be described later, when the enlargement ratio is equal to 1, the enable signal EN is fixed at a first predetermined level (for example, a high level), so that the counter circuit 630 is maintained in the enable state. When the enlargement ratio is equal to a value other than 1, such as 1.25 or 1.5, the second clock signal CLK2 is switched to a second predetermined level (for example, a low level), so that the counter circuit 630 is maintained in the disabled state in which the counter circuit 630 does not perform the count operation.

When the counter circuit 630 is maintained in the enabled state, it counts the second clock signal CLK2 and outputs a two-bit counter value (control signal) consisting of QA and QB. The signal QA changes at a speed equal to twice that of the signal QB. Since the multiplexer circuit 624 multiplexes four bits, the two control signals QA and QB are needed.

The driver control signal generating circuit 631 inputs the horizontal synchronizing signal /HS and the vertical synchronizing signal /VS, and outputs driver control signals used to control the data driver 614 and the scan driver 618. The driver control signal generating circuit 631 itself is known and is not directly related to the enlargement process of the present invention. Hence, a detailed description of the circuit 631 will be omitted here.

Figure 48:
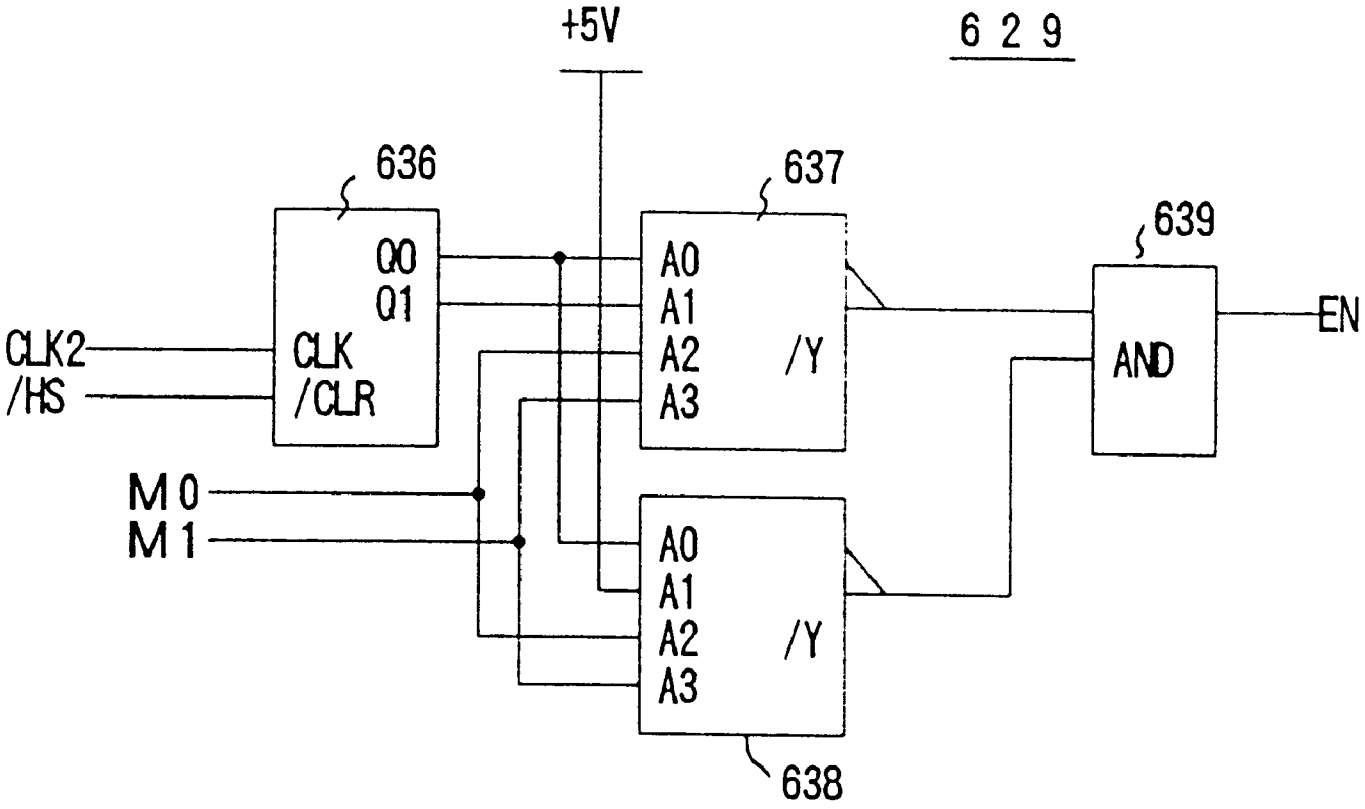
FIG. 48 is a block diagram of a control circuit shown in FIG. 45.

FIG. 48 is a block diagram of the enable control circuit 629. The enable control circuit 629 shown in FIG. 48 includes a two-bit counter 636, decoders 637 and 638, and an AND gate 639. The two-bit counter 636 counts the second clock signal CLK2 and outputs a counter value consisting of Q0 and Q1. The two-bit counter 636 is cleared by the horizontal synchronizing signal /HS. The output signal Q0 is applied to input terminals A0 of the decoders 637 and 638. The output signal Q1 is applied to an input terminal A1 of the decoder 637. The input terminal A1 of the decoder 638 is fixed to a power supply voltage of +5 V. The mode bit M0 is applied to input terminals A2 of the decoders 637 and 638, and the mode bit M1 is applied to input terminals A3 of the decoders 637 and 638. Output signals /Y of the decoders 637 and 638 are applied to the AND gate 639, an output signal of which serves as the enable signal EN.

When M0=M1=1, that is, when the XGA mode is indicated, the decoders 637 and 638 output a value of 1 irrespective of the output signal of the counter 636. When M0=0, and M1=1, that is, when the SVGA mod is indicated, the decoders 637 and 638 sets their output signals /Y to zero each time the counter value of the counter 636 reaches 4. In this case, the enable signal EN is changed to 0 every four bits.

Figure 49A:
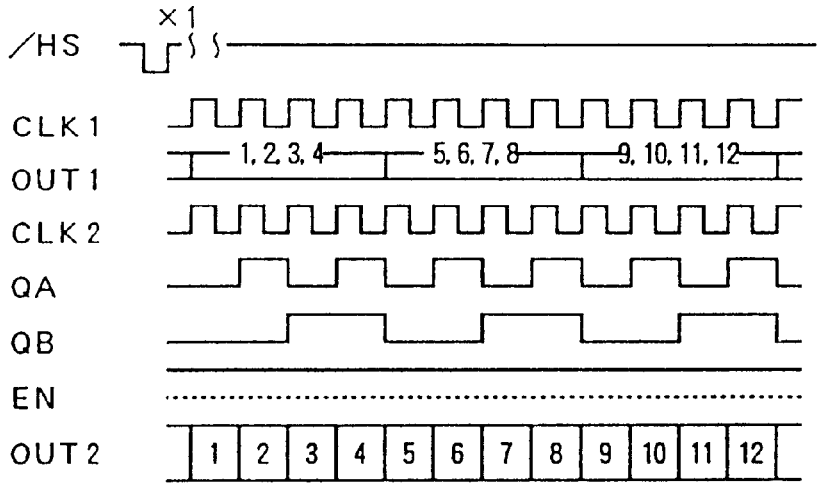
FIGS. 49A, 49B and 49C are respectively timing charts of operations of the ninth embodiment of the present invention.
Figure 49B:
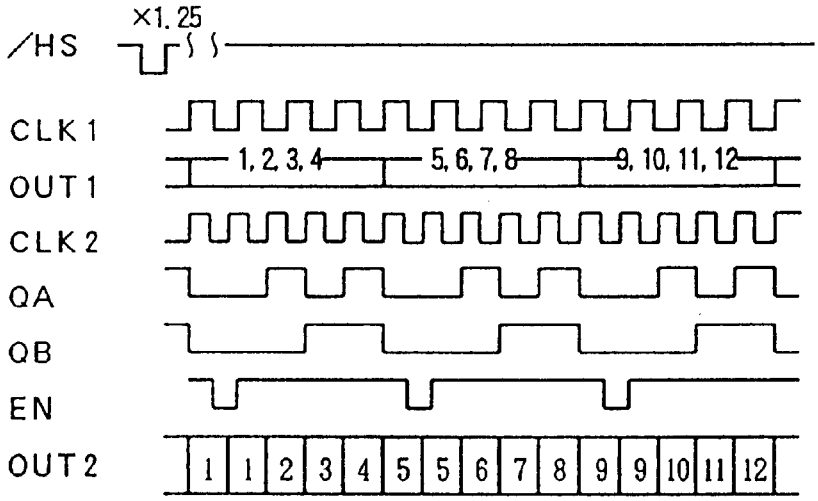
Figure 49C:
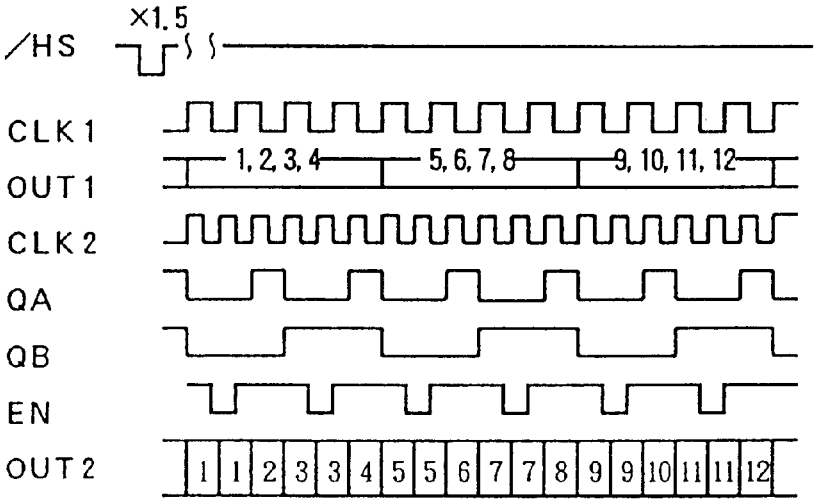

FIGS. 49A, 49B and 49C are timing charts of an operation of the liquid crystal display device according to the ninth embodiment of the present invention. FIG. 49A shows an operation carried out when the enlargement ratio is equal to 1 (XGA). FIG. 49B shows an operation carried out when the enlargement ratio is equal to 1.25 (SVGA). FIG. 49C shows an operation carried out when the enlargement ratio is equal to 1.5 (VGA).

In the case shown in FIG. 49A in which the mode bits M0 and M1 are both 1, the enable signal EN output by the enable control circuit 629 is maintained at 1. Hence, the counter 630 continues to operate, and the multiplexer circuit 624 output sequentially the image signal OUT1 output from the latch circuit 623 one bit by one bit (OUT2).

In the case shown in FIG. 49B in which M0=0 and M1=1, the enable signal EN output by the enable control circuit 629 is switched to the low level (0) each time the second clock CLK2 is counted four times. In response to the above switching, the counter 630 stops operating, and the multiplexer circuit 624 continues to select the same data as previously. For example, in the output OUT2 shown in FIG. 49B, data 1, 5 and 9 are successively output two times. Hence, an image of the SVGA mode (800×600) can be enlarged in the vertical direction at an enlargement ratio of 5/4 (=1.25) and can be displayed on the XGA panel 610.

In the case shown in FIG. 49C in which M0=0 (or 1) and M1=0, the enable signal EN output by the enable control circuit 629 is switched to the low level (0) each time the second clock signal CLK2 is counted two times. In response to the above switching, the counter 630 stops operating, and the multiplexer circuit 624 continues to select the same data as previously. For example, in the output OUT2 shown in FIG. 49C, data 1, 3, 5, 7, 9 and 11 are successively output two times. Hence, an image of the VGA mode (640×480) can be enlarged in the vertical direction at an enlargement ratio of 3/2 (=1.5) and can be displayed on the XGA panel 610.

It should be noted that if the S/P converter 622, the latch circuit 623 and the multiplexer circuit 624 of each of the one-bit process circuit $\mathbf{620}_1$–$\mathbf{620}_n$ are respectively formed of eight-bit configuration circuits, it is possible to realize an enlargement ratio of 1.125 (=9/8). That is, an arbitrary enlargement ratio can be realized by selecting the number of bits processed in each of the one-bit process circuits $\mathbf{620}_1$–$\mathbf{620}_n$.

A description will now be given of a liquid crystal display device according to a tenth embodiment of the present invention.

Figure 50:
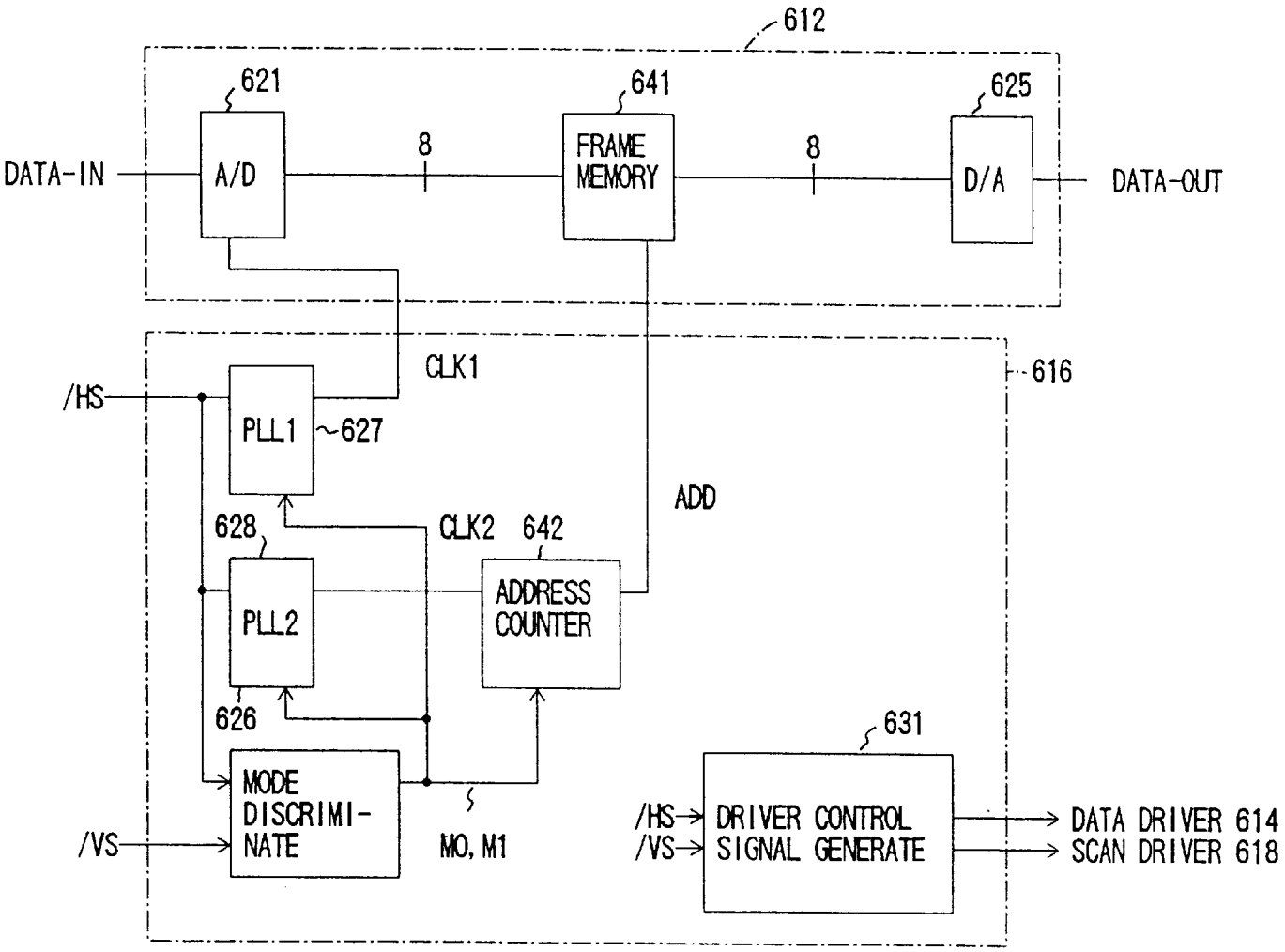
FIG. 50 is a block diagram of an image signal processing circuit and a control signal generating circuit used in a liquid crystal display device according to a tenth embodiment of the present invention.

FIG. 50 is a block diagram of the structures of the image signal processing circuit 612 and the control signal generating circuit 616 used in the tenth embodiment of the present invention. In FIG. 50, parts that are the same as those in the previously described figures are given the same reference numbers. The image signal processing circuit 612 shown in FIG. 50 includes a frame memory 641, which stores eight-bit image data output from the A/D converter 621. The frame memory 641 has a capacity of one picture plane. The D/A converter 625 converts image data read from the frame memory 641 every eight bits into an analog image signal, which serves as the write signal DATA-OUT.

The control signal generating circuit 616 includes an address counter 642 in addition to the aforementioned display mode discrimination circuit 626, first PLL circuit 627, second PLL circuit 628 and driver control signal generating circuit 631. The address counter 642 inputs the second clock signal CLK2 and mode bits M0 and M1, and produces therefrom an address ADD.

According to the tenth embodiment of the present invention, the A/D conversion and the write operation of the frame memory 641 are carried out in synchronism with the first clock signal CLK1 synchronized with the image signal. The read operation of the frame memory 641 is carried out in synchronism with the clock signal CLK2 dependent on the enlargement ratio indicated by the mode bits M0 and M1. The frame memory 641 is formed of, for example, a two-port memory, and the address ADD output by the address counter 642 is a read address ADD. A write address of the frame memory 641 can be produced by counting the first clock signal CLK1 by an address counter.

Figures 51A, 51B, 51C, 51D:
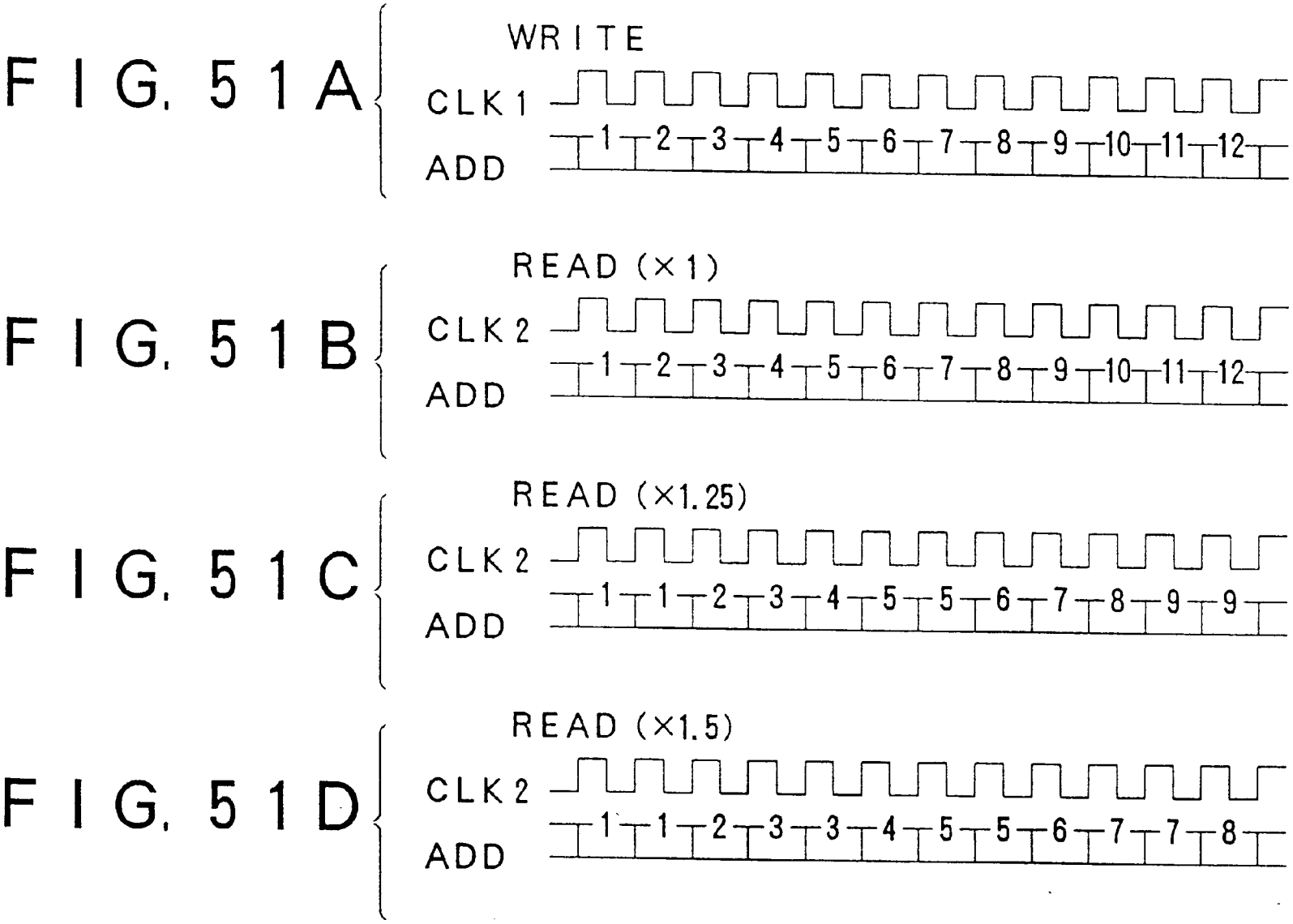
FIGS. 51A, 51B, 51C and 51D are respectively timing charts of operations of the tenth embodiment of the present invention.

FIGS. 51A, 51B, 51C and 51D are timing charts of an operation of the tenth embodiment of the present invention. FIG. 51A shows an operation in which image data is written into the frame memory 641. The address output by the address counter for writing in synchronism with the first clock signal CLK1 is sequentially incremented one by one.

FIG. 51B shows a read operation carried out when the enlargement ratio is equal to 1. The address ADD output by the address counter 642 is sequentially incremented one by one. The image data written into the frame memory 641 is read every eight bits.

FIG. 51C shows a read operation carried out when the enlargement ratio is equal to 1.25. The address ADD output by the address counter 642 is generated so that an identical address value is successively output twice each time four pulses of the second clock signal CLK2 are counted. In the case shown in FIG. 51C, address values 1, 5 and 9 are successively output twice. Hence, identical eight-bit image data is successively output twice every four pulses of the second clock signal CLK2.

FIG. 51D shows a read operation carried out when the enlargement ratio is equal to 1.5. The address ADD output by the address counter 642 is generated so that an identical address value is successively output twice each time two clocks of the second clock signal CLK2 are counted. In the case shown in FIG. 51D, address values 1, 3, 5 and 7 are successively output twice every two pulses of the second clock signal CLK2.

In the above-mentioned manner, the image can be enlarged in the horizontal direction by the clock signal CLK2 and the read address control of the frame memory 641.

Figure 52:
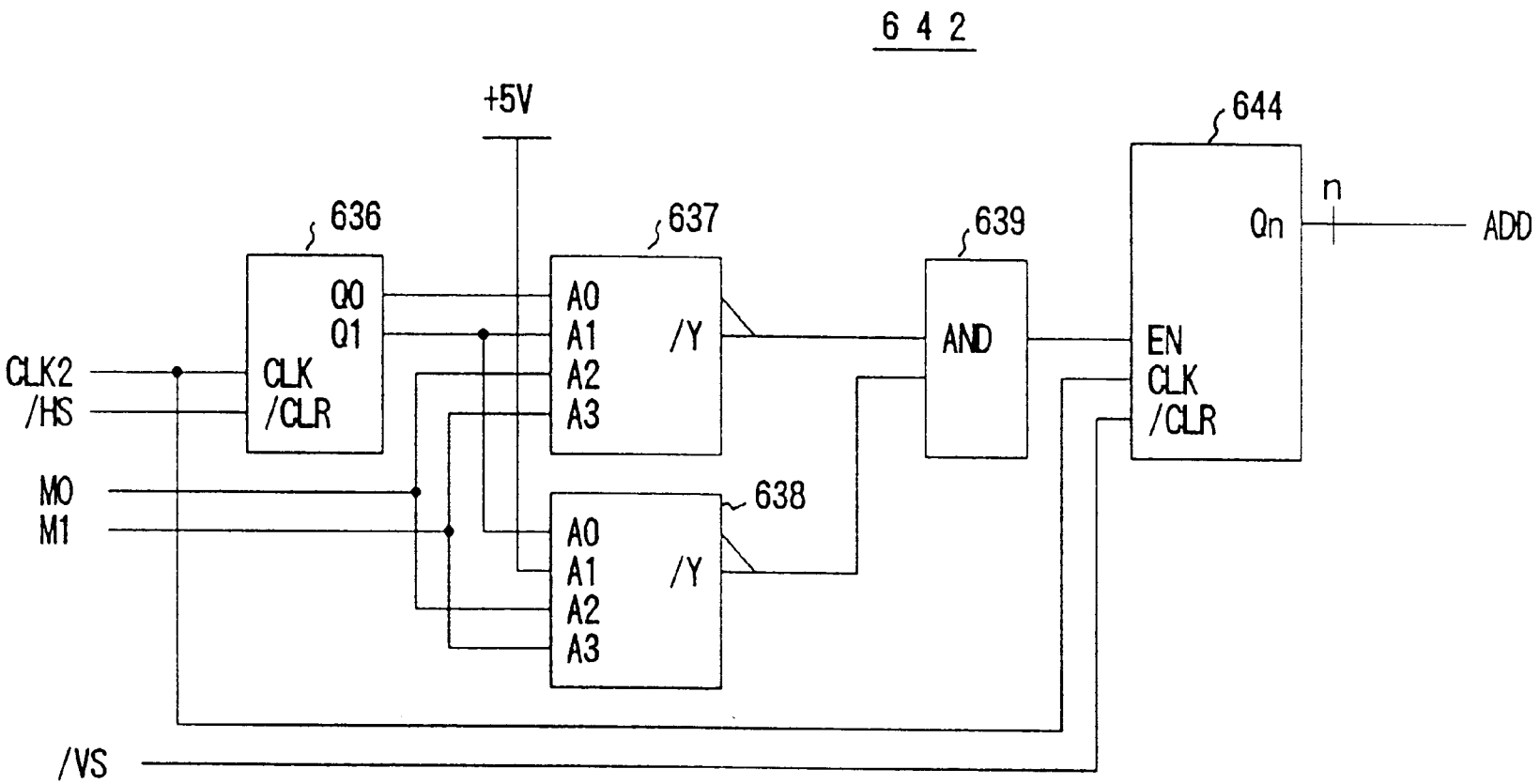
FIG. 52 is a block diagram of an address counter shown in FIG. 50.

FIG. 52 is a block diagram of the address counter 642 shown in FIG. 50. In FIG. 52, parts that are the same as those in the figures described previously are given the same reference numbers. The structure shown in FIG. 52 can substantially be formed by adding a counter 644 to the configuration shown in FIG. 48. The input signals of the decoders 637 and 638 shown in FIG. 52 are slightly different from those shown in FIG. 48. The counter 644 counts the second clock signal CLK2 while it is maintained in the enabled state by the enable signal EN, and is cleared in response to the vertical synchronizing signal /VS. The enable signal EN is generated in the aforementioned manner. Hence, the counter 644 stops counting each time the second clock signal CLK2 is counted four times when the enlargement ratio is 1.25. Alternatively, the counter 644 stops counting each time the second clock signal CLK2 is counted two times when the enlargement ratio is 1.5.

Figure 53:
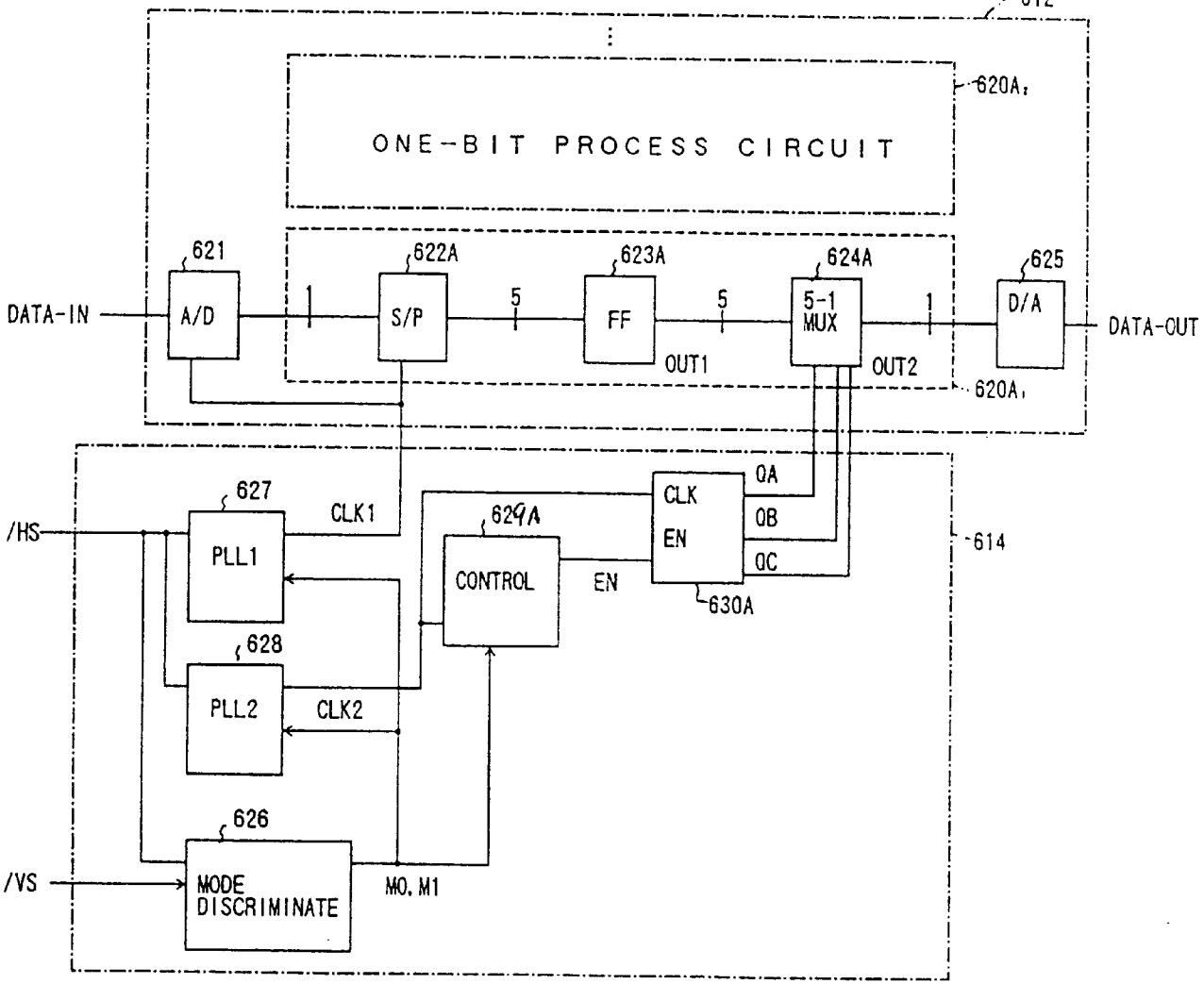
FIG. 53 is a block diagram of an image signal processing circuit and a control signal generating circuit used in a liquid crystal display device according to an eleventh embodiment of the present invention.

A description will now be given of a liquid crystal display device according to an eleventh embodiment of the present invention, which is directed to realizing an enlargement ratio of 1.2. FIG. 53 is a block diagram of the structures of the image signal processing circuit 612 and the control signal generating circuit 616 used in the eleventh embodiment of the present invention.

In order to realize an enlargement ratio of 1.2, each of the one-bit process circuits 620$A_1$–620$A_n$ of the image signal processing circuit 612 includes a five-bit S/P converter 622A, a five-bit latch circuit 623A and a five-bit multiplexer circuit 624A. Correspondingly, the control signal generating circuit 616 includes a control circuit 629A and a counter 630A, which are different from the aforementioned control circuit 629 and counter 630. When an enlargement ratio of 1.2 is indicated by the mode bits M0 and M1, the control circuit 629A switches the enable signal EN to the low level every five pulses of the second clock signal CLK2. In response to the above switching, the counter 630A stops operating. Since each of the one-bit process circuits 620$A_1$–620$A_n$ has the five-bit structure, the counter 630A outputs the counter value consisting of three bits QA, QB and QC. The enlargement ratio 1.2 is indicated when the mode bits M0 and M1 are both 0, for example.

Figure 54:
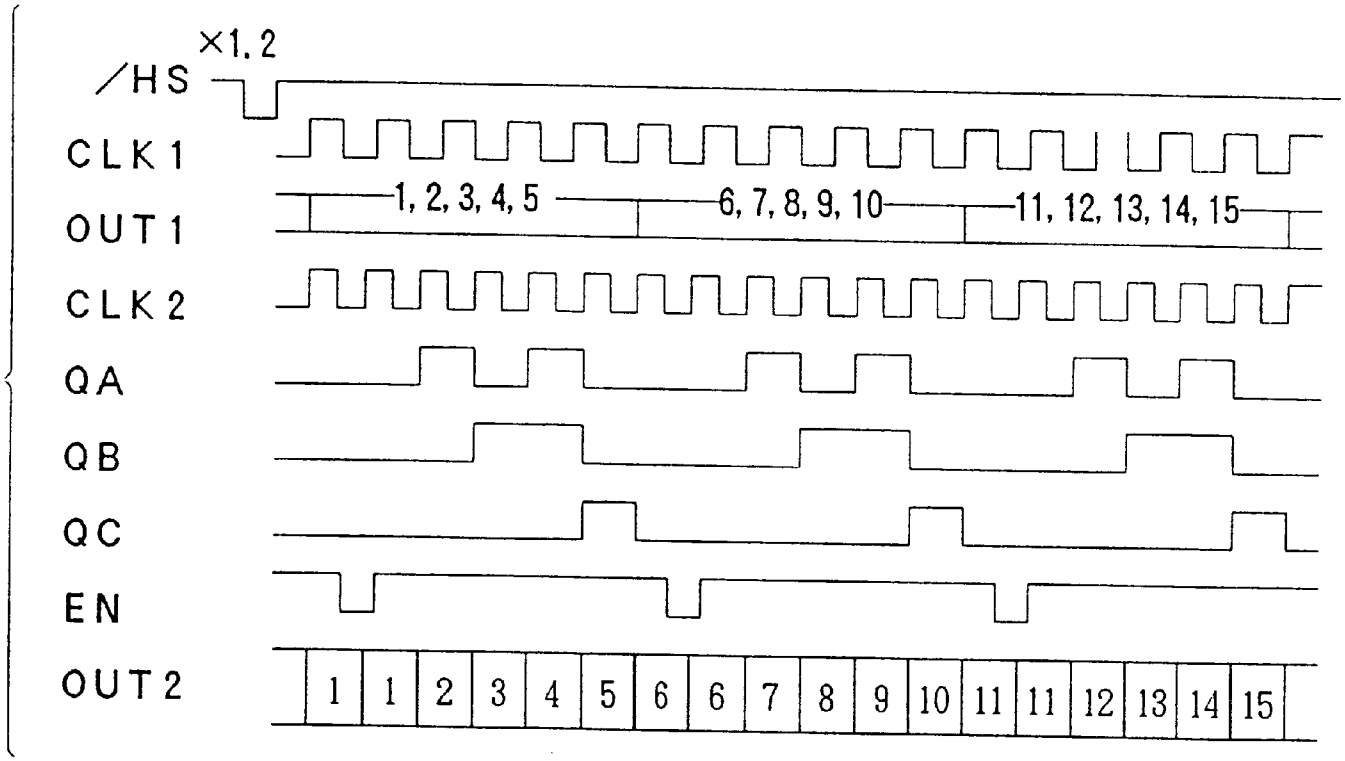
FIG. 54 is a timing chart of an operation of the eleventh embodiment of the present invention.

FIG. 54 is a timing chart of the operation of the liquid crystal display device shown in FIG. 53. As shown in FIG. 54, the enable signal EN is switched to the low level every five periods of the second clock signal CLK2, so that the counting operation of the counter 630A is stopped. Hence, image data 1, 6 and 11 are successively output twice.

According to the ninth through eleventh embodiments of the present invention, image data sampled by the first clock signal CLK1 synchronized with the image signal (pixel data) is processed in synchronism with the second clock signal CLK2 corresponding to the number of pixels of the panel 610 so that identical pixel data is successively output twice periodically under the control of the enable signal EN. Hence, an image can easily be enlarged in the horizontal direction at an arbitrary enlargement ratio externally selected and can be displayed on a high-precision panel.

The ninth through embodiments of the present invention can be applied to the first through eighth embodiments of the present invention mainly directed to an enlargement process in the vertical direction.

The present invention includes display devices of all matrix types. In other words, the present invention is not limited to the matrix-type liquid crystal display device.

The present invention is not limited to the specifically disclosed embodiments, and variations and modifications may be made without departing from the scope of the invention.

What is claimed is:

1. A display device comprising:

a display panel having display pixels arranged in matrix formation;

a first driver circuit which sequentially supplies image data to vertical lines of the display panel in synchronism with a first clock signal;

a second driver circuit which sequentially drives horizontal lines in synchronism with a second clock signal; and a control circuit which controls a drive timing at which said second driver circuit sequentially drives the horizontal lines so that identical image data is supplied from said first driver circuit in synchronism with the first clock signal to two consecutive horizontal lines every N horizontal lines (N is an integer) in accordance with a non-integer enlargement ratio at which an image is enlarged in a vertical direction and is displayed on the display panel;

wherein said control circuit controls said second driver circuit so that a predetermined amount of image data equal to two consecutive horizontal lines is supplied to each of the horizontal lines so that a first half of the predetermined amount of image data is supplied to one horizontal line and then a second half thereof is supplied to said one horizontal line; and said control circuit further controls said second driver circuit so that said second driver circuit drives two consecutive horizontal lines at each cycle of the second clock signal, and prevents the second half of the predetermined amount of image data from being supplied to said one horizontal line when said identical image data is supplied to one of said two consecutive horizontal lines.

2. The display device as claimed in claim 1, wherein said control circuit controls said second driver circuit so that each of the horizontal lines is supplied from said first driver circuit with said predetermined amount of image data equal to two consecutive horizontal lines within a period equal to twice the cycle of said second clock signal.

3. The display device as claimed in claim 1, wherein said control circuit generates an enable signal including a pulse which prevents the first driver circuit from supplying said identical image data to said one of the two consecutive horizontal lines.

4. The display device as claimed in claim 1, wherein said control circuit controls said second driver circuit so that the image data is sequentially supplied to the horizontal lines during a constant period less than the cycle of said second clock signal.

5. The display device as claimed in claim 1, wherein the number N can be externally selected based on the enlargement ratio so that the enlargement ratio can be changed.

6. The display device as claimed in claim 1, wherein said control circuit controls, on the basis of the enlargement ratio, a start horizontal line from which the image data is sequentially supplied to the horizontal lines.

7. The display device as claimed in claim 1, further comprising a second control circuit which controls a drive timing at which said first driver circuit sequentially supplies the image data to the horizontal lines so that identical pixel data contained in the image data is successively supplied to one horizontal line being driven every M pixels (M is an integer) in accordance with a second enlargement ratio at which an image is enlarged in a horizontal direction and is displayed on said display panel.

8. The display device as claimed in claim 7, wherein the number N is equal to the number M and the enlargement ratio relating to the vertical direction is equal to said second enlargement ratio relating to the horizontal direction.

9. The display device as claimed in claim 7, wherein said second control circuit controls said first driver circuit so that the image data is sequentially supplied to the horizontal lines in synchronism with a timing based on a number of pixels of said display panel and said second enlargement ratio relating to the horizontal direction.

10. The display device as claimed in claim 1, wherein said display panel is a liquid crystal display panel.

11. A method of controlling a display device comprising a display having display pixels arranged in matrix formation, said method comprising the steps of:

(a) sequentially supplying image data to vertical lines of the display panel in synchronism with a first clock signal;

(b) sequentially driving horizontal lines in synchronism with a second clock signal;

(c) controlling a drive timing at which the horizontal lines are sequentially driven by the step (b) so that identical image data is supplied in synchronism with the first clock signal to two consecutive horizontal lines every N horizontal lines (N is an integer) in accordance with a non-integer enlargement ratio at which an image is enlarged in a vertical direction and is displayed on the display panel;

(d) controlling the step (b) so that a predetermined amount of image data equal to two consecutive horizontal lines is supplied to each of the horizontal lines so that a first half of the predetermined amount of image data is supplied to one horizontal line and then a second half thereof is supplied to said one horizontal line; and (e) controlling the step (b) so that two consecutive horizontal lines are driven at each cycle of the second clock signal, and the second half of the predetermined amount of image data is prevented from being supplied to said one horizontal line when said identical image data is supplied to one of said two consecutive horizontal lines.

12. The method as claimed in claim 11, further comprising the step of controlling the step (b) so that each of the horizontal lines is supplied with said predetermined amount of image data equal to two consecutive horizontal lines within a period equal to twice the cycle of said second clock signal.

13. The method as claimed in claim 11, further comprising the step of controlling the step (b) so that the image data is sequentially supplied to the horizontal lines during a constant period less than the cycle of said second clock signal.

14. The method as claimed in claim 11, further comprising the step of controlling the step (a) so that identical pixel data contained in the image data is successively supplied to one horizontal line being driven every M pixels (M is an integer) in accordance with another enlargement ratio at which an image is enlarged in a horizontal direction and is displayed on the display panel.

15. A display device comprising:

a display panel having display pixels arrange in matrix formation;

a first drive circuit which sequentially supplies image data to vertical lines of the display panel in synchronism with a first clock signal;

a second driver circuit which sequentially drives horizontal lines in synchronism with a second clock signal; and a control circuit which controls a drive timing at which said second driver circuit sequentially drives the horizontal lines so that identical image data is supplied from said first driver circuit in synchronism with the first clock signal, to two consecutive horizontal lines every N horizontal line (N is an integer) in accordance with a non-integer enlargement ratio at which an image is enlarged in a vertical direction and is displayed on said display panel;

wherein said control circuit serially drives the two consecutive horizontal lines so that each of the two consecutive horizontal lines is driven for a period shorter than one cycle of the second clock signal.

16. The display device as claimed in claim 15, wherein:

the second driver circuit comprises a first circuit part and a second circuit part;

the first circuit part sequentially drives odd-numbered horizontal lines, and the second circuit part sequentially drives even-numbered horizontal lines;

the first and second circuit parts alternately drive the horizontal lines one by one; and the control circuit controls the first and second circuit parts in one cycle of the second clock signal so that one of the two consecutive lines is driven by the first circuit part and the other one of the two consecutive lines is driven by the second circuit part.

17. The display device as claimed in claim 15, further comprising a second control circuit which controls a drive timing at which said first driver circuit sequentially supplies the image data to the horizontal lines so that identical pixel data contained in the image data is successively supplied to one horizontal line being driven every M pixels (M is an integer) in accordance with a second enlargement ratio at which an image is enlarged in a horizontal direction and is displayed on said display panel.

18. The display device as claimed in claim 17, wherein the number N is equal to the number M and the enlargement ratio relating to the vertical direction is equal to said second enlargement ratio relating to the horizontal direction.

19. The display device as claimed in claim 15, wherein said display panel is a liquid crystal display panel.

20. A method of controlling a display device comprising a display panel having display pixels arranged in matrix formation, said method comprising the steps of:

(a) sequentially supplying image data to vertical lines of the display panel in synchronism with a first clock signal;

(b) sequentially driving horizontal lines in synchronism with a second clock signal; and (c) controlling the step (b) so that identical image data supplied by the step (a) in synchronism with the first clock signal is supplied within one cycle of the second clock signal to two consecutive horizontal lines every N horizontal lines (N is an integer) in accordance with a non-integer enlargement ratio at which an image is enlarged in vertical direction and is displayed on the display panels;

wherein the step (c) serially drives the two consecutive horizontal lines so that each of the two consecutive horizontal lines is driven for a period shorter than one cycle of the second clock signal.

21. The method as claimed in claim 20, wherein:

the step (b) comprises the step (b-1) of alternately driving the horizontal lines one by one via a first circuit part and a second circuit part; and the step (c) comprises the step of controlling the step (b-1) in one cycle of the second clock signal so that one of the two consecutive lines is driven by the first circuit part and the other one of the two consecutive lines is driven by the second circuit part.

22. The method as claimed in claim 20, further comprising the step of controlling the step (a) so that identical pixel data contained in the image data is successively supplied to one horizontal line being driven every M pixels (M is an integer) in accordance with a second enlargement ratio at which an image is enlarged in a horizontal direction and is displayed on the display panel.

23. A display device comprising:

a display panel having display pixels arranged in matrix formation;

a first circuit which samples an image signal by a first clock signal synchronized with the image signal, and performs a predetermined process for sampled image data, said predetermined process being carried out by a second clock signal depending on a number of the display pixels of said display panel;

said first circuit including an A/D converter which converts the image signal in analog formation into serial digital data, a serial-to-parallel converter which converts the serial digital data into parallel data, a latch circuit which latches the parallel data, and a multiplexer which sequentially selects data contained in the parallel data;

said A/D converter and said serial-to-parallel converter operate in synchronism with the first clock signal, and said multiplexer operates in synchronism with the second clock signal;

a second circuit which produces the first clock signal and the second clock signal; and said second circuit including a first generator circuit which produces the first clock signal synchronized with the image signal, a second generator circuit which produces the second clock signal based on the number of the display pixels of said display panel, a counter which counts the second clock signal to thereby produce a select signal by which the multiplexer sequentially selects the data contained in the parallel data, and a control circuit which controls the counter on the basis of an enlargement ratio, whereby an image having a smaller number of dots than the number of pixels of said display panel can be enlarged and displayed.

24. The display device as claimed in claim 23, wherein the control circuit stops the counter counting the second clock signal on the basis of the enlargement ratio.

25. The display device as claimed in claim 23, wherein said second circuit further comprises a circuit which discriminates the enlargement ratio from horizontal and vertical synchronizing signals contained in the image signal, so that the second circuit controls the counter based on the enlargement ratio thus discriminated.

26. The display device as claimed in claim 23, wherein:

said first circuit comprises an A/D converter which converts the image signal in analog formation into digital data, and a frame memory which stores the digital data every predetermined number of bits;

said A/D converter operates in synchronism with the first clock signal;

a write operation of the frame memory is carried out in synchronism with the first clock signal; and a read operation of the frame memory is carried out in synchronism with the second clock signal.

27. The display device as claimed in claim 26, wherein said second circuit comprises a first generator circuit which generates the first clock signal synchronized with the image signal, a second generator circuit which generates the second clock signal based on the number of the display pixels of said display panel, and an address counter which counts the second clock signal in accordance with the enlargement ratio so that an address used to read the digital data from the frame memory is generated.

28. The display device as claimed in claim 27, wherein the address counter stops counting at a predetermined timing based on the enlargement ratio.

29. The display device as claimed in claim 27, wherein said second circuit further comprises a circuit which discriminates the enlargement ratio from horizontal and vertical synchronizing signals contained in the image signal, so that said second circuit controls the counter based on the enlargement ratio thus discriminated.

* * * * *